United States Patent [19]

Stirbis et al.

[11] Patent Number: 4,741,266

[45] Date of Patent: May 3, 1988

[54] CAN DECORATING APPARATUS

[75] Inventors: James S. Stirbis, Littleton; Chet L. Rose, Lakewood; Roscoe W. O'Hair, Golden, all of Colo.

[73] Assignee: Adolph Coors Company, Golden, Colo.

[21] Appl. No.: 916,604

[22] Filed: Oct. 8, 1986

[51] Int. Cl.[4] ..... B41F 17/22

[52] U.S. Cl. ..... 101/40; 29/469; 101/248; 101/350

[58] Field of Search ..... 101/40, 39, 38 A, 217, 101/218, 177, 247, 248, 352, 351, 350, 216; 29/428, 469

[56] References Cited

U.S. PATENT DOCUMENTS

| | | | |
|---|---|---|---|
| 3,041,967 | 7/1962 | Nystrand | 101/218 X |
| 3,163,109 | 12/1964 | Stelling, Jr. | 101/248 X |
| 3,262,384 | 7/1966 | Dubuit | 101/217 X |
| 3,371,603 | 3/1968 | Brigham | 101/177 X |
| 3,584,579 | 6/1971 | Rothenberg | 101/350 |
| 3,613,571 | 10/1971 | Russell et al. | 101/40 |
| 3,735,697 | 3/1973 | Provan | 101/37 |
| 3,786,747 | 1/1974 | Szpitalak | 101/40 X |

FOREIGN PATENT DOCUMENTS

| | | | |
|---|---|---|---|
| 126160 | 7/1983 | Japan | 101/218 |
| 8200777 | 10/1982 | Netherlands | 101/40 |
| 83/01040 | 3/1983 | PCT Int'l Appl. | 101/40 |
| 2146291 | 4/1985 | United Kingdom | 101/216 |

*Primary Examiner*—Clifford D. Crowder
*Attorney, Agent, or Firm*—Klaas & Law

[57] ABSTRACT

A decorator apparatus and methods for applying an ink image to cylindrical can body members comprising multiple station ink supply and transfer apparatus for transferring ink from an ink fountain to a blanket wheel through a plate cylinder with ink image registration adjustment apparatus and axial and circumferential tightness control apparatus operatively associated with each plate cylinder and each ink supply and transfer apparatus.

71 Claims, 29 Drawing Sheets

CAN DECORATING APPARATUS

BACKGROUND & SUMMARY OF INVENTION

This invention relates to can decorating apparatus and more particularly to can decorating apparatus with new and improved apparatus for applying a multiple-color decorative image to the cylindrical outer surface of a one-piece aluminum or steel can body member of a two-piece can assembly.

Decorators of this general type are described and shown in the following U.S. Pat. Nos., the disclosures of which are incorporated herein by reference: Sirvet 4,037,530; McMillin et al. 4,138,941; Dugan, et al. 4,222,479; Stirbis 4,267,771; Hahn 4,441,418; Stirbis 4,445,431; Stirbis 4,491,068; Stirbis 4,498,387; and Stirbis 4,509,555.

In general, decorator apparatus of this type comprises a rotatable mandrel wheel means for supporting can body embers on circumferentially spaced mandrel members; infeed means for loading undecorated can body members onto the mandrel members; a rotatable inking blanket wheel means having circumferentially spaced blanket segment members thereon for applying ink images to the can body members; a plurality of ink fountain means for holding a supply of ink of different colors; an ink transfer system associated with each ink fountain means including a plurality of circumferentially spaced ink stations each having an ink transfer roll members associated with each ink fountain means for transferring ink from the fountain means to a plate cylinder means and then to the blanket segment members; a transfer wheel means for receiving decorated can body members from the mandrel wheel means; a pin-chain means for receiving decorated can body members from the transfer wheel means and transferring the decorated can body members to a drying oven means. Such decorator apparatus is continuously operated by a motor means and a drive means with the various wheel means rotating synchronously. The construction and arrangement is such that each can body member is decorated along approximately 20 degrees of each 360 degree revolution of the mandrel wheel means when in contact with a blanket segment. Decorator apparatus of this type are operable between relatively low speeds of approximately 500 cans per minute and relatively high speeds of 1200 to 1400 or more cans per minute. In addition, such decorators may employ relatively few ink stations, e.g., 2 or 3 or may employ a relatively large number of multiple-color ink stations, e.g. 4 to 6, as illustrated by U.S. Pat. Nos. of Urban 3,996,851 and vander Griendt et al., 4,337,719.

In any event, a critical aspect of satisfactory operation is that each ink image derived from each separate ink station must be applied to the cylindrical surface of the blanket segments on the blanket wheel in a precise manner requiring the use of the proper amount and distribution of ink and proper alignment (i.e., registration) of the image relative to the blanket segment surfaces. Registration involves proper correlation of the image relative to the central longitudinal axis and circumference of the blanket segment members for transfer to the can body members as discussed in Stirbis, U.S. Pat. No. 4,491,068, the disclosure of which is incorporated herein by reference. The general term "registration" applies to both adjustment of alignment under static conditions when the decorator is not operating (running) and to dynamic conditions when the decorator is operating (i.e., "running registration" adjustment).

In the past, various ink transfer system registration adjustment mechanisms have been provided which have been generally relatively inaccurate, complicated, difficult to adjust and subject to misadjustment and misalignment during operation due to machine vibration and individual and tolerance variations of individual parts and cumulative tolerance variations of multiple parts. In general, misadjustment and misalignment can result from relative axial displacement and relative circumferential displacement and lack of parallelism of rotational axes between the various parts.

Proper alignment of the plate cylinder relative to the blanket wheel and blanket segment members is critical to obtaining a good ink image and to registration of the image with the can body members. In the past, the plate cylinder means and the ink transfer roll members for transferring ink from the fountain means to the plate cylinder means have been constructed and arranged as a sub-assembly unit whereby adjustment, misadjustment, replacement and/or removal of any one part affects the entire sub-assembly. Also, the drive systems for the ink transfer system have been constructed and arranged in a manner resulting in substantial vibration and application of forces tending to cause misalignment and malfunction of the plate cylinder means. Various prior art constructions and arrangements are shown in the following U.S. Pat. Nos. Brigham 3,223,028; Zurich 3,491,686; Szpitalak 3,786,747; Zurick 3,817,209; Skrypek 3,859,919; VanDer Roer 4,455,934; and Shirmizer 4,519,310.

In a can manufacturing line, prior art decorators have been responsible for as much as fifty percent of the scrap generated during operation of the can line. In addition, when frequent adjustments of registration are required, down-time of the can line is substantially increased. Some prior art decorators require that operation of the decorator be stopped in order to make registration adjustments. Other prior art decorators have employed apparatus intended to enable "running registration" adjustment but the adjustment apparatus has been relatively inaccurate and difficult to operate, and often unreliable and subject to relatively rapid loss of accuracy during operation. Another problem with prior art decorators has been the use of plate cylinder assemblies which are connected to the same drive system as the ink transfer rolls and are assembled and mounted as a unit including both the plate cylinder means and the ink transfer roll means. Thus, the plate cylinder means is subject to cumulative tolerance variations (slop) and vibration of the ink transfer roll system. Also, repair, maintenance, and replacement of parts of the plate cylinder and inker roll system often produces adverse effects on all parts of the unitary system requiring substantial down-time and readjustment of the entire alignment system.

The present invention provides a construction and arrangement to overcome the prior art problems relating to the ink station apparatus. The plate cylinder means for each status are each constructed, arranged, and mounted as a separate sub-assembly unit having new and improved alignment and registration means. The ink fountain means and ink transfer roll means for each station are also constructed as a separate sub-assembly unit having a separate support frame means. Each sub-assembly unit is precision-mounted on a single vertical frame plate means by special high precision mounting support means mounted in relatively non-critically dimensioned mounting holes and slots in the vertical frame plate means. New and improved alignment adjustment and mounting means are associated with the roll means and new and improved drive means are provided for separately driving the roll means and the plate cylinder means.

Each of the plate cylinder means are separately custom fitted and aligned on the vertical frame plate means with high precision during assembly at the factory. All of the plate cylinder means have separate drive gear means driven directly by the main bull gear which drives the blanket wheel and are mechanically separate from and independent of the ink roll system. Each plate cylinder means has an independent alignment and adjustment system which enables highly accurate alignment and adjustment both during assembly and during operation of the machine. Each of the ink transfer roll and fountain systems are separately constructed, assembled and mounted as a removable and replaceable unit. All of the roll-fountain units are of the same design and construction so as to be interchangeable at the various inking stations on the decorator. All of the roll-fountain units are separately driven by a separate timing belt-pulley drive system to substantially eliminate drive system vibration. Each roll-fountain unit has an independent separate alignment and adjustment system which enables highly accurate alignment and adjustment both before and during operation of the decorator. The apparatus is constructed and arranged to substantially eliminate misalignment problems due to tolerance variations of particular parts and accumulated total tolerance variations between parts which can result in axial and circumferential and parallelism misalignment problems due to "slop" between parts and "wobble" of parts. It is intended that the total tolerance variation be reduced to below 0.003 inch and preferably to 0.0005 inch or lower. Other advantages and improvements of apparatus and methods are described hereinafter.

BRIEF DESCRIPTION OF THE DRAWING

Presently preferred and illustrative embodiments of the invention are shown in the accompany drawings wherein.

DETAILED DESCRIPTION

In General

Figure 1:
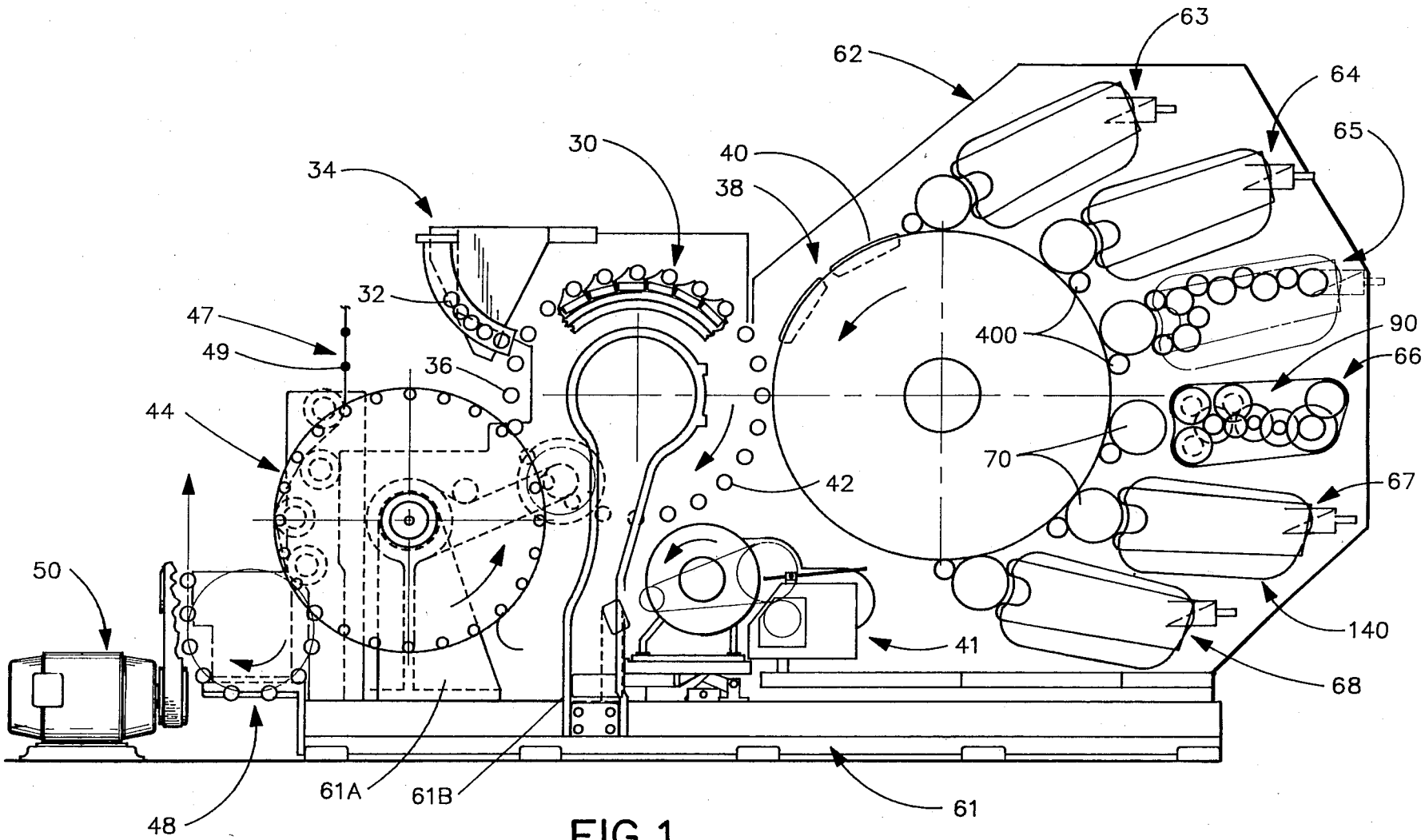
FIG. 1 is a schematic partial front side elevational view of a decorator employing the inventive concepts.
Figure 2:
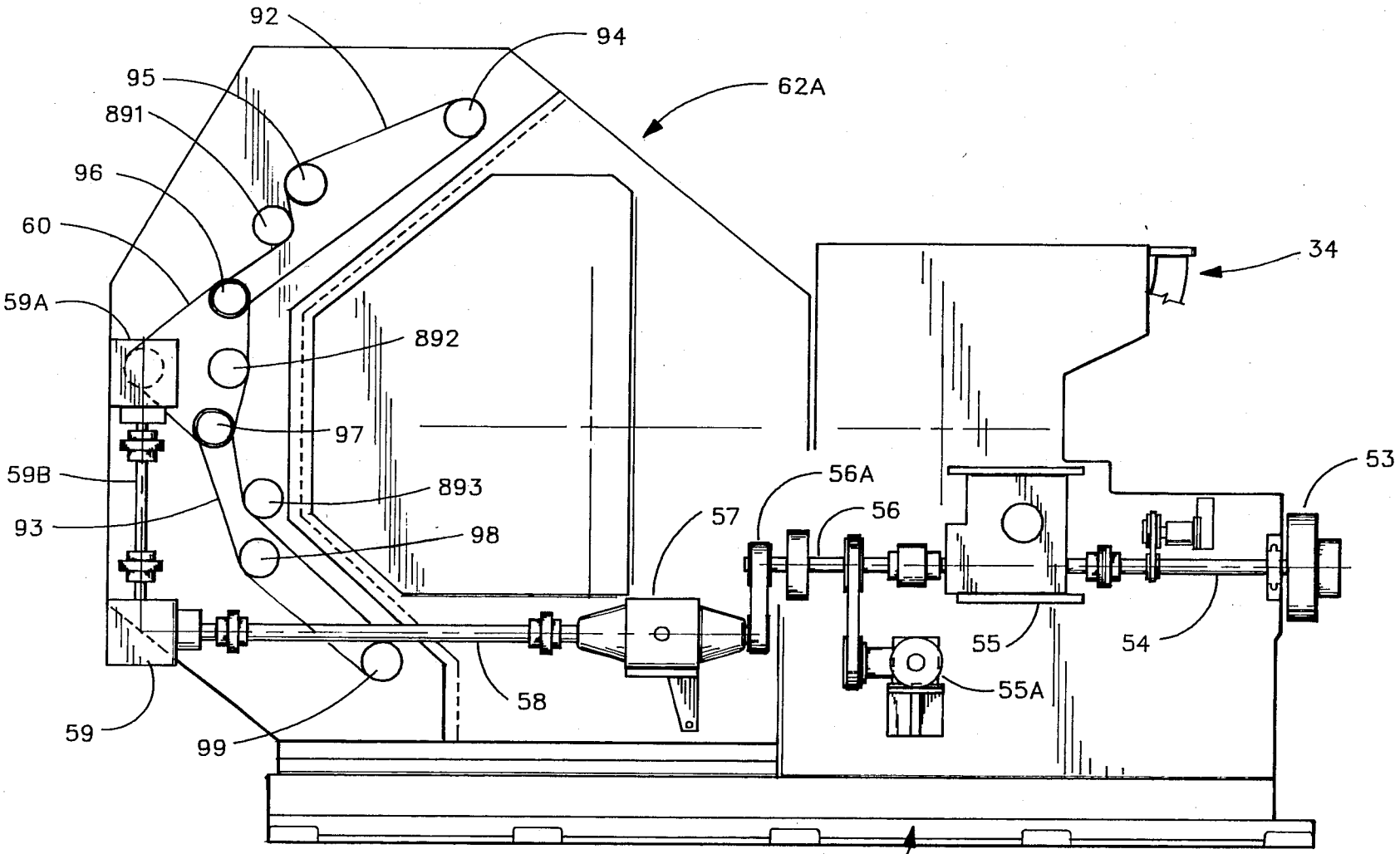
FIG. 2 is a partial rear view of the decorator of FIG. 1.
Figure 3:
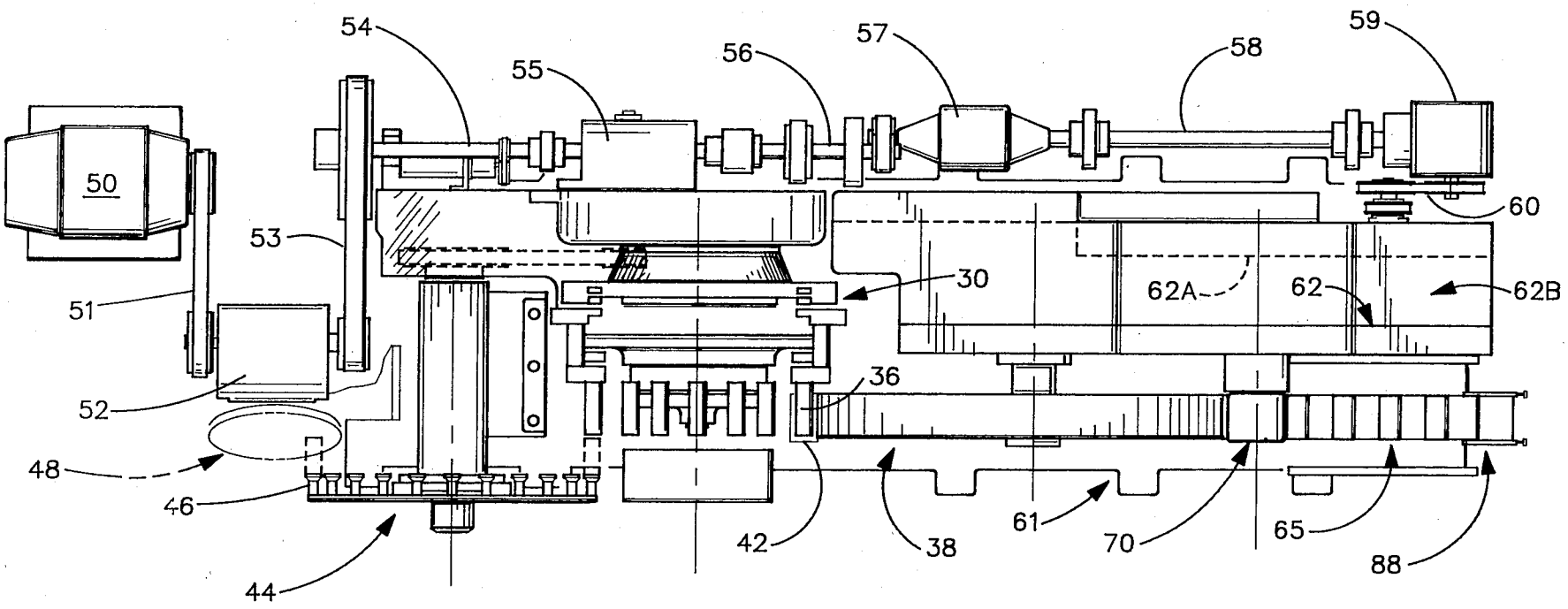
FIG. 3 is a top plan view of the decorator of FIG. 1.
Figure 4:
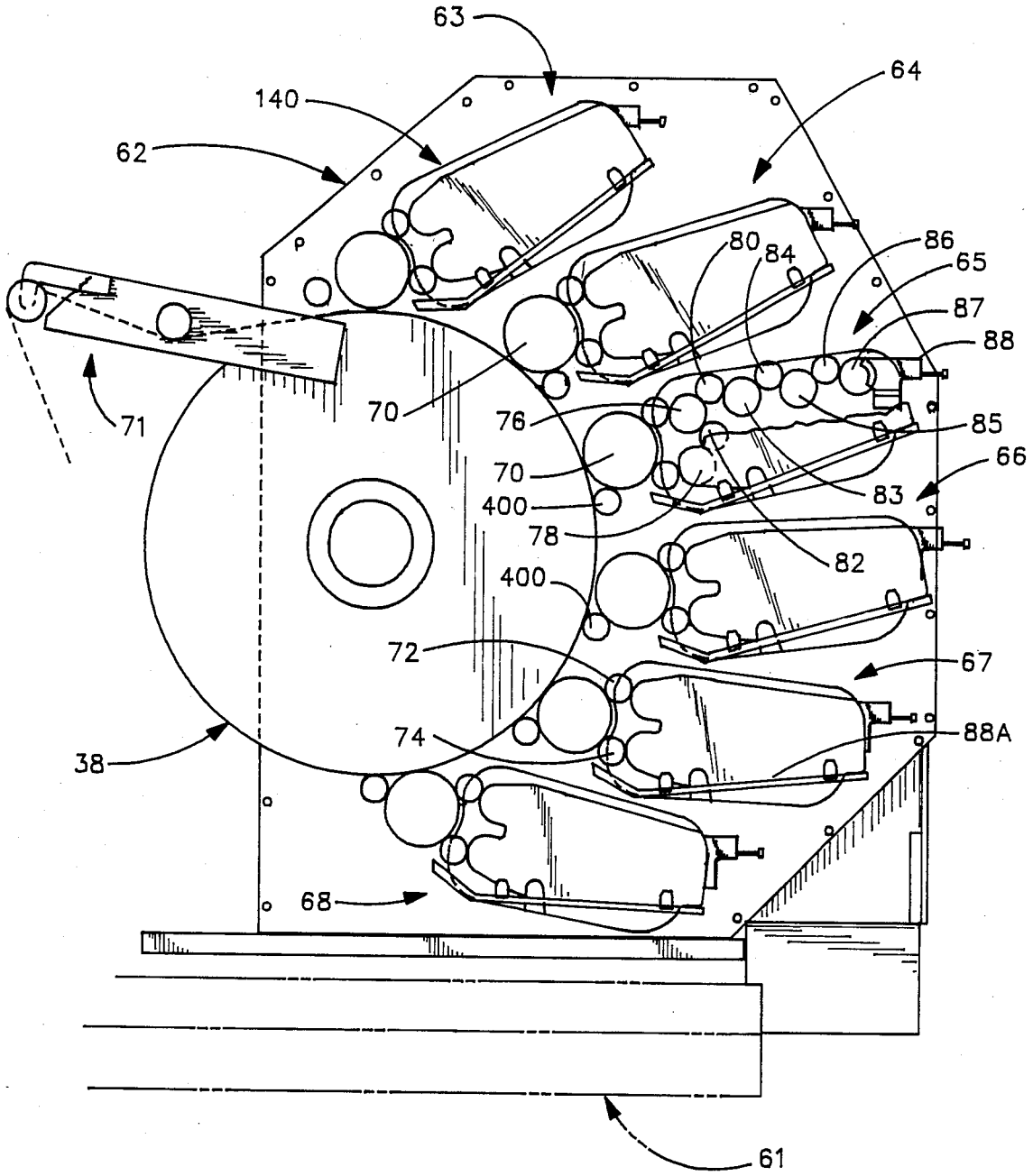
FIG. 4 is an enlarged schematic front side elevational view of the inking station section of the decorator.
Figure 5:
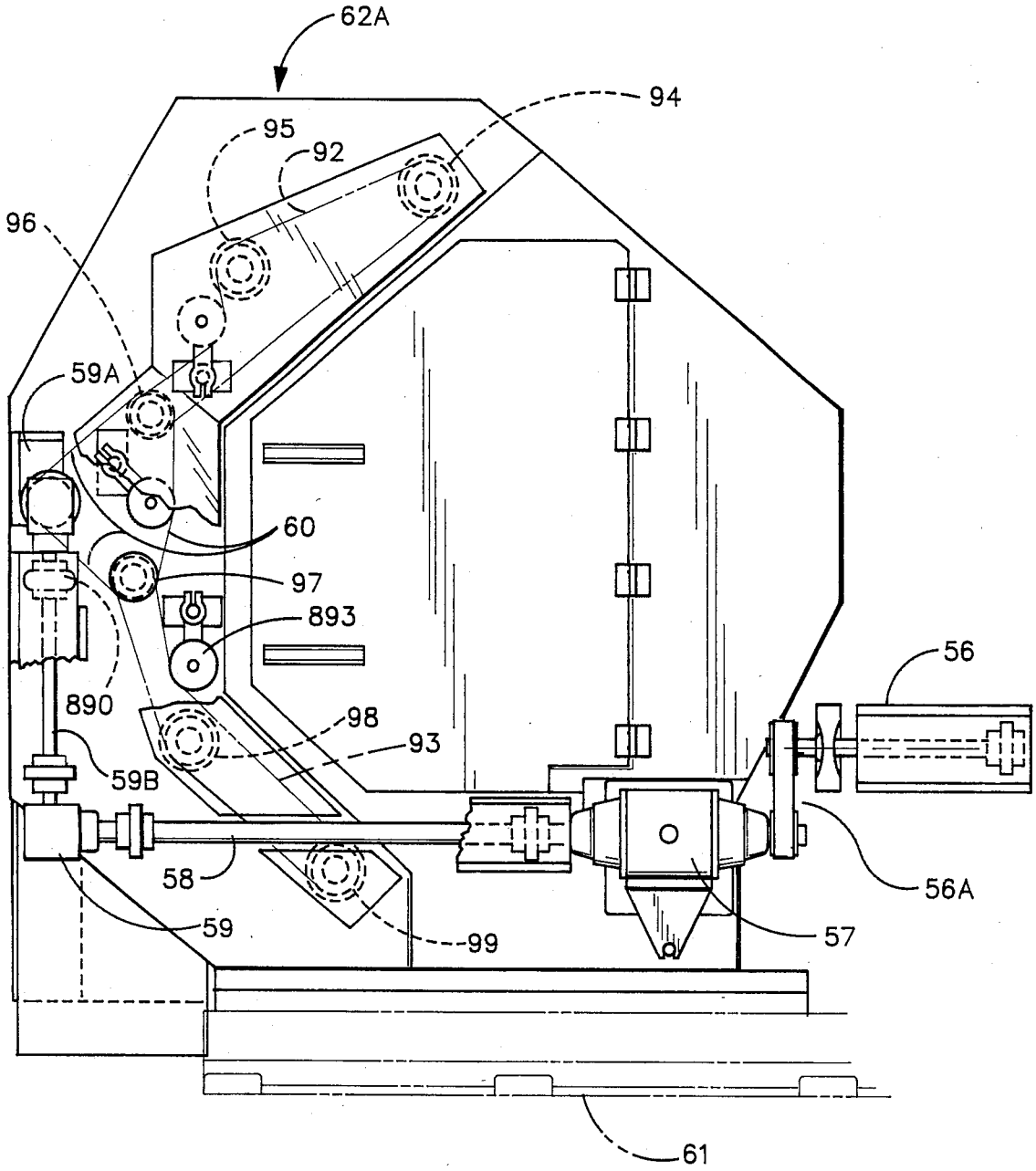
FIG. 5 is an enlarged rear side view of the inking station section.
Figure 6:
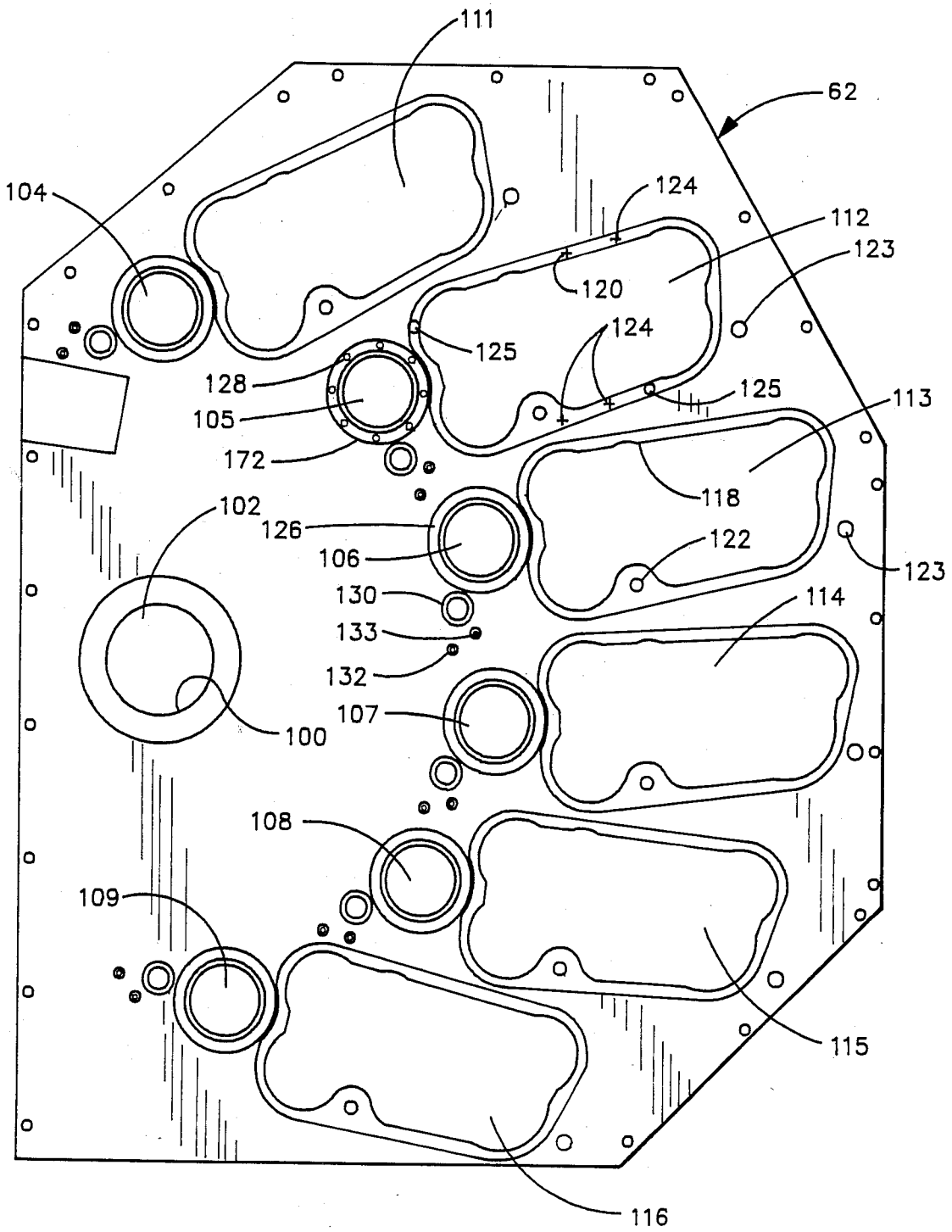
FIG. 6 is an enlarged side elevational view of the main multiple ink station vertical frame plate means for a decorator with six inking stations.

In general, FIGS. 1–5 show a decorator apparatus comprising a mandrel wheel means 30 for receiving undecorated can body members 32 from an infeed means 34. Can body members 32 are supported on a plurality of equally circumferential spaced mandrel means 36 for movement with the mandrel wheel means past a blanket wheel means 38 which carries a plurality of circumferentially spaced blanket segment means 40 having ink and inked images thereon. Each blanket segment means 40 engages the cylindrical outer peripheral surface of a can body member 32 to apply variable color ink and ink images thereon in the form of a label including a brand name, printed matter, decorative images, etc. An overvarnish means 41 may be provided to apply an overvarnish coating material to the inked can members as described in U.S. Pat. No. 4,441,418. Decorated can body members 42 are carried to a transfer wheel means 44 and transferred from the mandrels 36 to carrying devices 46 such as suction cup support members as described in U.S. Pat. Nos. 4,445,431 and 4,509,555. Decorated can members are carried on transfer wheel means 44 to a pin-chain means 47 driven by a sprocket wheel means 48 and having pin members 49, which receive the decorated can members from the transfer wheel means 44. An electric motor-type drive means 50 is connected by suitable transmission apparatus to each of the driven devices, FIGS. 2, 3, including belt means 51, gear box means 52, belt means 53, a main shaft means 54, gear box means 55 for driving the mandrel wheel and the transfer wheel, belt driven gear box means 55A for driving the overvarnish means 41, shaft and coupling means 56, belt and pulley means 56A, gear box means 57 for driving the blanket wheel and associated plate cylinders 70, shaft and coupling means 58, gear box means 59 and 59A and shaft and anti-vibration coupling means 59B and belt-pulley means 60 for driving the inker station roll systems, all of which are synchronously driven for the intended purposes. A main base frame means 61 and vertical support devices 61A, 61B, etc. support the aforedescribed apparatus in a conventional manner. The blanket wheel means 38 and ink station apparatus are supported by a vertically extending rigid plate frame means 62 as shown in FIGS. 1, 4 and 6 and located in a housing means comprising a rear plate means 62A and side panels 62B of FIG. 3. A plurality of circumferentially-spaced ink transfer roll and fountain means 63, 64, 65, 66, 67, 68 are mounted on frame plate means 62 for supplying ink to the separate individual blanket segment means 40 through an equal number of plate cylinder means 70 at six separate inking stations during rotation of the blanket wheel means 38 which has a pre-spin belt frame and pulley assembly 71, FIG. 4.

Figure 29:
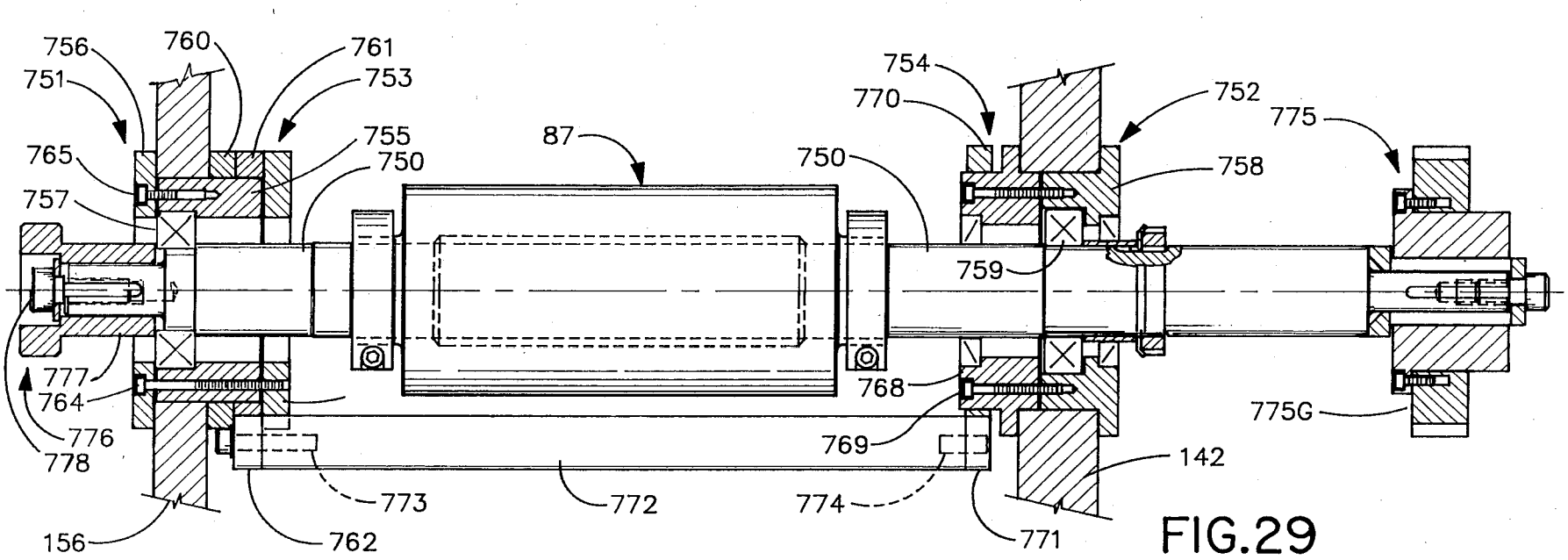
FIG. 29 is a side elevational view, partly in crosssection, of a fountain roller assembly.
Figure 31:
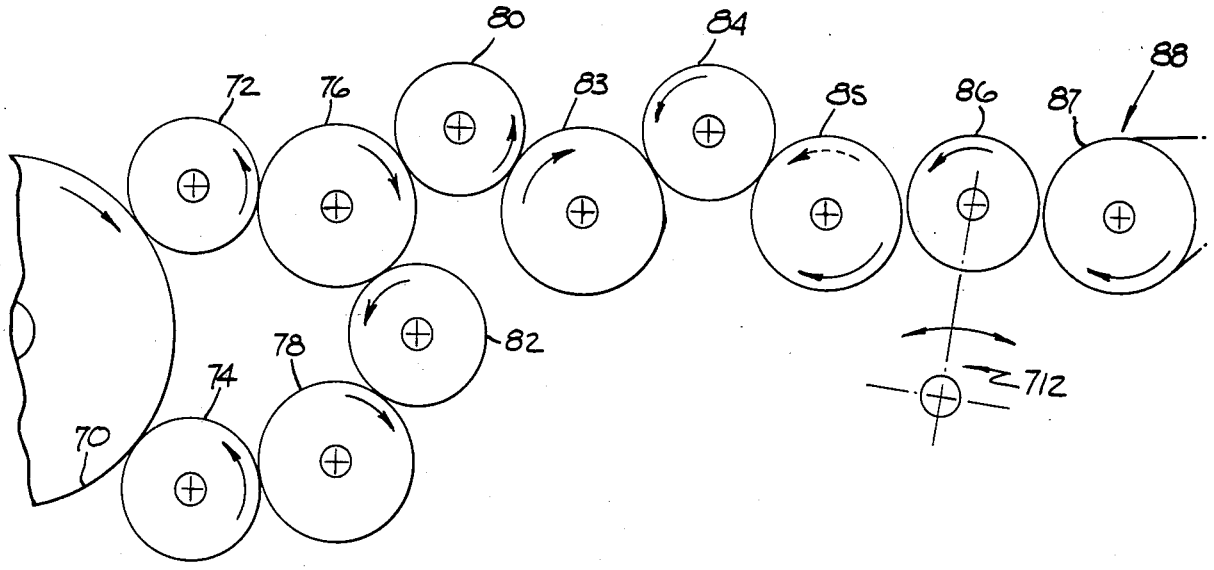
FIG. 31 is a schematic side elevational view of the ink applying and transfer roll system.

As shown in FIGS. 4 and 31, each of the ink applying stations comprises a plate cylinder means 70, a pair of rubber-form roll means 72, 74, a pair of vibrator roll means 76, 78, at least one pair of intermediate rubber roll means 80, 82, a vibrator roll means 83, an intermediate roll means 84, a steel distributor roll means 85 and an oscillating ductor roll means 86 associated with a fountain roll means 87 and ink supply fountain means 88. A gear train-type roll drive means 90 for operation of the roll means at each station is shown in FIGS. 1 and 29. Each of the plate cylinder means 70 are separately driven by the bull gear associated with blanket wheel means 38 so as to be completely independent of roll drive means 90 of each ink station, FIG. 1, which are driven by toothed timing belts 60, 92, 93 and pulley devices 94, 95, 96, 97, 98, 99, FIGS. 2, 15. Belt drive pulley devices 96, 97 which drive belt 92 associated with pulleys 94, 95, 96 and belt 93 associated with pulleys 97, 98, 99.

Ink Station Frame and Support Means

Referring now to FIG. 6, ink station frame means 62 comprises one piece of heavy rigid metallic plate-type material which has relatively accurately machined and properly located mounting bore means including a central bore means 100 for receiving a blanket wheel shaft means and bearing mounting means, illustrated at 102 and rotatably supporting the blanket wheel means 38 in proper parallel aligned relationship with mandrel wheel means 30. A plurality of circumferentially spaced, generally parallel plate cylinder assembly hub mounting bores 104, 105, 106, 107, 108, 109 are located radially outwardly of bore means 100 along a common arc for receiving hub members 172 for mounting separate individual plate cylinder assemblies as hereinafter described. A plurality of circumferentially spaced elongated mounting slots 111, 112, 113, 114, 115, 116 are located radially outwardly of and in juxtaposition to each of mounting bores 104, 105, 106, 107, 108, 109. Each mounting slot has a variably contoured machined inner side surface 118, a flanged machined side surface 120, support rod bores 122, 123, and a plurality of mounting bolt bores 124 associated therewith. Adjacent each plate cylinder mounting bore and dowel pin holes 125 is a radially outwardly spaced threaded bore 130 for supporting plate cylinder control apparatus, and a pair of radially outwardly spaced guide shaft support bores 132, 133 associated with bore 130.

Figure 9:
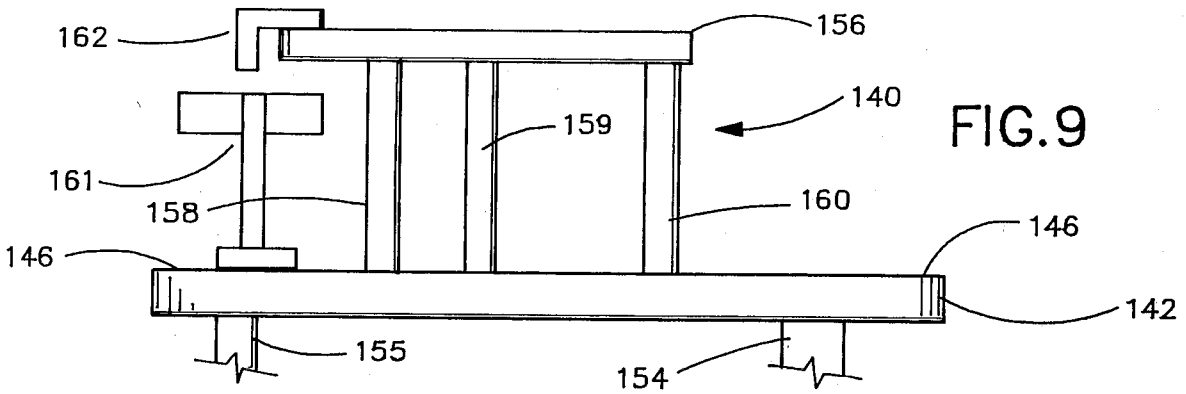
FIG. 9 is a partial top view of the frame means of FIGS. 7 & 8.
Figure 8:
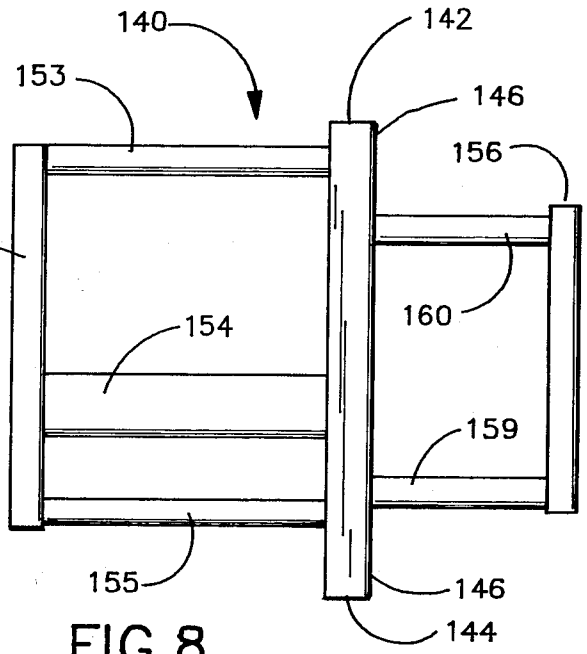
FIG. 8 is an end view of the individual inker station frame means of FIG. 6.
Figure 7:
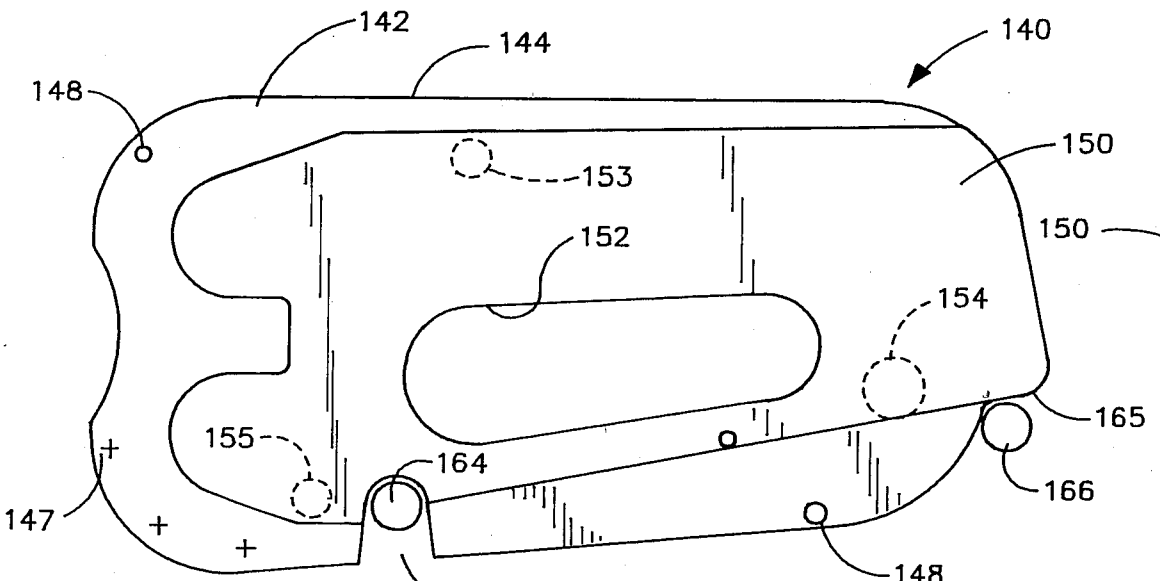
FIG. 7 is an enlarged side elevational view of an individual ink station frame means.

As shown in FIGS. 7–9, each inking station has a separate individual support frame assembly 140 comprising a central main plate member 142 having an outer peripheral surface 144 generally corresponding to the contour of flanged side surface 120 of the mounting slots 111–116, but of larger size, to provide a peripheral side abutment surface portion 146 adapted to abut support plate side surface 120, a plurality of bolt mounting bores 147 adapted to align with support plate bolt bores 124, and a plurality of dowel pin bores 148 adapted to align with support plate dowel bores 125 to receive locating dowel pin devices. A slot 149 is provided to receive a guide support rod fastened in support plate rod hole 122 to guidingly support the frame 140 during mounting on plate means 62. A front side plate member 150 having a slot 152 is fixedly attached to central plate member 142 by crossbar members 153, 154, 155 to provide a roll-ink fountain space for mounting of the roll members and ink fountain. A rear side plate member 156 of smaller peripheral size than the mounting slots, so as to be laterally movable therethrough, is fixedly attached to central plate member 142 by cross-bar members 158, 159, 160 to provide a gear-mounting space for mounting of the roll driving gears as hereinafter described. Cam follower mounting bracket means 161, 162, FIG. 9, are mounted between plate members 142, 156. Bottom surface 165 of front plate 150 is slidably engageable during assembly with a support guide rod 166 mounted in support plate hole 123.

Plate Cylinder Assembly

Figure 10:
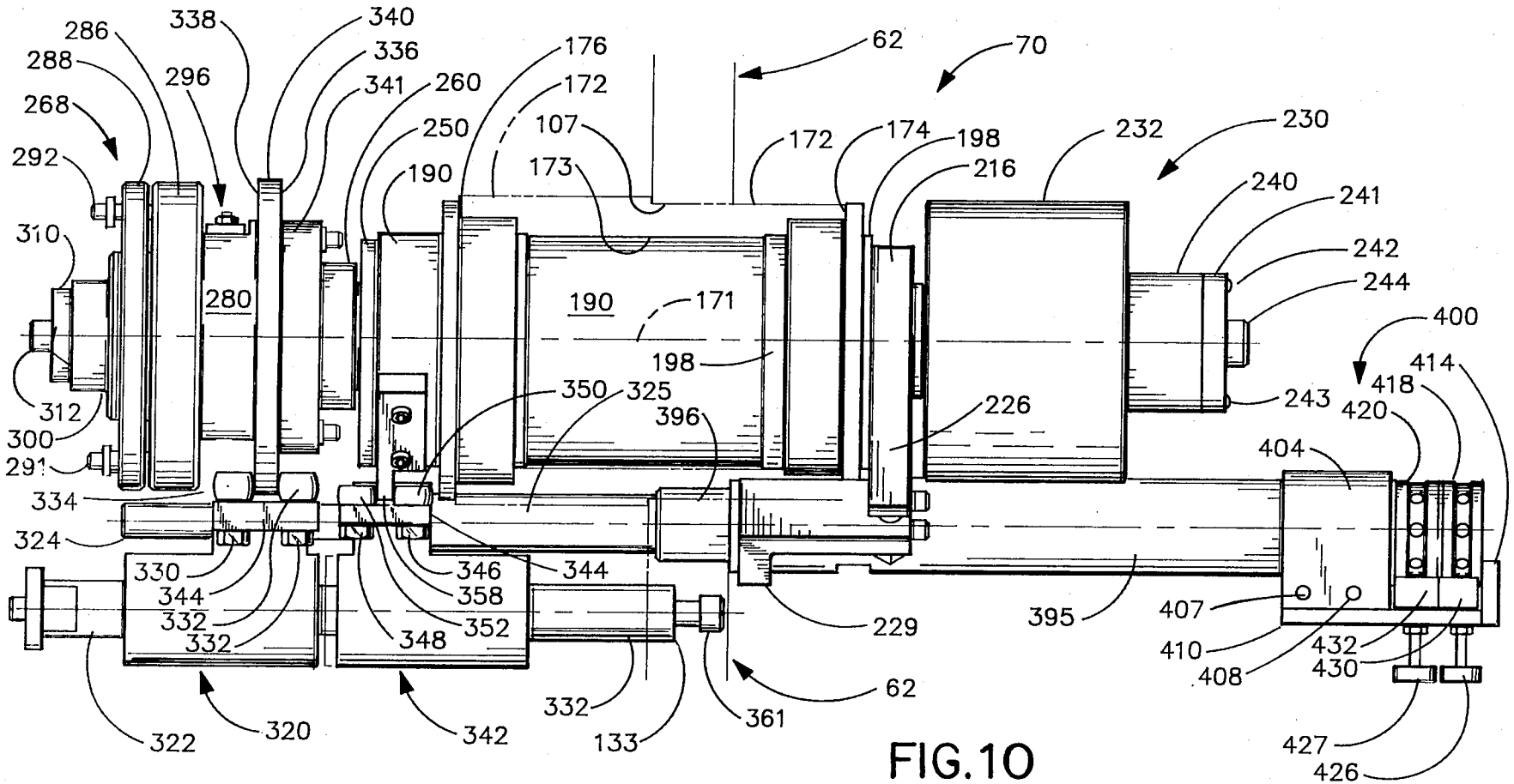
FIG. 10 is an enlarged side elevational view of a plate cylinder assembly.

The plate cylinder assemblies 70 for ink stations 64–68 are of identical construction and arrangement. The plate cylinder assembly at station 63, shown in FIGS. 10 and 14, is essentially the same as the other plate cylinder assemblies except that some alignment adjustment control parts are mounted in different locations because of space requirements.

Figures 11, 13:
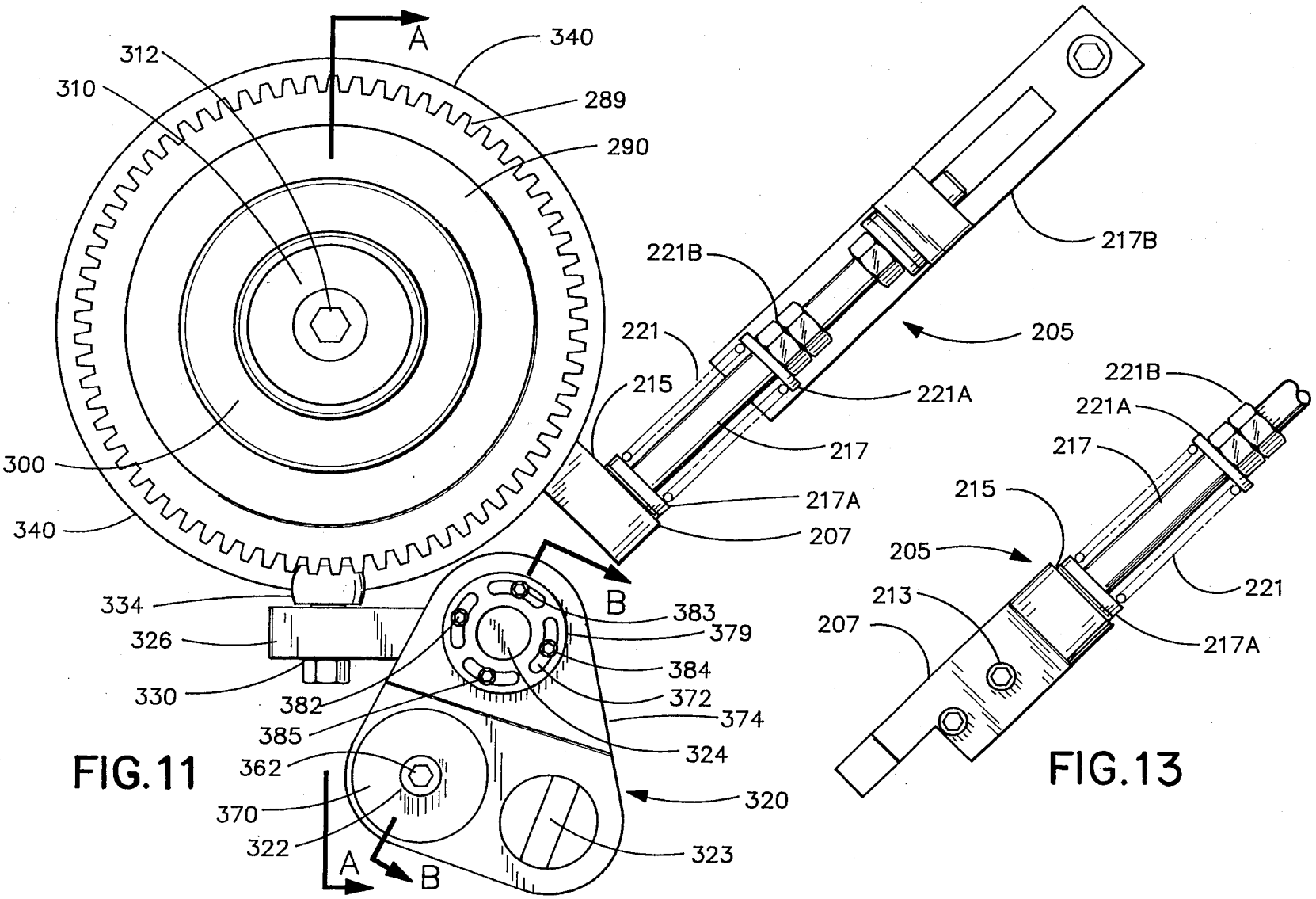
FIG. 11 is an end view of a plate cylinder assembly.
FIG. 13 is a partial side elevational view of stop apparatus shown in FIG. 11.
Figure 12:
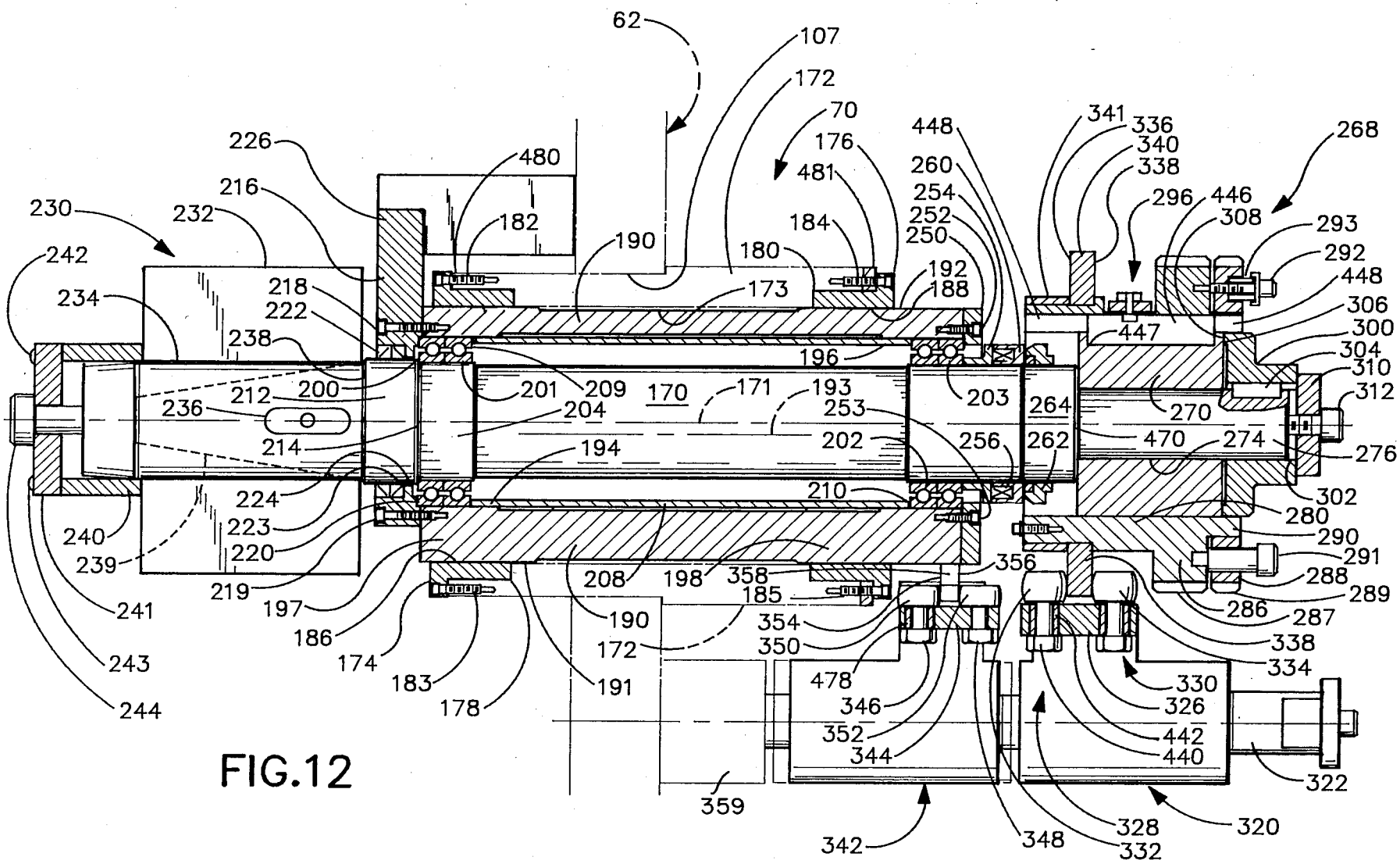
FIG. 12 is an enlarged cross-sectional view of a plate cylinder assembly taken along line A—A in FIG. 11.
Figure 14:
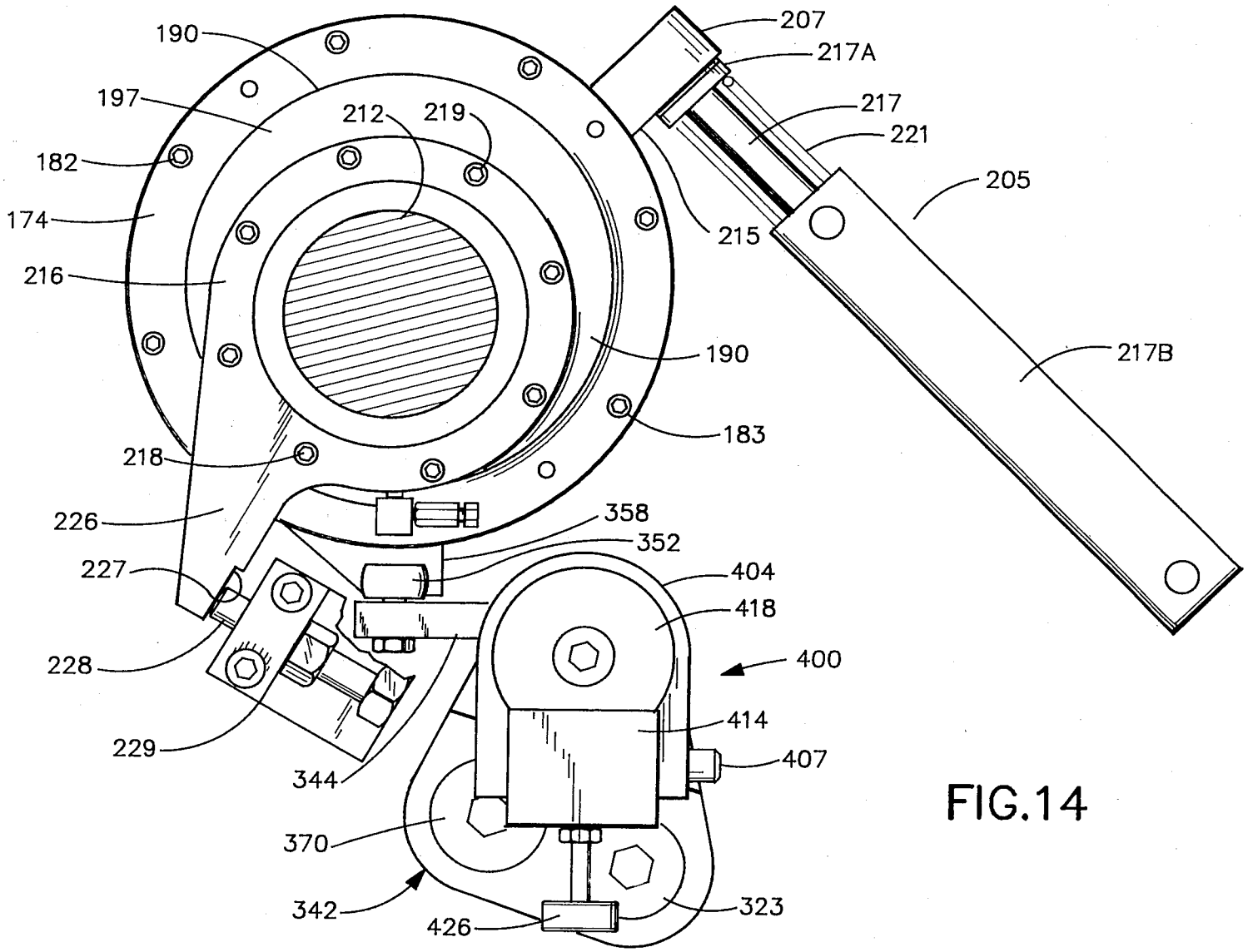
FIG. 14 is a cross-sectional view of the plate cylinder assembly of FIG. 10.

Referring now to FIGS. 10–17, each plate cylinder assembly 70 comprises a central highly accurately machined shaft member 170, FIG. 12, having a central axis of rotation 171 and rotatably supported in a cylindrical support hub member 172 having a central bore 173 and fixedly mounted in a frame plate bore 107. As shown in FIG. 12, a pair of flanged sleeve members 174, 176 are fixedly mounted in counterbores 178, 180 in hub members 172 by bolt members 182, 183, 184, 185 mounted in bolt holes 128, FIG. 6, in end portion 126, and provide aligned coaxial precision machined and located central bores 186, 188 as hereinafter described. An eccentric sleeve member 190 has precision machined coaxial cylindrical outer peripheral end surfaces 191, 192 with a central longitudinal axis 193 eccentric to shaft axis 171 and precision machined cylindrical central end bore portions 194, 196 with a central axis coaxial with shaft axis 171. Opposite end portions 197, 198 of eccentric sleeve member 190 are rotatably supported in bore portions 186, 188 of sleeve members 174, 176. Opposite pairs of conventional high-speed precision ground grinding machine-type bearing units 200, 201, 202, 203 are mounted in bore portions 194, 196 of eccentric end portions 197, 198 and spaced intermediate drive shaft portions 204, 206. A cylindrical spacer sleeve member 208 has end surface portions 209, 210 which abut bearing units 201 and 202 and enable axial force transfer therebetween. An enlarged diameter intermediate portion 212 of drive shaft 170 provides an annular shoulder 214 for abutting engagement with the inner race of bearing unit 200. An end plate member 216 is fixedly attached to eccentric sleeve member 190 by suitable bolt means 218, 219 and has a shoulder portion 220 for engaging the outer race of bearing unit 200. Sealing units 222, 223 abut a radially inwardly extending flange portion 224 of end plate 216. A flange portion 226 of end plate 216 extends radially outwardly and has a radially extending abutment surface 227, FIGS. 14 and 17, engageable with an axially adjustable bolt means 228 on a fixedly mounted bracket member 229 to enable a turning force to be applied thereto to cause rotation of sleeve member 190 and change the eccentric location of shaft rotational axis 171 relative to axis 193. As shown in FIG. 14, the end plate 216, flange portion 226 and bracket member 229 are located in a different position at station 63.

As shown in FIGS. 11, 13 and 14, a resilient compressible counter stop means 205 is provided in the form of a bracket member 207 fixed to hub end portion 192 by bolt means 213 with an abutment surface 215 engaging a stop rod member 217 having a head portion 217A and axially adjustably mounted on a fixed bracket member 217B. A compression spring 221 is mounted circumjacent rod member 217 between head portion 217A and an abutment ring member 221A associated with adjustment nuts 221B to enable adjustment of the spring force applied to stop 215. The arrangement of FIG. 14 is used at station 63.

A precision-machined plate cylinder member 230, FIG. 12, having a cylindrical peripheral surface 232 is fixedly mounted on shaft end portion 234 by suitable key means 236 in abutting engagement with a shaft shoulder portion 238. In a presently preferred embodiment, shaft portion 234 has an outwardly tapered conical peripheral configuration as illustrated by dotted lines 239 for tightly slidably fitting into a corresponding conical bore in the cylinder member 230 for accuracy and ease of alignment. Plate cylinder 230 is fixedly mounted on shaft portion 234 in precise parallel coaxial relationship for rotation with shaft 170 by an end cap assembly comprising a sleeve member 240, an end plate member 241, fastening members 242, 243 and an end bolt member 244.

Bearing units 202, 203, FIG. 12, are held in position by an outer end plate member 250 which is fixed to eccentric member 190 by suitable bolt members 252, 253 and a flanged axially slidable inner sleeve member 254 which is engaged by compression spring means 256 in an axially slidable support ring member 260 held on intermediate shaft portion 206 by a threaded lock ring 262 on threaded shaft portion 264.

The plate cylinder drive means 268, FIGS. 12, 12A, 12B and 12C, comprises a drive sleeve member 270 having a central cylindrical bore 272 and is rotatably supported on a cylindrical surface 274 of drive shaft end portion 276. A rotatable and axially slidably movable ring gear member 280 has a central cylindrical bore 282, FIG. 12B, mounted on a cylindrical outer peripheral surface 284 of sleeve member 270 so as to be axially slidably therealong. An annular radially outwardly extending ring gear flange portion 286 has helical gear teeth 287 on the outer periphery thereof. Conventional self-adjusting anti-backlash means comprises an anti-backlash ring gear member 288 having helical teeth 289 corresponding to teeth 287 and axially slidably mounted on a hub portion 290 of gear member 280 by guide pin bolt members 291 and spring bolt members 292 which include compression spring members 293 to axially bias the ring gear member 288 toward flange member 286 while enabling axial sliding movement away therefrom. Both sets of helical gear teeth engage a helical drive bull gear member 294, FIG. 12B, which is the bull gear that also drives the blanket wheel means. Ring gear member 280 is drivably connected to sleeve member 270 by key means 296 which enables axial adjustment as hereinafter described in detail. An annular friction-drive sleeve end cap member 300 is slidably mounted on drive shaft portion 276 by a central bore 302 and is drivably connected thereto by a key means 304. Sleeve member 270 is drivably connected to sleeve member 300 by radially extending axially abutting friction drive surfaces 306, 308 to enable slippage under excessive jam condition loads. An end cap 310 and a bolt 312 attached to shaft portion 276 axially retain the assembly.

Plate Cylinder Adjustment Means

Figure 15:
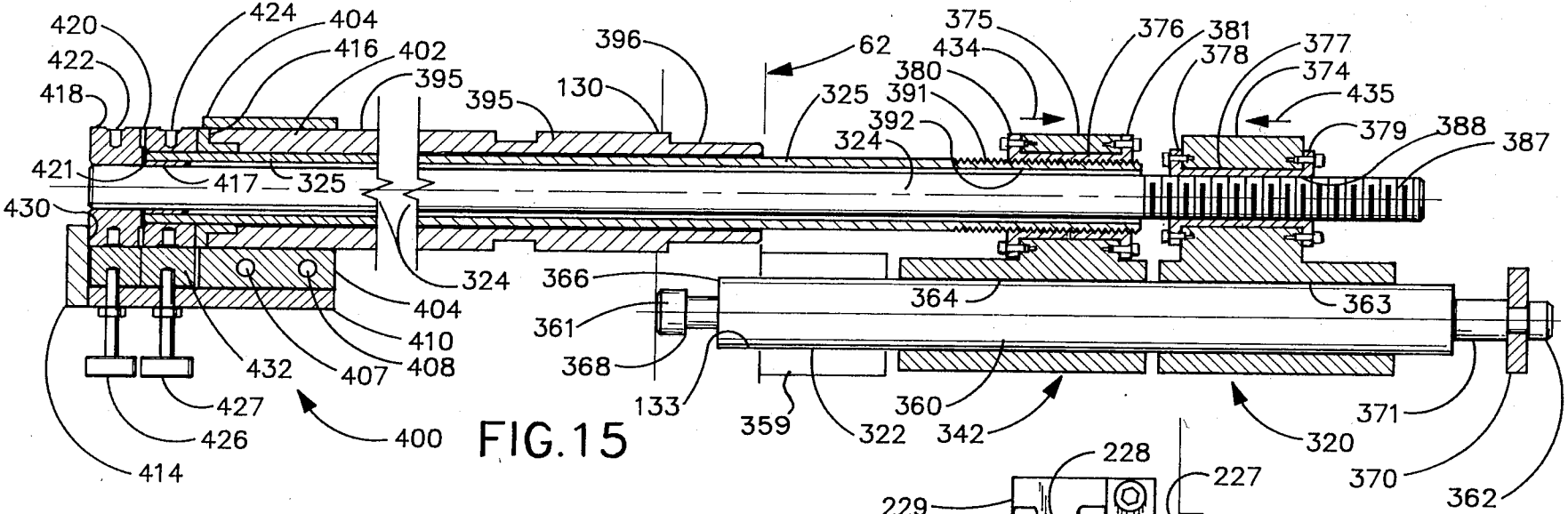
FIG. 15 is a cross-sectional side elevational view of the slide block and adjustment control apparatus of the plate cylinder assembly.

In order to precisely adjust and maintain the axial location of gear 280 relative to shaft 170 for proper image height registration, an adjustable slide block means 320 is axially slidably mounted on a guide shaft means 322, 323, FIGS. 11, 12 and 15, and are axially drivably mounted on a threaded adjustment shaft means 324 mounted in a threaded adjustment sleeve shaft means 325. A flange portion 326, FIGS. 11 & 12, rotatably supports a pair of cam follower-type roller assemblies 328, 330 which have crown surface roller members 332, 334 engageable with opposite surfaces 336, 338 of an annular flange member 340 suitably fixed to drive gear member 280 by a sleeve member 341 so as to be rotatable therewith. In order to precisely adjust and maintain the axial location of shaft 170 and eccentric sleeve 190 relative to support housing 172 for proper image circumferential registration, a similar adjustable slide block means 342 has a flange portion 344 supporting roller assemblies 346, 348 with crown surface roller members 350, 352 engageable with opposite side surfaces 354, 356 of a flange member 358 fixed to eccentric sleeve member 190.

As shown in FIG. 15, guide shaft members 322, 323 are fixedly mounted in support plate holes 132, 133 and support blocks 359 affixed to the support plate 62. Adjustment shaft members 324, 325 are mounted in fixed parallel relationship in hole 130 of support plate means 62. Each guide shaft member 322, 324 comprises an elongated cylindrical central portion 360 having threaded central bores in the end portions to receive bolt means 361, 362. Central portion 360 is mounted in coaxial bores 363, 364 of slide block means 320, 342. Mounting holes 132, 133 have an enlarged counterbore 366 which receives the adjacent end portion of central shaft portion 360, and an enlarged counterbore 368 which receives the head of threaded bolt member 361. A stop plate 370 is fastened on reduced diameter shaft end portion 371 by bolt member 362.

Slide block means 320, 342 have radially extending portions 374, 375 with coaxial central bores 376, 377. Each of flanged sleeve members 378, 379 and 380, 381 are similarly mounted in each of the bores 376, 377 by suitable threaded fastening means 382, 383, 384, 385, as shown in FIG. 11, extending through arcuate slots 372 in the flange portion to enable adjustment rotation of each sleeve relative to the bolts 379. A shaft member 324 has a threaded end portion 387, FIG. 15, engageable witn threaded central bore portions 388 of each of sleeve members 378, 379. Concentric coaxial sleeve-type shaft member 325 is mounted circumjacent shaft member 324 and has a threaded end portion 391 engageable with threaded central bore portions 392 of each of sleeve members 380, 381. Shaft member 324 and sleeve shaft member 325 are relatively rotatably mounted in a fixed, rigid support tube member 395 having an end portion 396 threadably fixed in bore 130 in frame plate support means 62.

Figure 16:
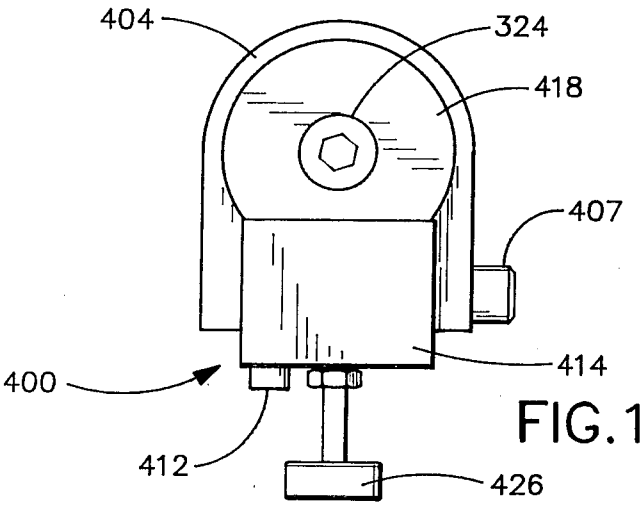
FIG. 16 is a left end view of the adjustment control apparatus of FIG. 15.

Micrometer-type shaft-slide block adjustment control means 400, FIGS. 15 and 16, are mounted on end portion 402 of support tube member 395 by support bracket means comprising a bifurcated clamp-type housing member 404 adjustably clampingly secured to housing tube 395 by fastening bolt means 407, 408; a plate member 410 secured by fastening bolt means 412, and an end plate 414 with an abutment surface 415. Sleeve shaft member 325 is rotatably supported in a flanged bushing member 416 and shaft member 324 is rotatably supported in a bearing sleeve 417 in sleeve shaft member 325. Adjustment control means 400 comprises ring members 418, 420 fixed to each of the shaft members 324, 325, respectively, and separated by a bearing ring member 421. Each ring member has a plurality of closely circumferentially spaced bores 422, 424 for receiving a turning tool (not shown) and is associated with locking clamp means in the form of threaded lock bolt members 426, 427 mounted in threaded holes in plate member 410 and extending into saddle-shape friction-type clamping block members 430, 432 engageable with the periphery of the ring members 418, 420. Thus, each of the bolt members 426, 427 may be separately loosened to enable selective rotation of the ring members 418, 420 and associated shaft members 324, 325 to properly locate the slide block members 320, 342 and then tightened to fixedly locate the shaft members and the slide block members in any selectively adjustable position. Abutment surface 415 engages the side surface of ring member 418 to provide stop means preventing axial displacement of the ring members and associated shaft members.

Slide block members 320 and 342 are tightly connected to shaft members 324, 325 through adjustable threaded sleeve members 378, 379, 380, 381 so as to eliminate relative axial displacement due to thread tolerances or wear. By loosening the associated bolt members 382, 383, 384, 385, each of the sleeve members may be rotated relative to the shaft threads until the threads on the sleeve members are tightly engaged with the threads on the shaft members. Then the bolt members are tightened so as to prevent any relative axial displacement due to thread tolerances. The construction and arrangement is such that oppositely facing pairs of sleeve members 378, 379 and 380, 381 are rotatable in opposite directions on threaded shaft portions 387 and 391 to create oppositely axially directed forces, as indicated by arrows 434, 435, FIG. 15, between the teeth on the sleeve members and the teeth on the shaft members. As shown in FIG. 12, axial play or looseness of slide block member 320 relative to the drive gear means 280 is eliminated by adjustment of the location of roller means 332 relative to flange surface 336 by loosening nut member 440 and turning the roller shaft in an eccentric sleeve 442 until the roller surfaces firmly abut the opposite side surfaces 336, 338 of flange 340 fixedly attached to gear member 280 to prevent axial play therebetween. A similar eccentric sleeve 478 is associated with roller means 350, 352 of slide block 342 for a similar purpose.

Figure 12A:
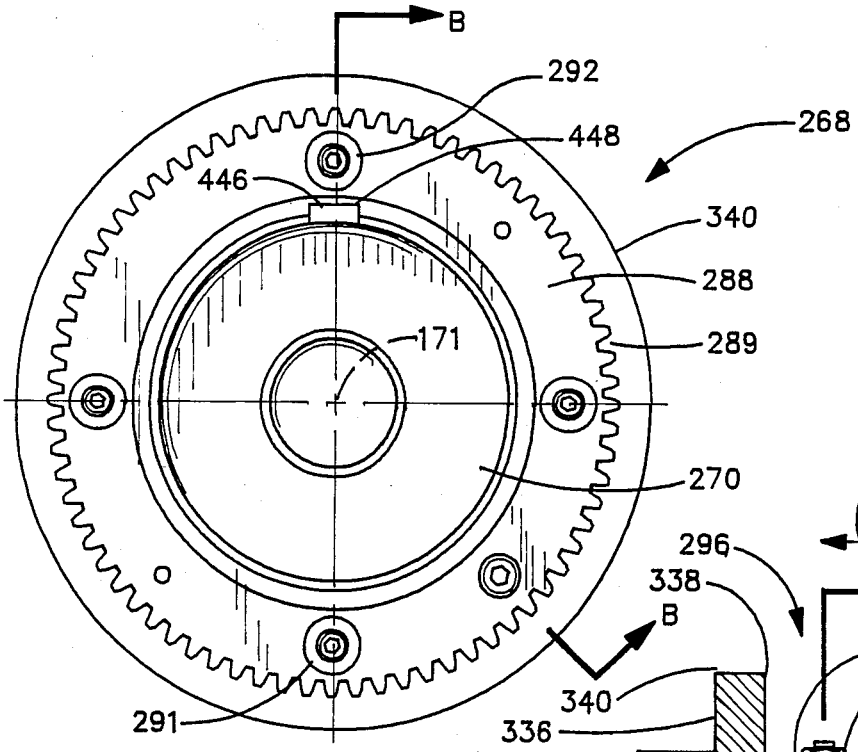
FIG. 12A is a right end view of a portion of the plate cylinder drive means shown in FIG. 12.
Figure 12B:
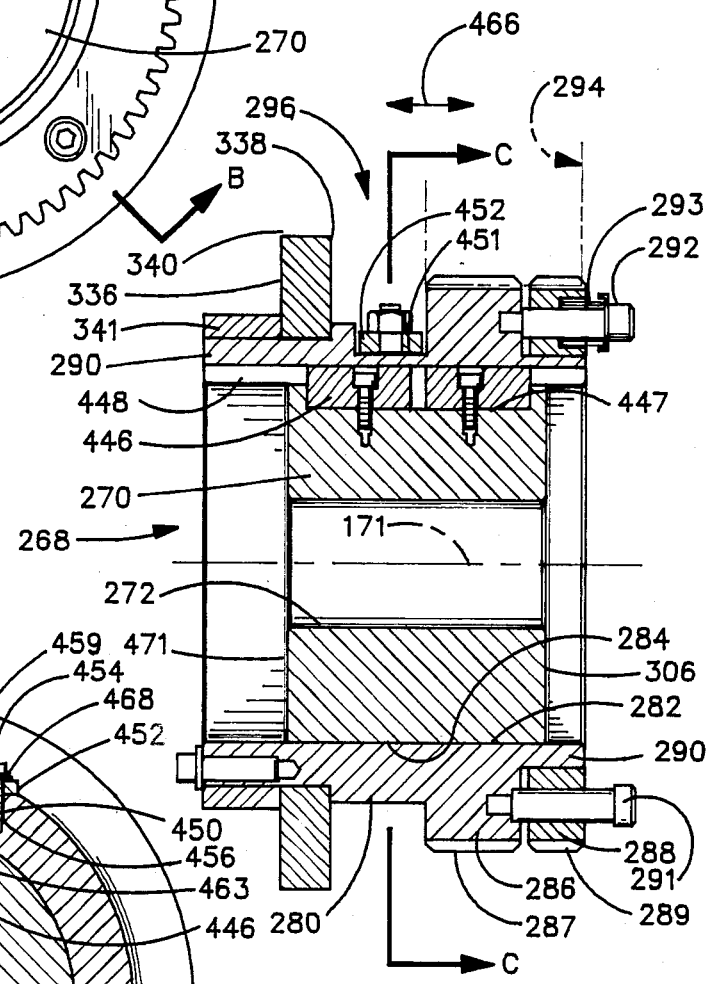
FIG. 12B is a cross-sectional view of the drive means of FIG. 12A taken along line B—B.
Figure 12C:
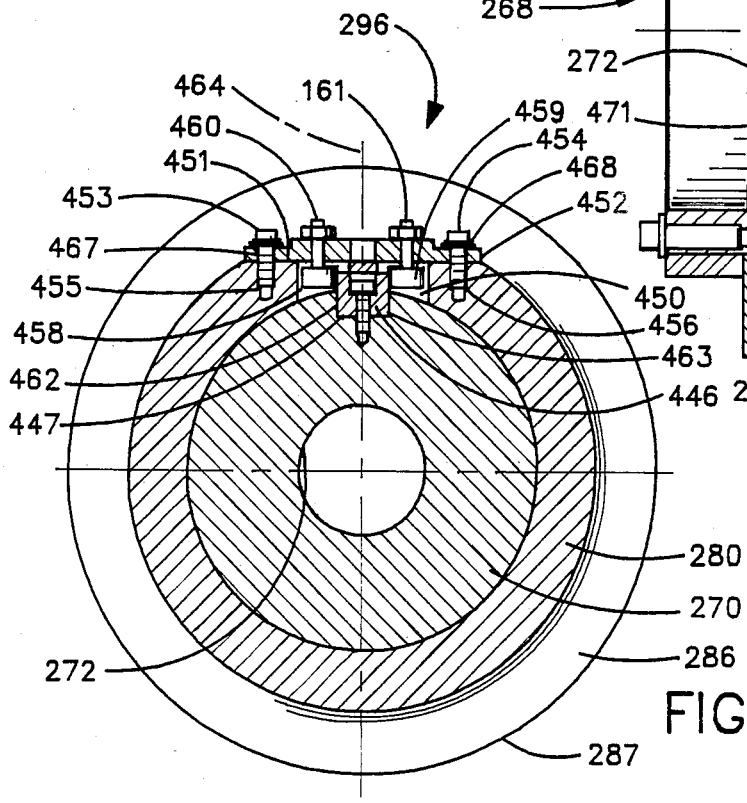
FIG. 12C is another cross-sectional view of the drive means of FIGS. 12A and 12B taken along line C—C.

Adjustable kkey means 296, FIGS. 12A, 12B and 12C, comprises an elongated key member 446 of square cross-sectional shape fixedly mounted in an elongated slot 447 in drive hub member 270 and in an elongated slot 448 extending completely through gear member 280 to enable axial movement of gear member 280 relative to hub member 270 caused by axial displacement of slide block 320. Axial movement of gear member 280 causes rotation of shaft 170 due to engagement of helical teeth 287 with the helical teeth of bull gear 294. A rectangular-shape cross lot 450, FIG. 12C, is provided in gear gear member 280 opposite a portion of key slot 447 and a flat abutment surface 451 is provided on the outer periphery of gear member 280 to abuttingly support a rectangular-shape adjustment plate member 452. Threaded fastening bolt members 453, 454 extend through arcuate slots in plate member 452 into threaded bores 455, 456 in gear member 280. A pair of roller members 458, 459 are mounted on plate member 452 by threaded fastening means 460, 461 so as to be abuttingly engageable with opposite side surfaces 462, 463 of key member 446. When bolt members 453, 454 are loosened, opposite end portions of plate member 452 are pivotally adjustably movable in opposite directions relative to abutment surface 451 about central axis 464, as indicated by arrow 466, and relative to the bolt members along arcuate slots 467, 468. In this manner, the roller surfaces are brought into tight abutting engagement with key surfaces 462, 463 and bolts 453, 454 are then tightened to maintain such engagement without circumferential play therebetween.

As shown in FIG. 12, drive hub means 270 is axially fixed on shaft 170 by side surface abutting engagement between side surface 470 and shaft shoulder surface 471, FIG. 12B, and shaft abutting driving engagement between friction drive end surface 306 and friction drive surface 308 of drive cap member 300, FIG. 12, which is fixedly axially located by end plate 310 and bolt member 312. Axial play of shaft 170 is restricted by threaded ring member 262 on threaded shaft portion 264 which tightly abuts spring ring 260 and exerts an axially directed force through flanged sleeve member 254, abutting bearing assemblies 202, 203, sleeve member 208 and abutting bearing assemblies 200, 201 onto shaft shoulder surface 214 and fixed end plate shoulder surface 220. Bearing assemblies 200, 201, 202, 203 are precision ground high performance with axially offset inner and outer race pockets to enable transmission of axial force without binding. The outer peripheral end portion surfaces 474, 475 of main shaft housing 190 and bores 186, 188 of bearing sleeve members 174, 176 are precision ground to very close tolerances to provide close fitting sliding support means therebetween. Axial play is restricted by the threaded mounting of slide block member 342, rollers 350, 352 and flange 358 with roller 350 mounted in an eccentric sleeve 478 to enable fixed abutting engagement between rollers 350, 352 and flange 358 as previously described with respect to slide block 320.

Thus, the plate cylinder registration adjustment means are constructed and arranged to provide very precise micrometer type adjustment and to maintain registration during operation of the decorator, i.e., "running" registration, as well as when the decorator is inoperative. The registration adjustment control means 400 are conveniently located adjacent each plate cylinder assembly. Actuation of slide block means 320 causes micrometer type axial shifting movement of helical gear means 280 relative to the helical gear teeth on the bull gear 294 which causes the plate cylinder shaft 170 the be turned about axis 170 to vary the circumferential registration of the ink image applied to the can body members. Actuation of the slide block means 342 causes axially shifting micrometer-type movement of the plate cylinder shaft and support housing 190 to vary the height registration of the ink image applied to the can body member. After the micrometer-type registration adjustments have been made, the plate cylinder 230 is maintained in the adjusted registration position with minimal variation due to the fixed tight abutting relationship of the drive apparatus, the shaft support apparatus, the slide block apparatus, and the adjustment control apparatus as provided by the various adjustable abutment means.

Manufacture And Mounting Of Plate Cylinder Assembly

In manufacture of the apparatus, the various cylinder assembly mounting holes 107 are relatively accurately machined in vertical support plate means 62 and housing members 172 are welded in the holes 107 in approximate parallel relationship. Then, the bores and end surfaces of the housing members 172 are machined precisely accurately by computer controlled precision machine tools. Then the vertical support plate means 62 is arcuately bolted to the main frame means adjacent to the blanket wheel which has been previously properly accurately aligned and mounted on the main frame means 61. In manufacture of the blanket wheel, the individual blanket support segments 40, which are removably attached to the blanket wheel, in a conventional manner, are mounted on the blanket wheel and then the peripheral blanket support surfaces of the blanket segments are highly accurately machined to achieve precision coaxial and circumferential alignment relative to the central axis of rotation of the blanket wheel.

Figure 17:
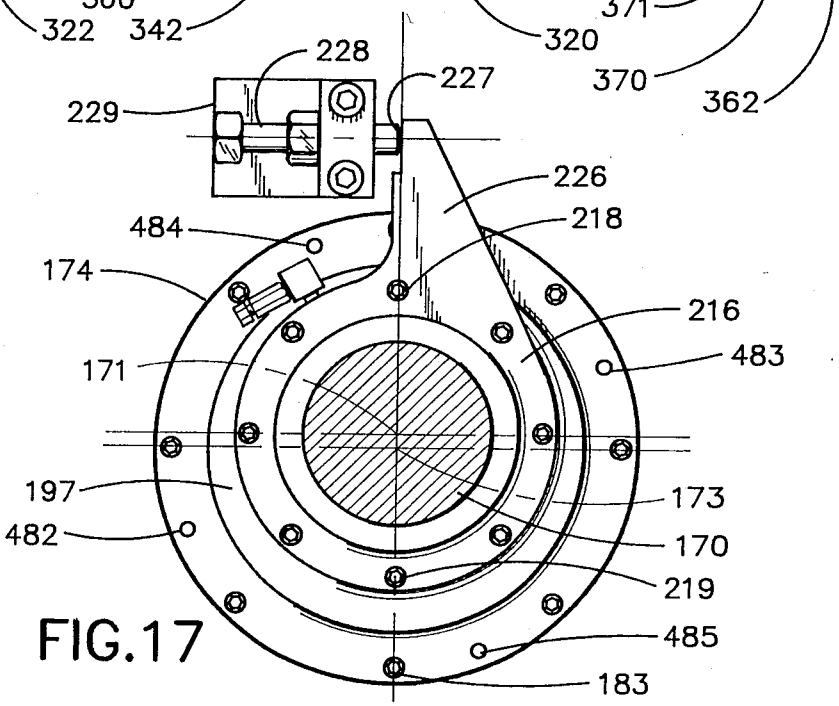
FIG. 17 is a cross-sectional view of the plate cylinder assembly of FIG. 12 showing an eccentric adjustment means.

Then, each plate cylinder shaft and support assembly is individually mounted in its associated support housing 172 on the frame plate member 62 without the drive gear assembly 268 or connection to the adjustment control slide block means 320, 342. Plate cylinder means 232 is properly accurately mounted on shaft 170 in juxtaposition to the blanket wheel. Flanged bearing sleeve members 174, 176 are mounted in proper, generally aligned position in main housing 172 with tapered spacer ring members 480, 481 and bolt members 182, 183, 184, 185 in place but with bolt members 184, 185 not tightened so as to enable lateral shifting unitary movement of bearing sleeve member 176, eccentric housing member 190, shaft 170, and associated bearing assemblies relative to the main housing. A jack screw adjustment fixture (not shown) is placed on the rear end portion 192 of housing member 190 and force is selectively applied thereto to laterally shift the eccentric housing 190 relative to main housing 172 until the central axis 171 of shaft 170 and plate cylinder 232 is in proper precision parallel aligned relationship with the blanket wheel. Then, precision dowel holes 482, 483, FIG. 17, are drilled through the flange portion of at least one of the sleeve members 174, 176, and the tapered spacer rings 480, 481 into main housing 172. The tapered spacer rings 480, 481 may be custom fitted for each installation in accordance with the amount of misalignment of the sleeve flanges relative to the side surfaces of the main housing. Precision dowel pins 484, 485 are then inserted into the dowel holes 482, 483 to fix the associated bearing sleeve member in the proper precision-aligned coaxial position. Then, the loosened bolt members are tightened to fixedly locate the plate cylinder assembly in the proper position. Then drive means 268 may be mounted on shaft 170 and the alignment adjustment control slide block means 320, 342 may be connected to flange portions 340, 358. The various precision adjustment apparatus may be thereafter employed to obtain precision alignment and positioning of each plate cylinder relative to the blanket wheel while substantially eliminating (i.e., reducing to at least approximately 0.001 to 0.003 inch maximum variation and preferably to less than 0.0005 inch) relative axial and circumferential alignment variation of the parts of the plate cylinder assembly. Thus, each plate cylinder assembly is separately precision installed at the factory during assembly prior to shipment and installation on a can manufacturing line and can thereafter be precision adjusted during use by the various precision adjustment apparatus. In addition, the construction and arrangement is such that each plate cylinder assembly is separately mounted on support plate means 62 and is not mechanically connected to its associated inker assembly whereby either the plate cylinder assembly or the inker assembly may be mounted and removed independently of the other.

Inker Assembly Units

The inker assembly units are constructed and arranged so as to employ a minimum number of common interchangeable parts. Each inker assembly unit is fixedly mounted on the vertical frame plate means 62 by bolt means fixed to the vertical plate means 62. In order to mount each inker unit, the unit may be lifted by a conventional overhead crane type device to a position adjacent and in alignment with one of the mounting slots 111–116 and the guide-support rod means. Then the unit may be moved laterally toward the mounting slot along the guide-support rod means 164, 166 to cause side plate 156 and the gear support section to move through the slot until peripheral side surface 146 of center plate 142 abuts the peripheral side surface of the support plate frame means 62 and the guide-support rod means may be removed. Then the inker unit may be bolted to vertical support plate frame means 62. Thus, each inker assembly unit may be lifted into mounted position or removed therefrom by a conventional overhead crane-type lifting means prior to fastening of the bolt means during mounting or subsequent to unfastening of the bolt means for removal and replacement of an inker assembly 70. As previously noted, each inker assembly is separate from the associated plate cylinder assembly. All of the roll gears are located on one side of the center plate 142 and the vertical support frame means 62; and all of the ink transfer roll means are located on the opposite side to enable application of lubricant to the gears by an automatic lubricant system without contamination of the ink by the lubricant or contamination of the lubricant by the ink. Each ink fountain 88 and each ink drip pan 88A as well as other components of each inker assembly are of the same construction and design so that the inker assemblies are interchangeable. The construction and arrangement of the inker assemblies on the vertical support plate 62 is such that each ink fountain is adjustably located in a substantially horizontal position and each ink drip pan is functional at each station even though the inker assemblies are of common interchangeable construction.

Inker Form Roll And Vibrator Roll Arrangement

Figure 18:
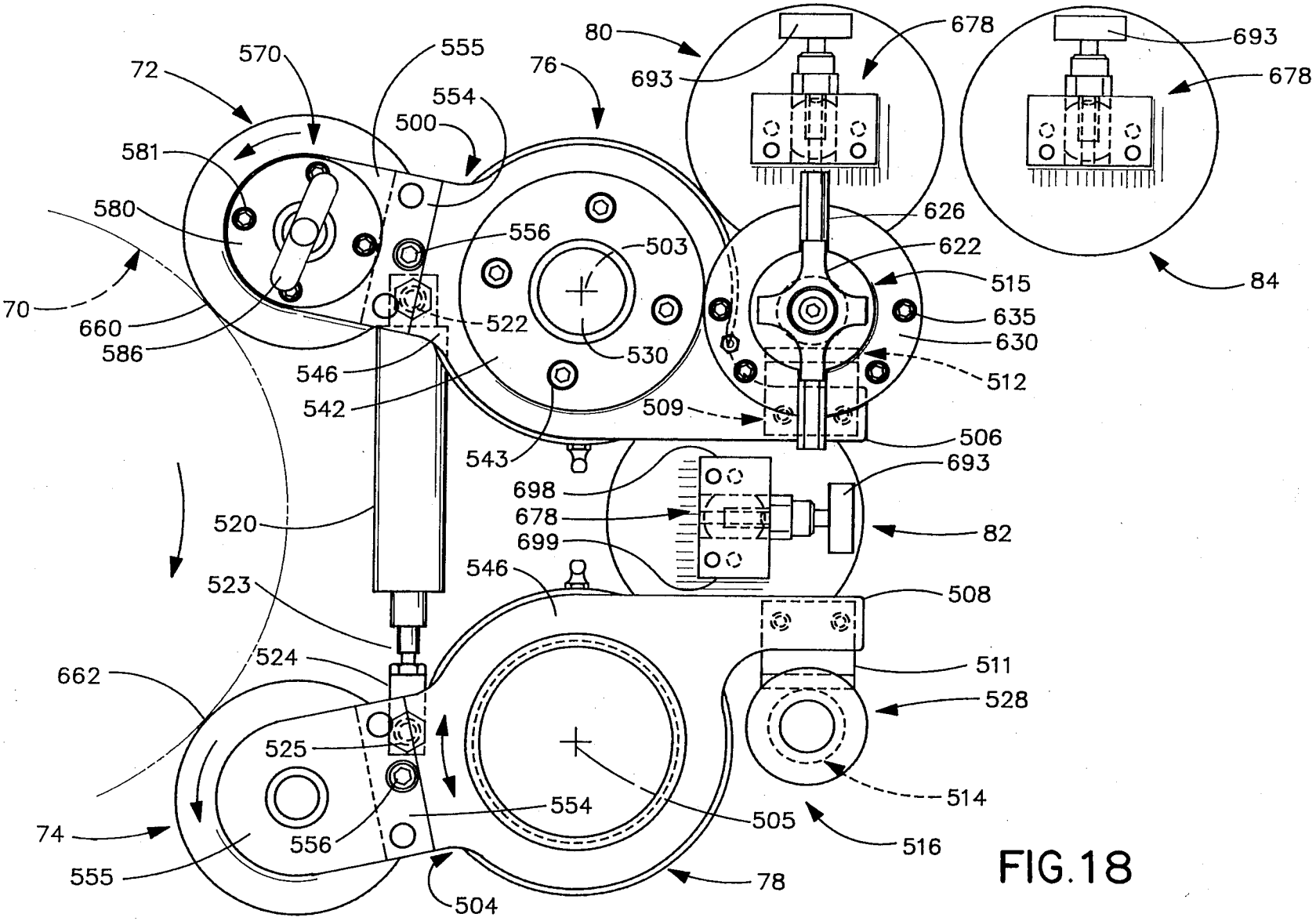
FIG. 18 is an end view, with parts removed, of form roll and vibrator roll and adjustment assemblies.
Figure 19:
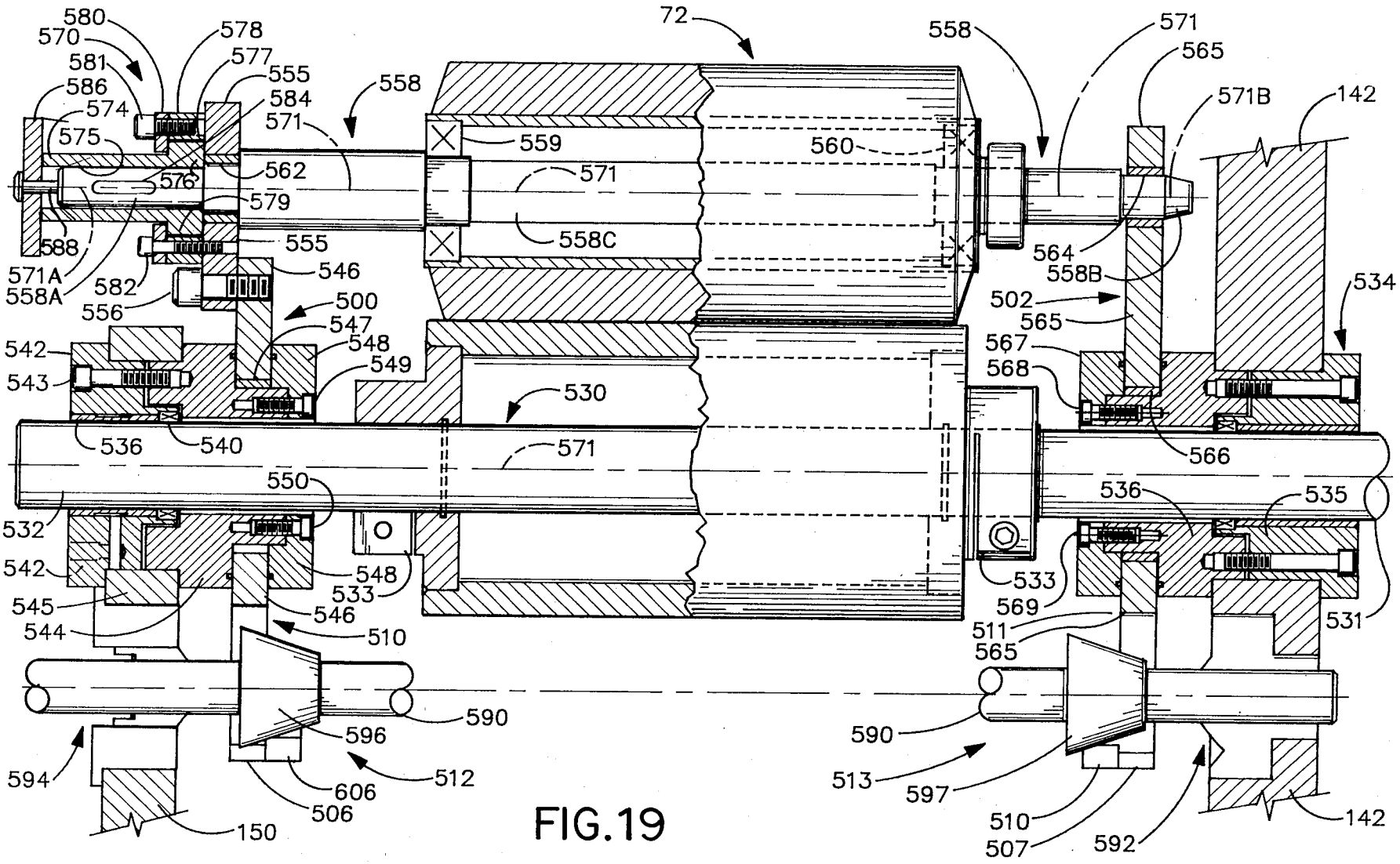
FIG. 19 is a cross-sectional side view of one form roll and one vibrator roll and one associated adjustment assembly of the apparatus shown in FIG. 18.
Figure 20:
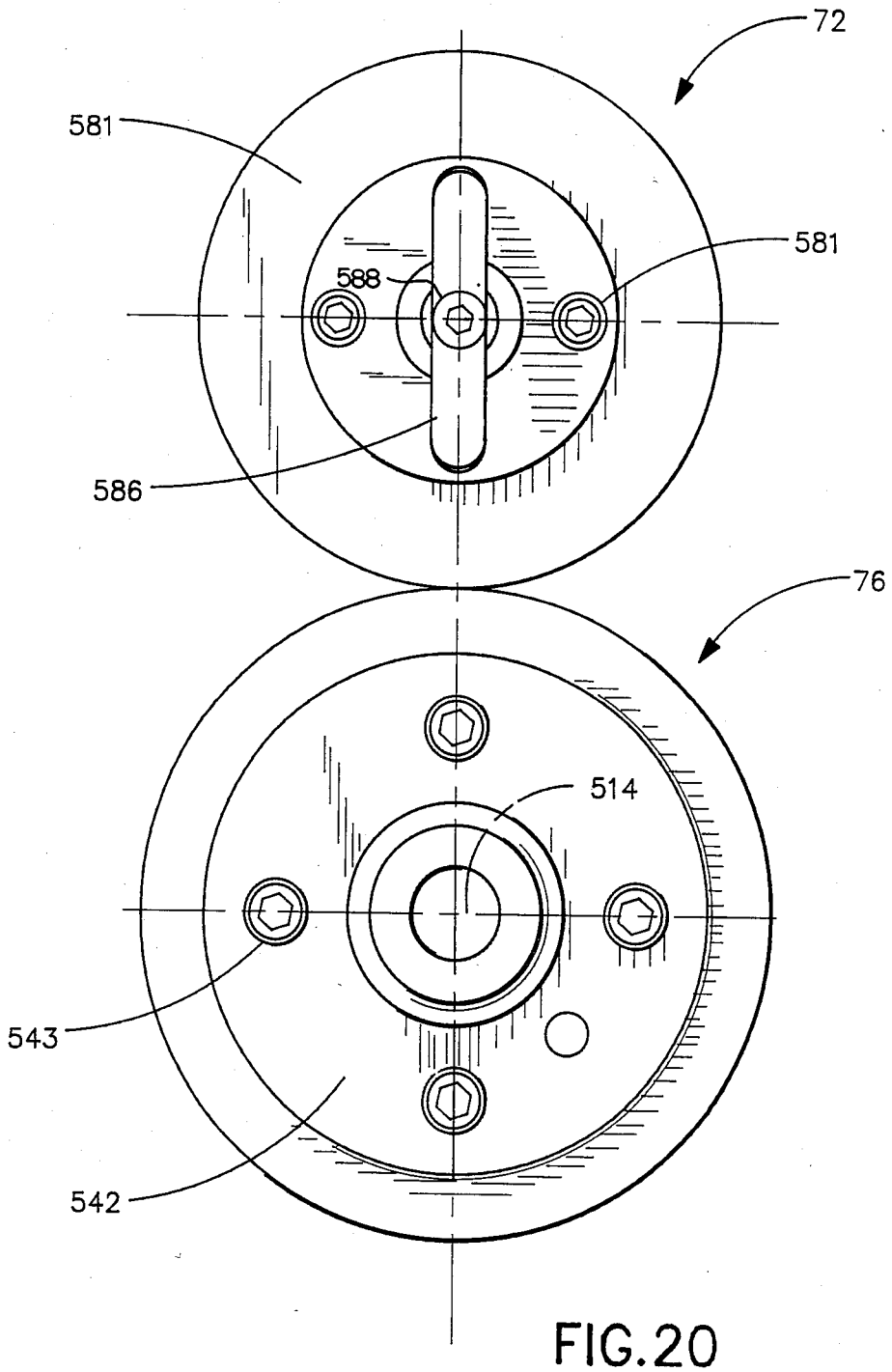
FIG. 20 is an end view of a portion of the apparatus shown in FIG. 19.
Figure 21:
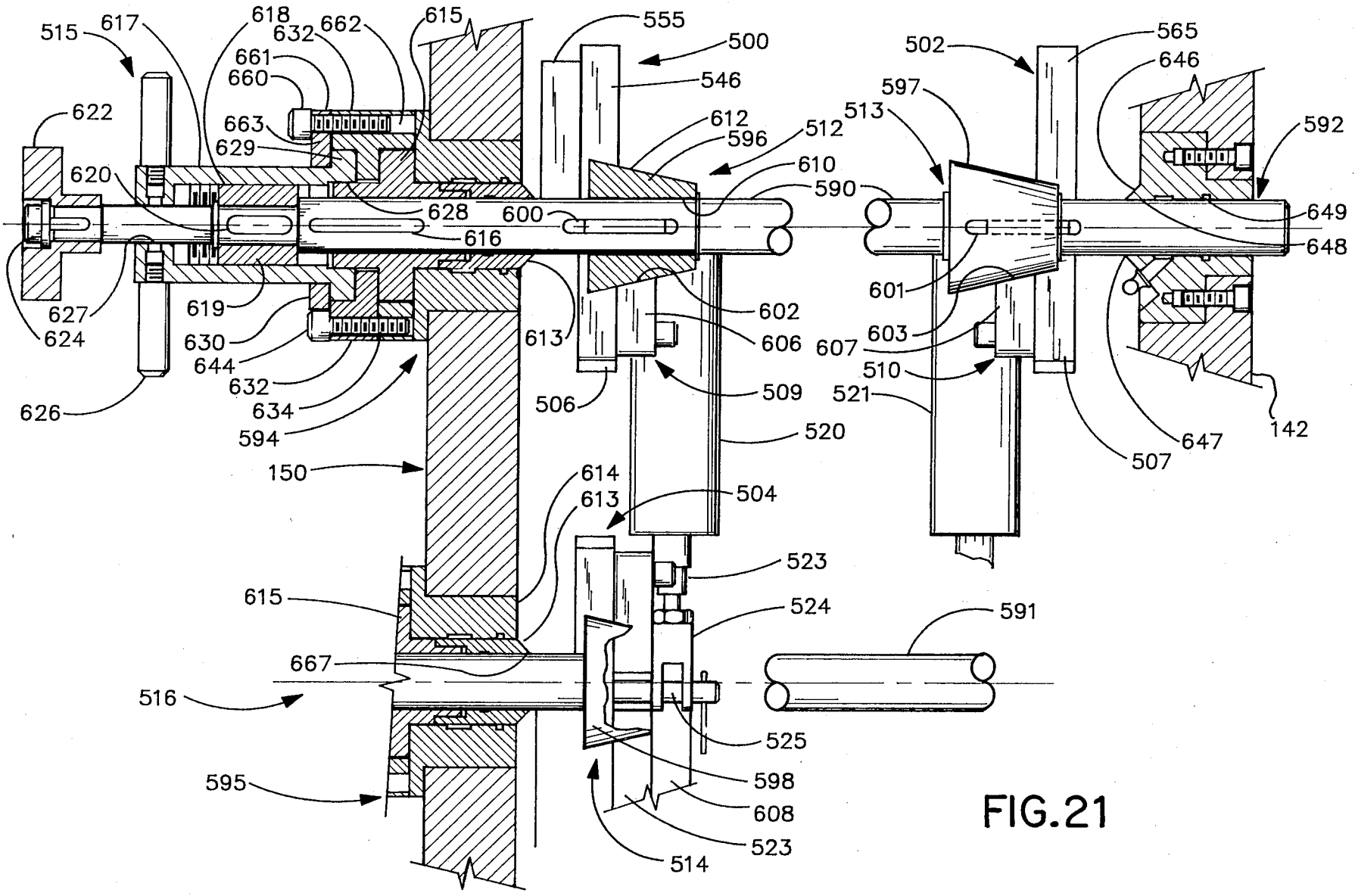
FIG. 21 is a cross-sectional view taken in the direction of line 21—21 in FIG. 22, with parts removed, showing the adjustment assembly of FIG. 19.

In general, as shown in FIGS. 18–21, form roll means 72 is rotatably supported on a pair of axially spaced bracket means 500, 502, FIG. 19, pivotally associated with opposite ends of vibrator roll means 76 to provide a pivotal axis 503, FIG. 18. Form roll means 74 is similarly rotatably supported on a pair of axially spaced bracket means, only one of which 504 is shown in the drawings, to provide a pivotal axis 505. Each of the bracket means is of similar construction and arrangement but the bracket means associated with vibrator roll 76 are reversely positioned relative to the bracket means associated with vibrator roll 78. Each bracket means has a radially outwardly extending flange portion 506, 507, 508 which carries an abutment plate means 509, 510, 511 for adjustable engagement with adjustable stop means 512, 513, 514 controlled by adjustment control means 515, which is fully shown, and 516, which is only partially shown, in FIG. 21. Force applying means in the form of a pair of air cylinder units 520, 521, FIGS. 18 and 21, are connected between bracket means which support form rolls 72, 74 for holding each form roll in engagement with the plate cylinder roll 70. Each form roll also engages the associated vibrator roll as shown in FIG. 20. As shown in FIG. 21, each air cylinder unit is connected to an upper bracket member 500 by a pivotal connecting means 522 with piston rod means 523 and an adjustable clevis means 524 pivotally connected to bracket means 504 by pivot means 525.

The construction and arrangement of form roll 72 and vibrator roll 76, and the associated bracket means 510, 511 are shown in FIG. 19. Vibrator roll 76 is mounted on a rotatable and axially displaceable shaft means 530 comprising a drive shaft portion 531 connected to suitable drive mechanism (not shown) and a second shaft end portion 532. Vibrator roll 76 is fixed to shaft 530 by releasable flexible clamp-type coupling devices 533. A main bearing hub assembly 534 comprising a bearing hub 535 and a bearing hub 536 is fixedly mounted in support frame plate member 142 by threaded bolt devices. Vibrator roll 76 may be removed from shaft 530 by releasing coupling devices 533 and axially removing shaft member 530. Shaft end portion 532 is axially slidably and rotatably supported by a bearing sleeve member 538 and has a seal ring 540 mounted in a hub member 542 attached by bolt members 543 to a bracket hub member 544 and spaced therefrom by a spacer ring member 545. A bracket plate member 546 is pivotally mounted on hub member 544 by a bearing ring member 547, an end plate member 548 and threaded fastening bolts 549, 550. Pivot plate member 546 is rigidly connected to an arm portion 554 of a plate member 555 by threaded fastening means 556. Form roll 72 is rotatably mounted on a roll form shaft member 558 by bearing means 559, 560. Shaft member 558 is adjustably rotatably supported by a bear:rng sleeve 562 in plate member 555 and a bearing sleeve member 564 in a pivotal support plate 565 mounted on hub member 536 by a bearing ring member 566, an end plate member 567, and suitable threaded fastening means 568, 569.

A form roll shaft axis adjustment means 570, FIG. 19, is mounted on plate 555 and connected to shaft 558 for adjusting the location of shaft axis 571 relative to shaft axis 572 to vary the contact pressure between form roll 72 and vibrator roll 76. Shaft end portions 558A and 558B are eccentric to shaft center portion 558C so that coaxial end portion center lines 571A and 571B are eccentric to roll center line 571. Adjustment means 570 comprises a flanged sleeve member 574 having an elongated central bore 575 and a flanged end portion 576 with an annular peripheral surface 577 mounted in a ring member 578 having an concentric surface 579 and held on plate member 555 by an end plate 580 and threaded fastening devices 581, 582. Sleeve member 574 is connected to shaft 558 by a key means 584 and to an adjustment knob 586 by a threaded bolt means 588. Shaft 558 is relatively loosely (i.e., plus 0.010 inch) supported by bearing sleeves 562, 564 and the eccentric variation between shaft and portions 558A, 558B and center shaft portion 558C is approximately 0.010 inch. In order to adjust roll-vibrator pressure bolts 581, 582 are loosened and sleeve member 575 and shaft 558 are rotated by handle 586 whereby engagement of flange surface 577 with eccentric ring surface 579 causes lateral shifting of the shaft 558 and roll 72 relative to vibrator 76.

As shown in FIGS. 21–24, each of the adjustment control means 515, 516 are of identical construction and arrangement and comprise an adjustment shaft member 590, 591 rotatably and axially slidably mounted in support bearing assemblies, one of which is shown at 592 and the other of which is not shown, in support plate 142 and bearing assemblies 594, 595 in support plate 150. A pair of frustro-conical cam devices as shown at 596, 597 and 598 are fixedly mounted on each shaft 590, 591 by key means 600, 601 to engage correspondingly inclined cam surfaces 602, 603, 604, on stop block members 606, 607, 608. The central bores 610 of each cam device are eccentric to the conical peripheral surfaces 612 so is to be eccentrically mounted on the shaft 590, 591 but the eccentricity of associated eccentric cam devices 596, 597 and 598, 599 is opposite to one another (i.e., offset 180°) in order to obtain parallelism during adjustment.

Figure 23:
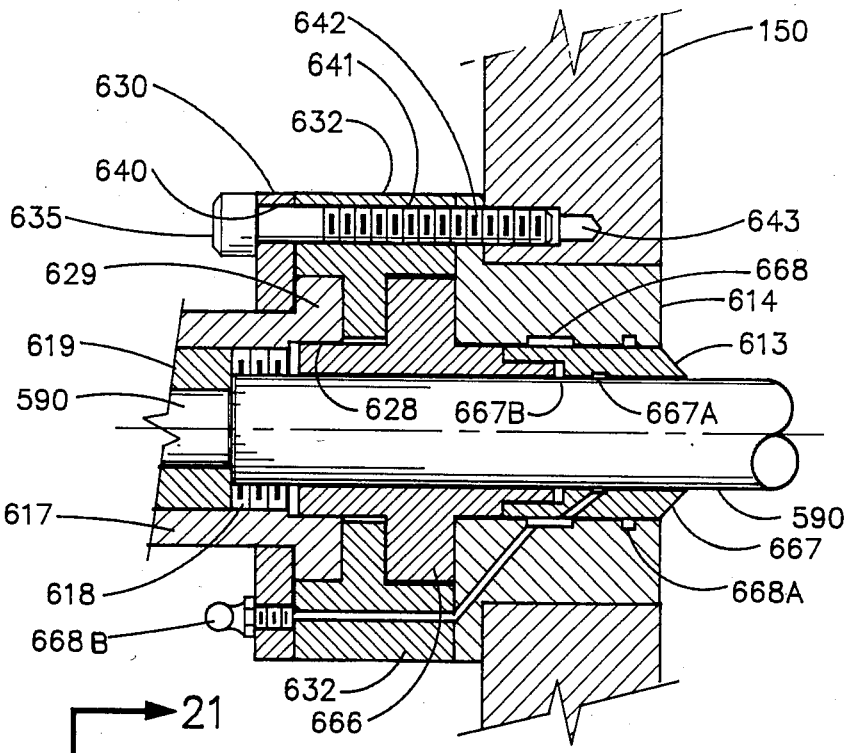
FIG. 23 is a cross-sectional view of a portion of the adjustment assembly taken along line 23—23 in FIG. 22.

Each support bearing assembly 594, 595, FIGS. 21 and 23, comprises a flanged bearing hub member 614 rotatably supporting a flanged sealing sleeve member 613 and coupling sleeve member 615 connected to shaft 590 by a key means 616 enabling relative axial displacement. An elongated rotatable end cap member 617 has a threaded central bore 618 for threadably receiving a threaded nut member 619 fixedly connected to shaft 590 by key means 620. An adjustment knob means 622 is fixedly connected to shaft 590 by a bolt means 624. An adjustment handle means 626 is connected to end cap member 617 which is rotatably supported on shaft member 590 by bore 627 and on sleeve member 615 by bore portion 628.

Figure 22:
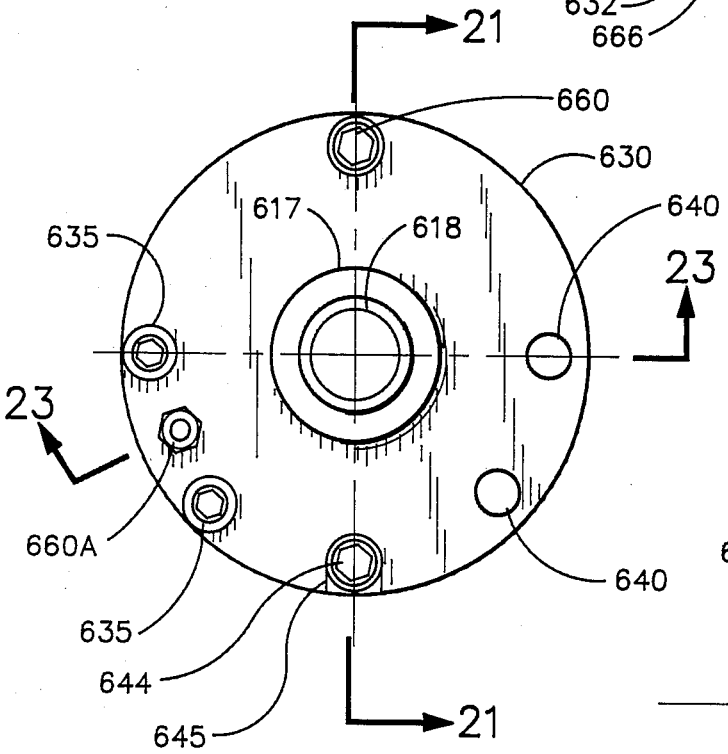
FIG. 22 is a cross-sectional view of a portion of the adjustment assembly of FIG. 21 showing the end plate.
Figure 24:
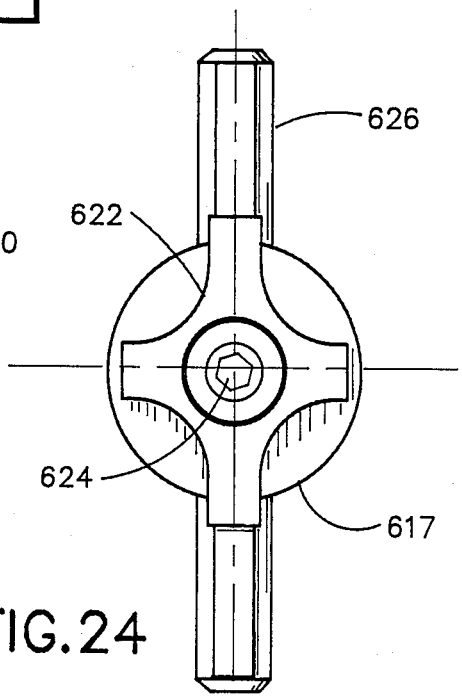
FIG. 24 is an end view of the adjustment knob and adjustment handle of FIG. 21.
Figure 24A:
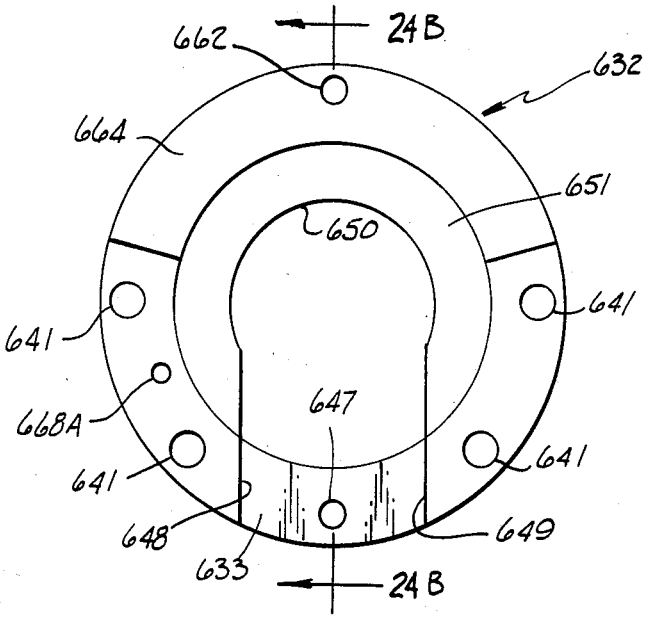
FIG. 24A is an end view of the locking ring member of FIG. 23.
Figure 24B:
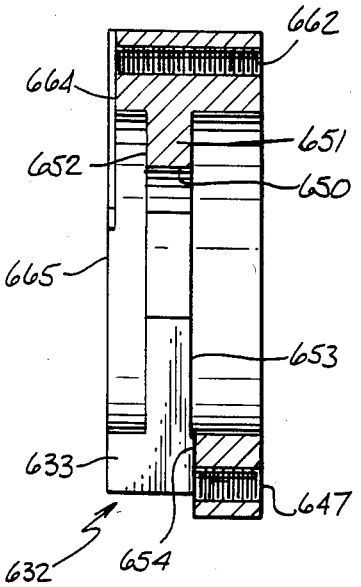
FIG. 24B is a cross-sectional view of the locking ring member of FIG. 24A.
Figure 24C:
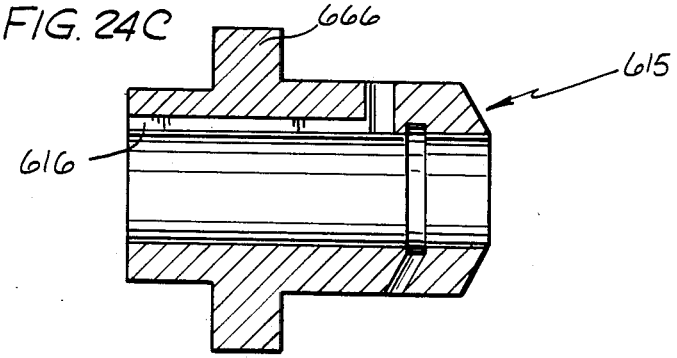
FIG. 24C is a cross-sectional view of a nut member.
Figure 24D:
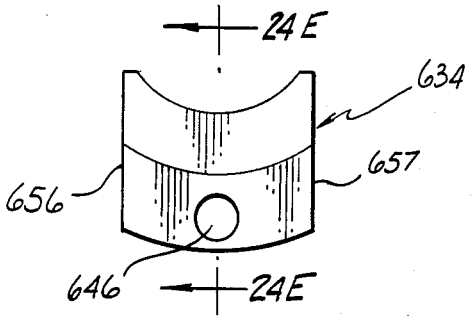
FIG. 24D is an enlarged end view of the segment clamp member of FIG. 21.
Figure 24E:
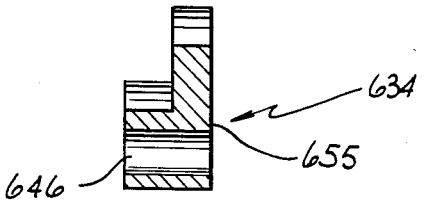
FIG. 24E is a cross-sectional view of the segment clamp member of FIG. 24D.

As best shown in FIGS. 22–24, cap member 617 has an annular flange portion 629 located between an end plate 630, a locking ring member 632 and an arcuate locking clamp segment 634, FIG. 21, mounted in radial slot 633, FIGS. 24A and 24B, in ring 632. A plurality of mounting bolt means 635, FIGS. 22 and 23, extend through end plate bores 640, ring bores 641, FIGS. 23 and 24A, hub bores 642, and threaded bores 643 in plate means 150. A locking segment bolt 644, FIGS. 21 and 22, is located in a clearance slot 645 in end plate 630 and extends through a bore 646, FIGS. 24D and E, in clamping segment 634 into a threaded bore 647, FIGS. 24A and B, in locking ring 632 so that the clamping segment 634 may be selectively locked to the locking ring 632. Slot 633 has parallel side surfaces 648, 649 which intersect central bore 650 in central flange portion 651 having axially spaced side surfaces 652, 653. Slot 633 also has an arcuate abutment surface 654 for selective clamping engagement with side surface 655, FIG. 24E, of clamping segment 634. Side surfaces 656, 657 of clamping segment 634 are slidably mounted adjacent slot side surfaces 648, 649 to enable axial movement of the segment member into and out of abutting engagement with ring surface 654, FIG. 24B. A locking bolt 660, FIGS. 21 and 22, is mounted in an end plate bore 661 and extends into a threaded bore 662 in ring member 632 to enable an arcuate flexible portion 663 of end plate 630 to be deflected into abutting engagement with corresponding arcuate surface 664, FIGS. 24A and B, on ring member 632 which is axially offset from end surface 665. The construction and arrangement is such that there is sufficient clearance among the parts to enable movement therebetween when bolt means 644 and 660 are loosened. When bolt 644 is loosened, clamping segment 634 is movable relative to flange 629 of sleeve 617 and to flange portion 651 of ring member 632 and to flange portion 666 of sleeve member 615. When bolt 660 is loosened, flange portion 629 of adjustment sleeve member 617 is movable relative to end plate 630.

Sleeve member 613 has a tapered conical end surface to provide a sharp edge ink seal tip portion 667, FIG. 23, and annular lubricant slot 667A, 667B. Sleeve member 613 and 615 may be made as one piece. Hub member 614 has an annular lubricant slot 668 and an annular ring 668A connected to a lubricant fitting 668B. Bearing hub means 592, 593 have also conical end surfaces providing a sharp edge ink sealing tip portion, a lubricant slot, and an O-ring seal.

In operation of the plate cylinder rolls 72, 74 and associated vibrator rolls 76, 78, as illustrated in FIG. 18, each of the form rolls 72, 74 is held in peripheral parallel pressure contact with the plate cylinder means 70 at 660 by force applied by air cylinder means 520, 521 through pivotal bracket means 500, 502, 504 about pivotal axes 503, 505 as limited by engagement of conical cam means 596, 597, 598, 599 and cam block means 606, 607, 608, 609. During assembly and operation, axial alignment, parallelism and pressure may be selectively adjusted by adjustment means 515, 516 and 570.

As shown in FIG. 19, pressure between rolls 72, 74 and the associated vibrator rolls 76, 78 may be adjusted by pressure adjustment means 570 by loosening bolt means 581, 582 and turning knob means 586 which causes eccentric offset shaft axes 571, 571A and 571B to laterally shift the location of roll shaft axis 571 relative to vibrator roll shaft axis 572 as permitted by the tolerances of shaft bearing means 562, 564.

As shown in FIG. 21, the location of roll shaft axes 571 and rolls relative to the plate cylinder means 70 is controlled by the location of conical cam devices 596, 597, relative to cam plate devices 606, 607 which controls the amount of pivotal displacement and location of pivotal bracket means 500, 502. When bolt means 644, 660 are selectively loosened, shaft 590 or 591 are individually separately rotatable and movable axially. When both bolts 644 and 660 are loosened or when segment locking bolt 644 is loosened and locking ring bolt 660 is tightened, the knob 622 can be turned to turn the associated shaft 590 or 591 in nut 619 and change the circumferential location of the eccentrically offset conical cam devices to adjust parallelism of the form roll. When segment locking bolt 644 is tightened to maintain the proper parallelism and locking ring bolt 660 is loosened, the handle 626 and sleeve member 617 can be turned to axial displace nut 619 and associated shaft 590, 591 and the conical cam devices to increase the contact pressure between the associate roll 72 or 74 and the plate cylinder 70.

Intermediate Roll Assembly

Figure 25:
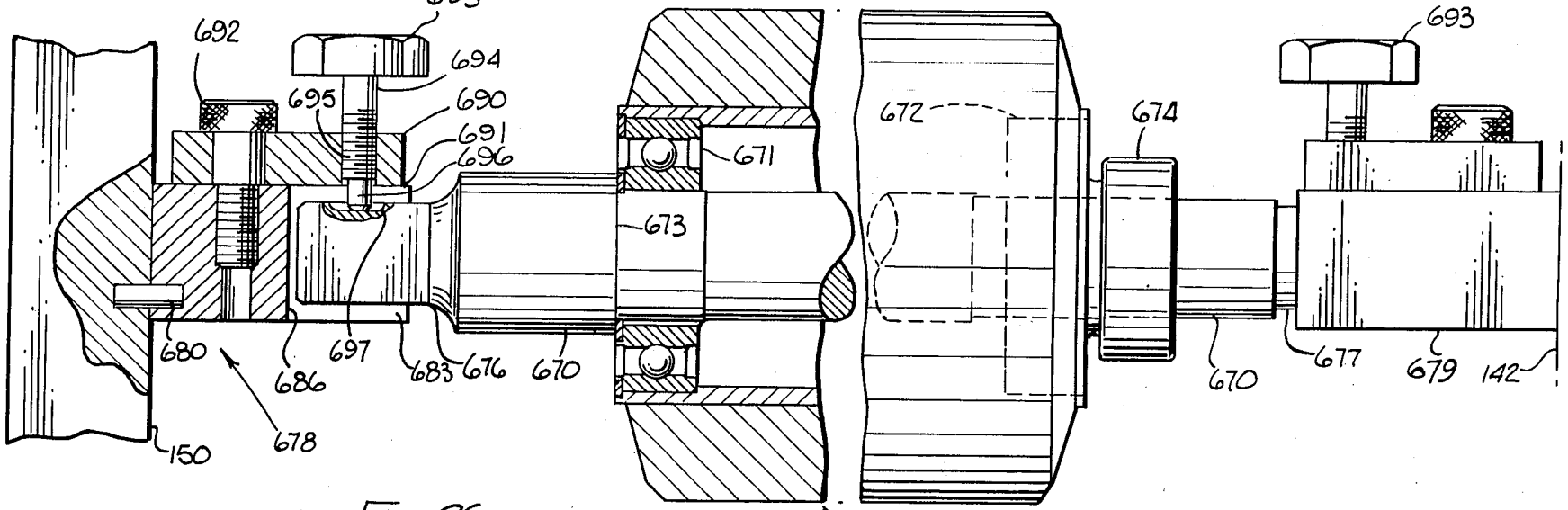
FIG. 25 is a partial cross-sectional view of an intermediate roll assembly of the apparatus of FIG. 18.
Figure 26:
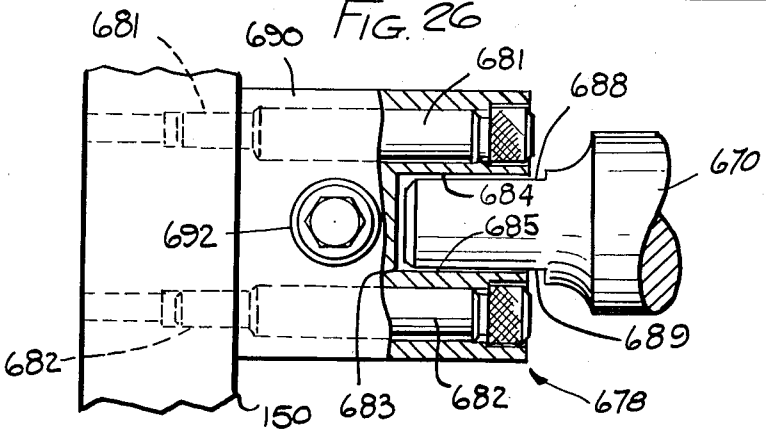
FIG. 26 is a top view of shaft support and adjustment apparatus of FIG. 25.

As shown in FIGS. 18, 25 and 26, each of the intermediate idler roll means 80, 82, 84 are rotatably mounted on a shaft member 670 by bearing means 671, 672 and axially positioned by a shaft shoulder 673 and a clamp ring 674. Reduced shaft end portions 676, 677 are non-rotatably accurately supported in support block member 678, 679 fixed to side plate members 142, 150 by a locating dowel 680 and suitable bolt devices 681, 682. Each support block member comprises an accurately machined rectangular slot 683 having opposed parallel flat surfaces 684, 685 and a flat end surface 686 to receive and support accurately machined opposed parallel flat surfaces 688, 689 on shaft end portions 676, 677. A plate member 690 is mounted on block surface 691 by bolt means 692. A lock bolt means 693 has a threaded portion 694 mounted in a threaded bore 695 in plate 690 and an end portion 696 located in a slot 697 in each shaft end portion 676, 677. As shown in FIG. 18, side surfaces 698, 699 of the shaft support blocks 678, 679 for roll 82 may be inclined to provide stop means for pivot bracket means 500, 504 in the non-contact position. In assembly and operation, the support block members for roll means 80 are mounted in a horizontal position so that the shaft slots 683 extend vertically and the roll means is supported by peripheral surface contact with vibrator roll means 76. The position of the shaft end portions may be vertically adjusted by upward and downward movement of bolt means 693. The support block members for roll means 82 are mounted in a vertical position so that the shaft slots 683 extend horizontally and the roll means is supported by peripheral surface contact with both vibrator roll means 76, 78. The position of the shaft end portions may be horizontally adjusted by horizontal movement of bolt means 693. The end surfaces 695 of slots 683 provide accurate axial locating means for the shafts.

Oscillating Ductor Roll Assembly

Figure 28:
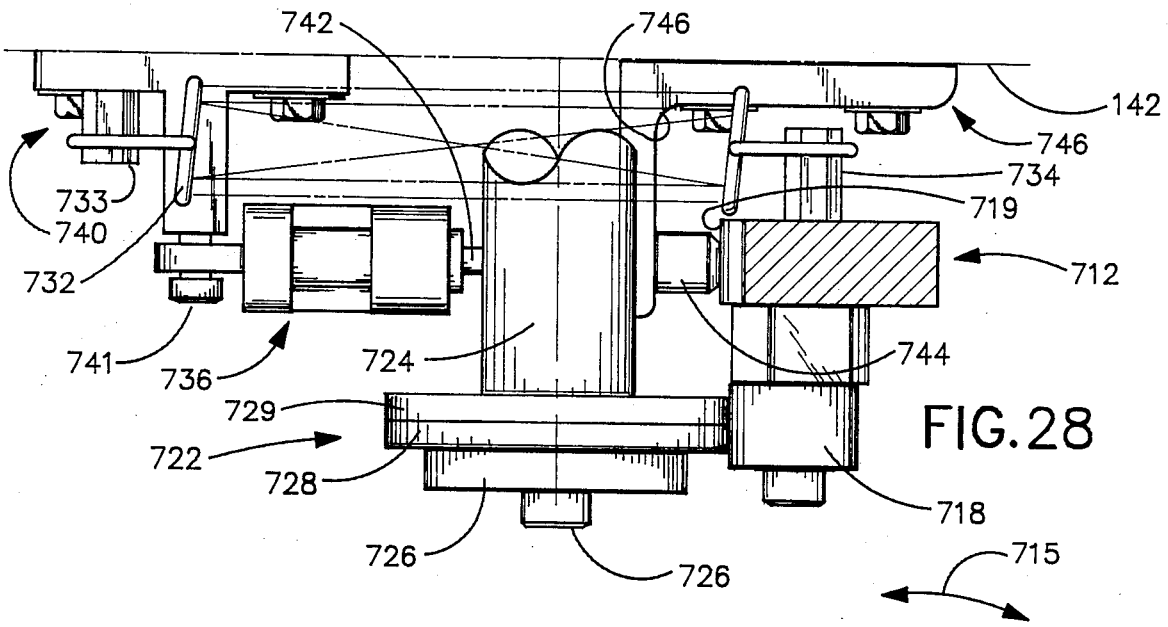
FIG. 28 is a cross-sectional view of the oscillator ductor roll system of FIG. 27.
Figure 27:
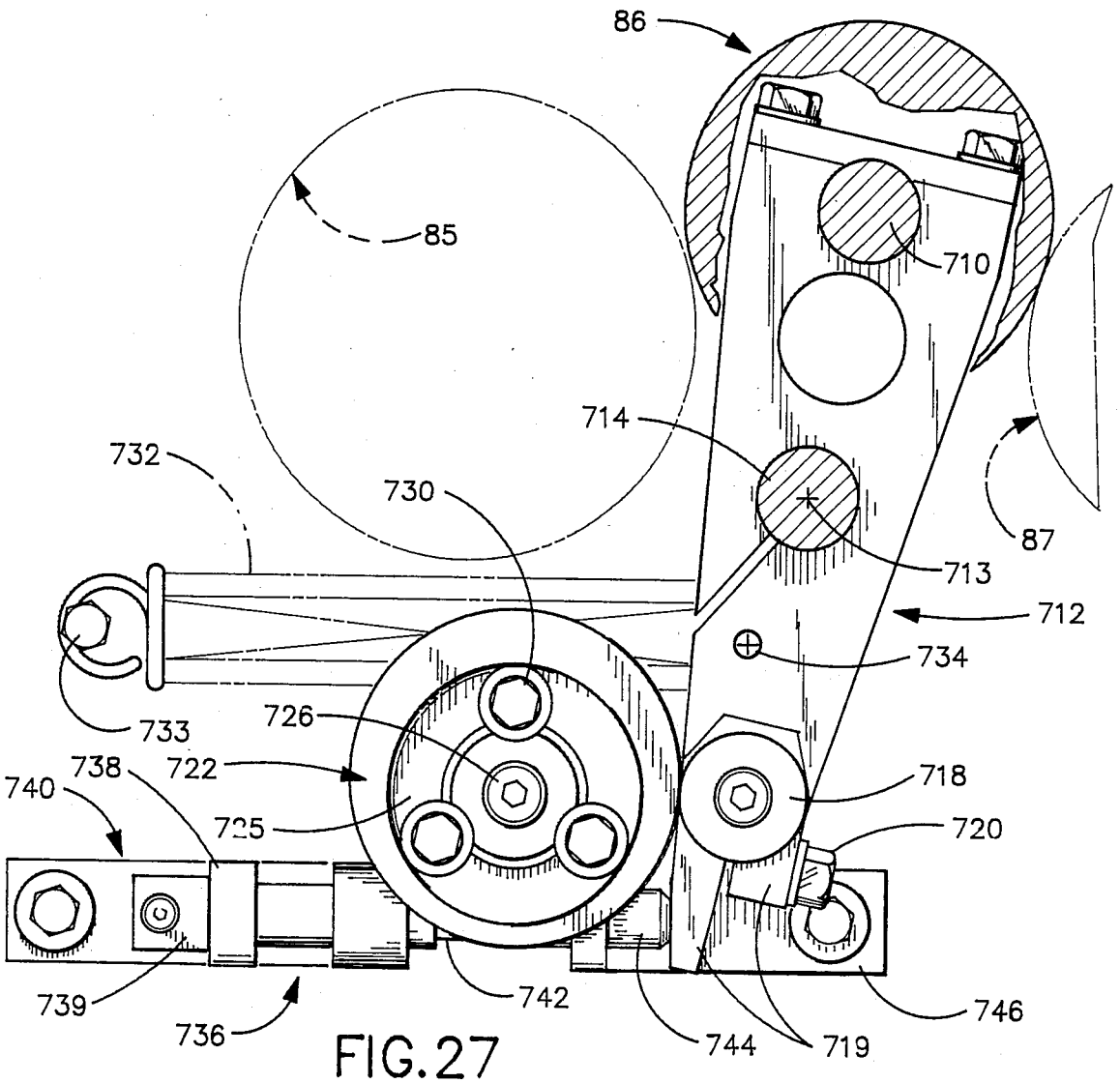
FIG. 27 is an end view of an oscillator ductor roll system.

As shown in FIGS. 27 and 28, the oscillating ductor roll assembly 86 comprises a fixed support shaft member 710 supported at each end by pivotal arm means 712 mounted on a pivot shaft member 713 for oscillatory movement about pivot axis 714 as indicated by arrow 715 between a position of engagement with fountain roll 87 and distributor roll 85. A roller member 718 is mounted on bifurcated lower end portion 719 of arm means 712 by a bolt means 720 for engagement with a rotatable annular cam plate means 722 eccentrically mounted on a rotatable drive shaft member 724 by an end plate 725 and bolt means 726. Conventional cam plate means 722 comprises a pair of plate members 728, 729 secured to end plate by bolt means 730 to enable adjustment. A spring means 732 has one end attached to a bolt device 733 and the other end attached to pivot arm means 712 at 734 to exert a force causing the roller means 718 to engage eccentric cam plate means 722. A cam lift-off means 736 for disengaging roller 718 from cam plate 722 comprises an air cylinder means 738 with one end 739 pivotally attached to bracket means 740 by bolt means 741 and piston rod means 742 connected to a pin 744 in a support bracket means 746.

Fountain Roll and Fountain Assembly

Figure 30:
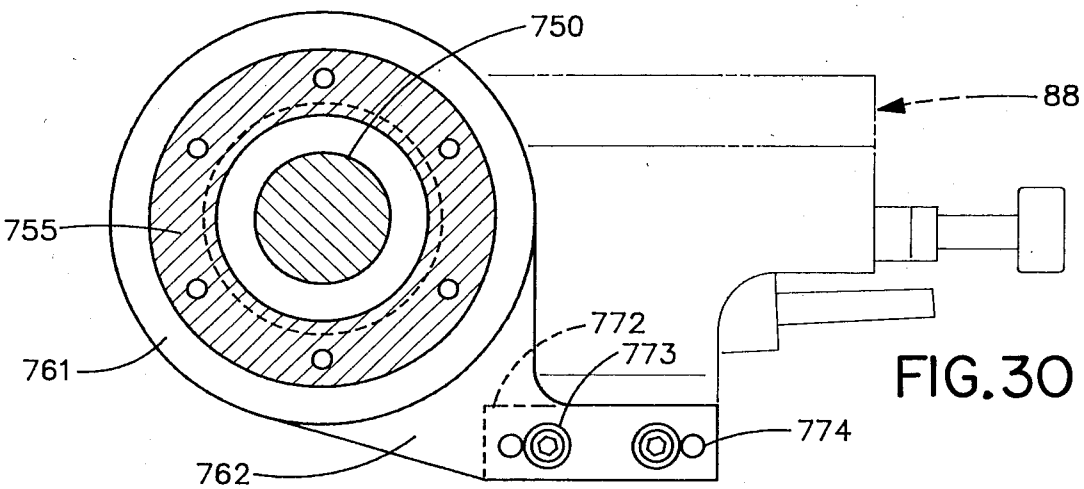
FIG. 30 is an end view of the support bracket portion of the apparatus shown in FIG. 29.
Figure 32:
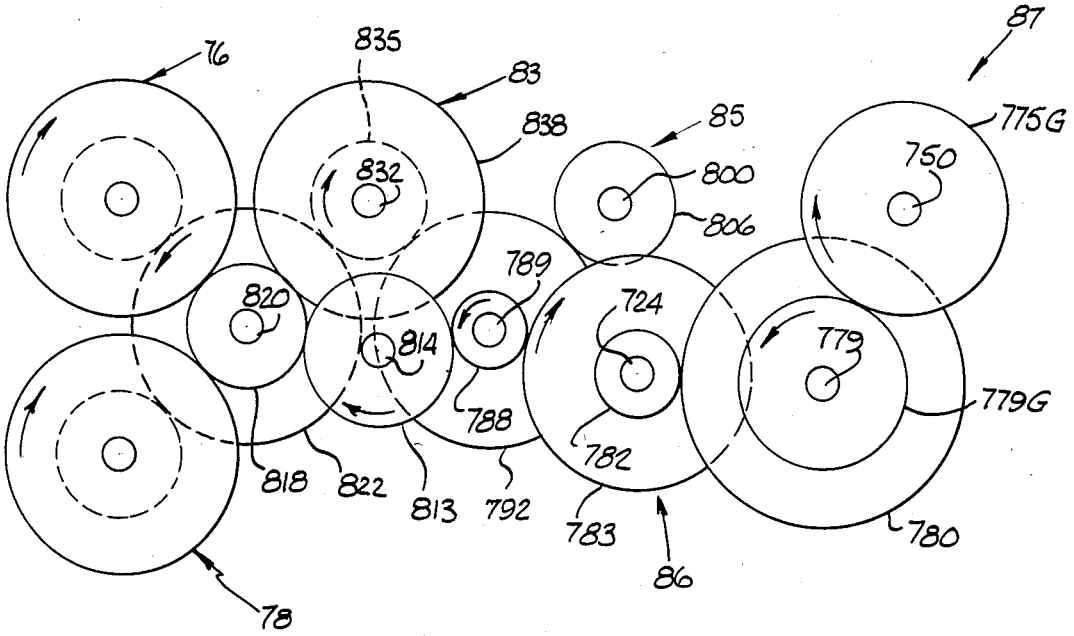
FIG. 32 is a schematic side elevational view of the gear system for the ink applying and transfer roll system of FIG. 31.

As shown in FIGS. 29 and 30, the fountain roller 87 and fountain assembly 88 are mounted between center plate 142 and side plate 156 by a shaft member 750, a support bearing means 751, 752 and support bracket means 753, 754. Bearing means 751 comprises a hub member 755, an end plate 756, a bearing means 757. Bearing means 752 comprises a hub member 758 and a bearing means 759. Adjustably rotatable bracket means 753 comprises a spacer ring 760, an annular bracket member 761 having a support flange portion 762 and an end plate 763 fastened by unit bolt means 764, 765. Adjustably rotatable bracket means 754 comprises a hub member 768 secured by bolt means 769 and a rotatable and axially displaceable annular bracket member 770 having a support flange portion 771. Inker fountain means 88 has a bottom plate member 772 fastened to flange portions 762, 771 by suitable bolt means 773 and dowel means 774. Shaft 750 is driven by a gear means 775 and has a threaded adjustment knob-sleeve means 776 on portion 777 held by bolt means 778 to enable manual turning of the shafts to coat the roll 87 with ink during start-up.

Ink Roll System

The general arrangement of the ink transfer roll system is illustrated in FIG. 31. A supply of ink is contained in the ink fountain means 88 for metered transfer to fountain roll 87 which rotates at a relatively slow speed. Oscillating ductor roll 86 is a rubber roll friction driven at variable rotational speeds by fountain roll 87 when in contact therewith and by gear driven steel distributor roll 85, when in contact therewith, which rotates at a relatively fast speed. Ink is transferred from fountain roll 87 to oscillating ductor roll 86 and then from ductor roll 86 to steel distributor roll 85 to rubber distributor roll 84 and to the first vibrator roll 8 which is axially reciprocably and rotatably driven by the drive gear means. Ink is transferred from vibrator roll 83 to intermediate distributor roll 80 and onto vibrator roll 76 which transfers ink to both form roll 72 for transfer to plate cylinder means 70 and also to intermediate distributor roll 82 which transfers ink to vibrator roll 78 for transfer to plate cylinder means 70 through form roll 74. Thus, the ink is supplied to the plate cylinder means through two ink transfer paths wherein a vibrator roll means 76, 78 is effective to smooth the ink on each form roll means 72, 74. There are three vibrator roll means 76, 78, 83 and two form roll means 72, 74, 80, 82 and 84 and three intermediate distributor rolls associated therewith.

Ink Roll Drive System

Figure 33:
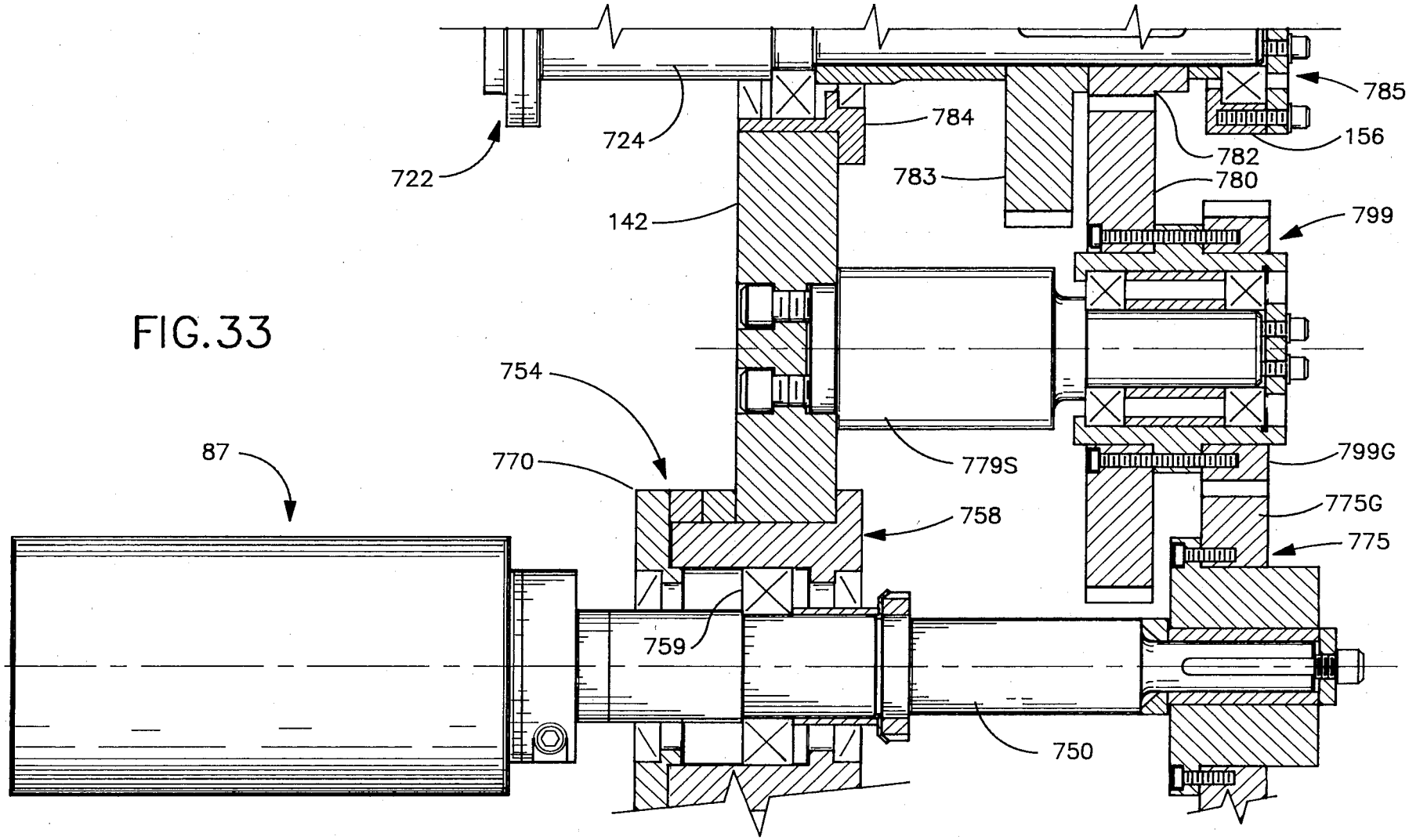
FIGS. 33, 34, 35, 33A, 34A and 35A are plan view layouts of the gear system for the fountain roll and the vibrator rolls and the intermediate idler rolls.
Figure 33A:
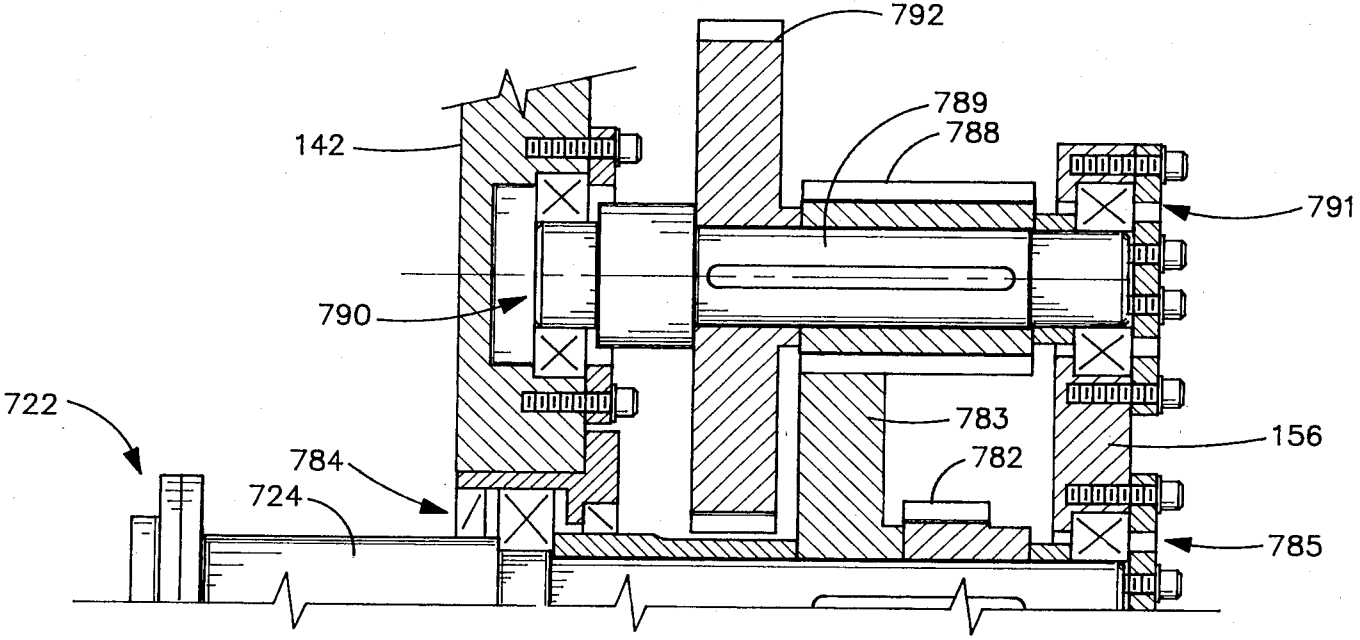

FIGS. 32–35 illustrate the construction and arrangement of the ink roll gear drive system. Fountain roller 87 is mounted on a drive shaft 750, FIG. 33, supported in a bearing assembly 758 in frame center wall 142 and driven by a gear assembly 775 having a gear 775G connected to a gear 779G of a gear assembly 779 mounted on an idler shaft 779S fixed to side wall 142. A gear 780 of gear assembly 779 is connected to a pinion gear 782 on oscillating ductor roll cam shaft 724 which is driven by a gear 783 and mounted in bearing assemblies 784, 785 in ink frame side wall members 142, 156. Gear 783 is driven by a pinion 788, FIG. 33A, on a stub shaft member 789 supported by bearing assemblies 790, 791 in side wall members 142, 156 and driven by a gear member 792.

Figure 34:
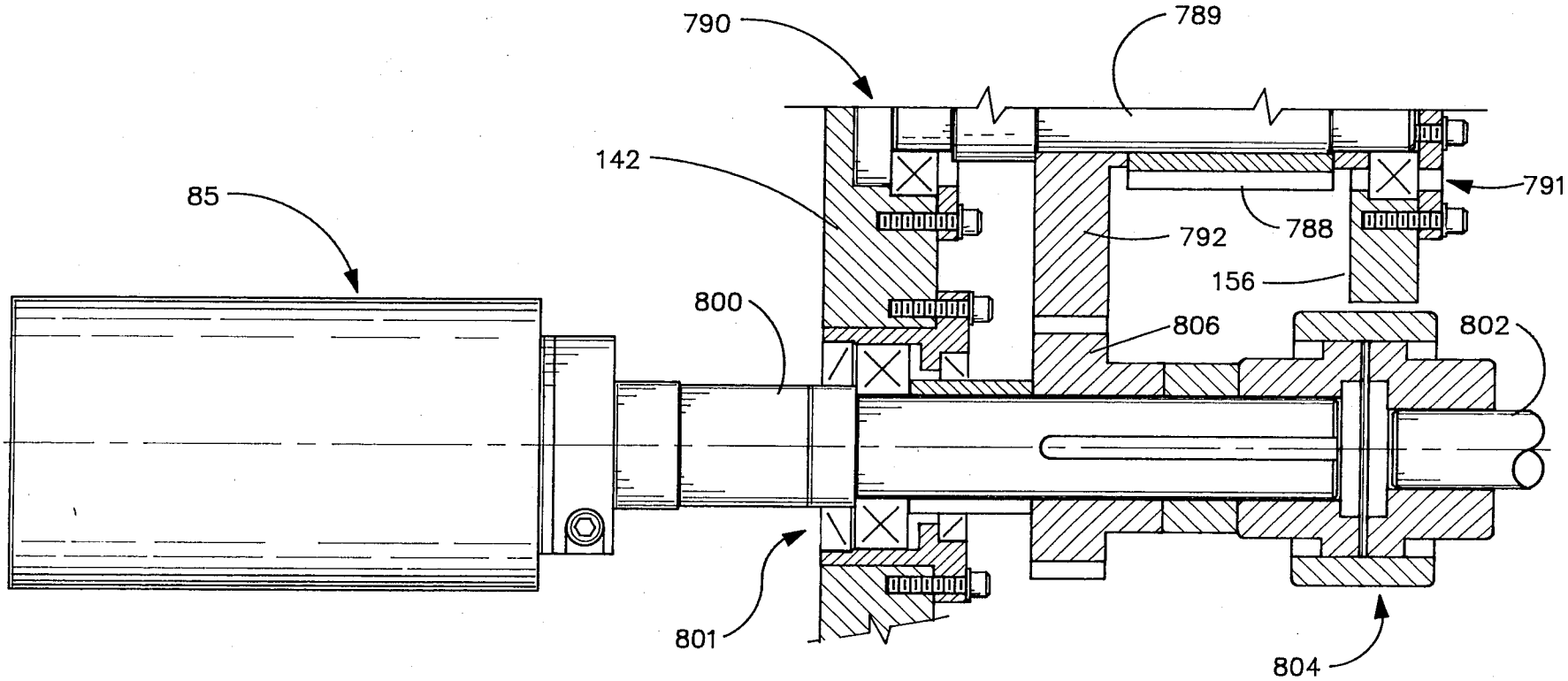
Figure 34A:
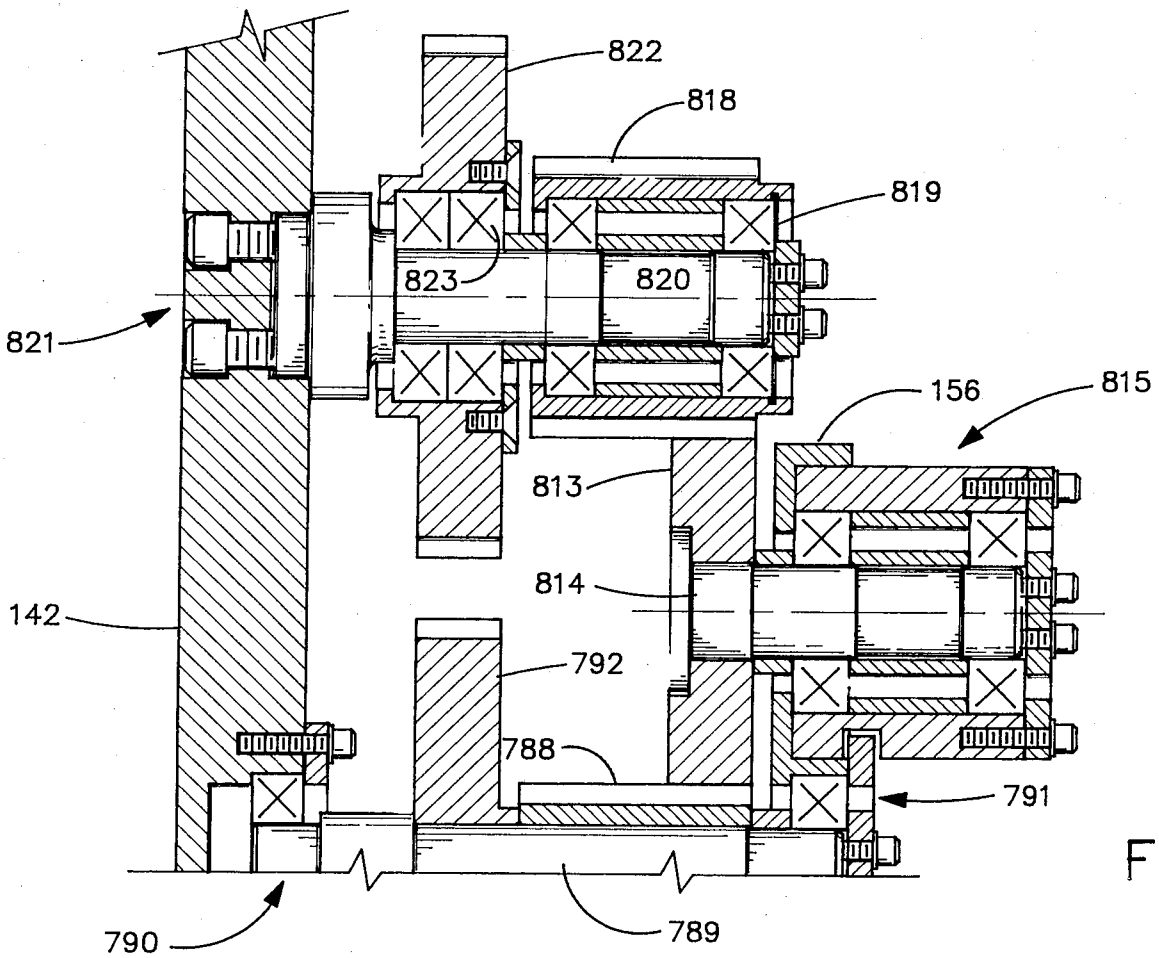

Distributor roll means 85, FIG. 34, is mounted on a drive shaft member 800 rotatably mounted in a bearing assembly 801 in side wall 142 and connected to a belt sprocket driven power input shaft 802 by a splined coupling means 804 enabling disconnection of shaft 800 from shaft 802 by axial displacement to remove distributor roller assembly 85. A pinion drive gear 806 is drivably mounted on shaft 800 and connected to gear 792 mounted on shaft 789 and a bearing assembly 810 mounted on a ring clamp 811 and pinion gear 788 mounted on shaft 789 is connected to an idler gear 813, FIG. 34A, mounted on a stub shaft 814 rotatably supported by a bearing assembly 815 on side wall 156. Gear 813 is drivably connected to an idler pinion 818 rotatably mounted by bearing means 819 on a stub shaft 820 fixedly supported on wall 142 by support means 821 and rotatably supporting an idler gear 822 on bearing means 823 for power transfer to the vibrator rolls.

Figure 35:
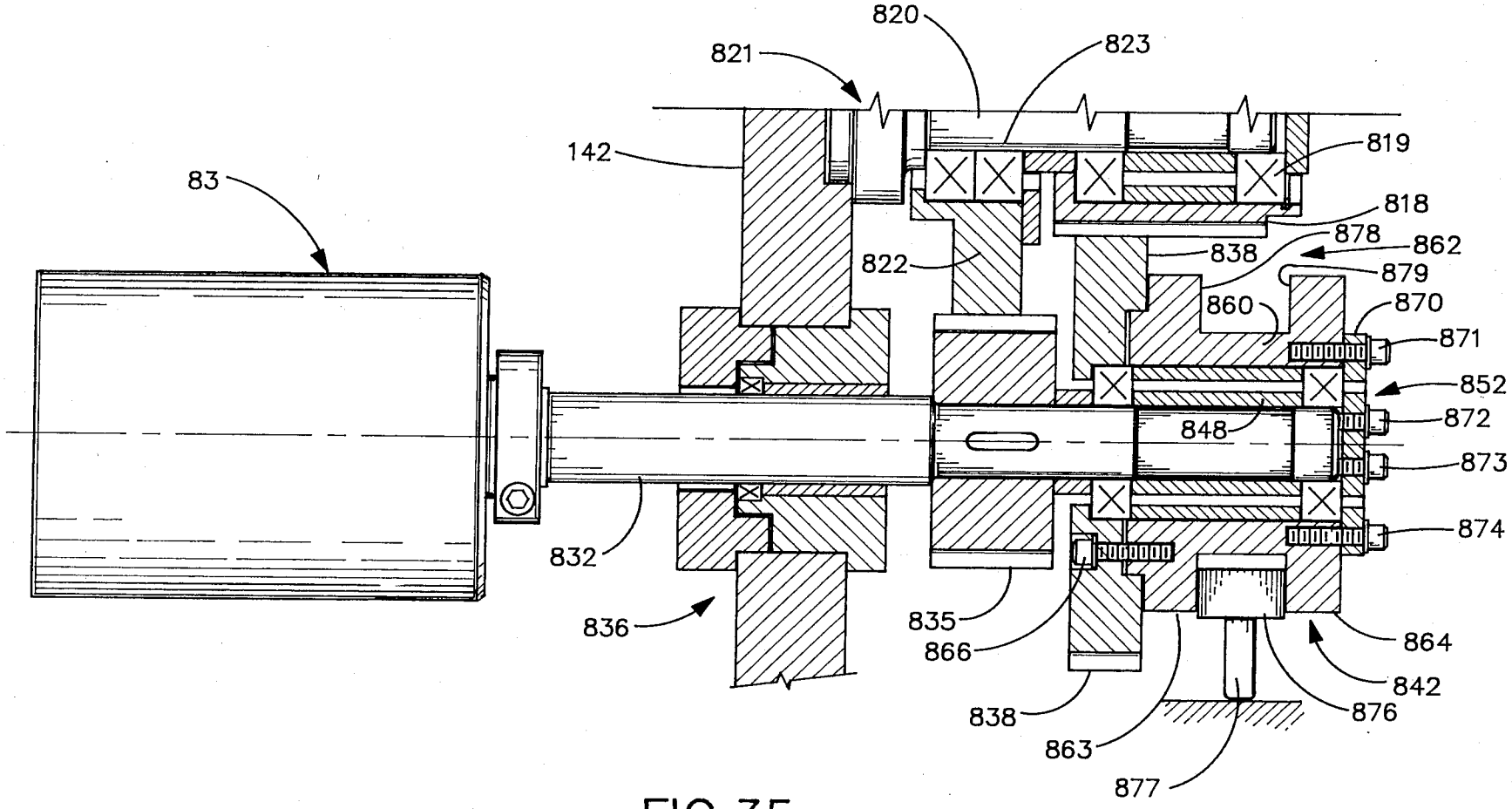
Figure 35A:
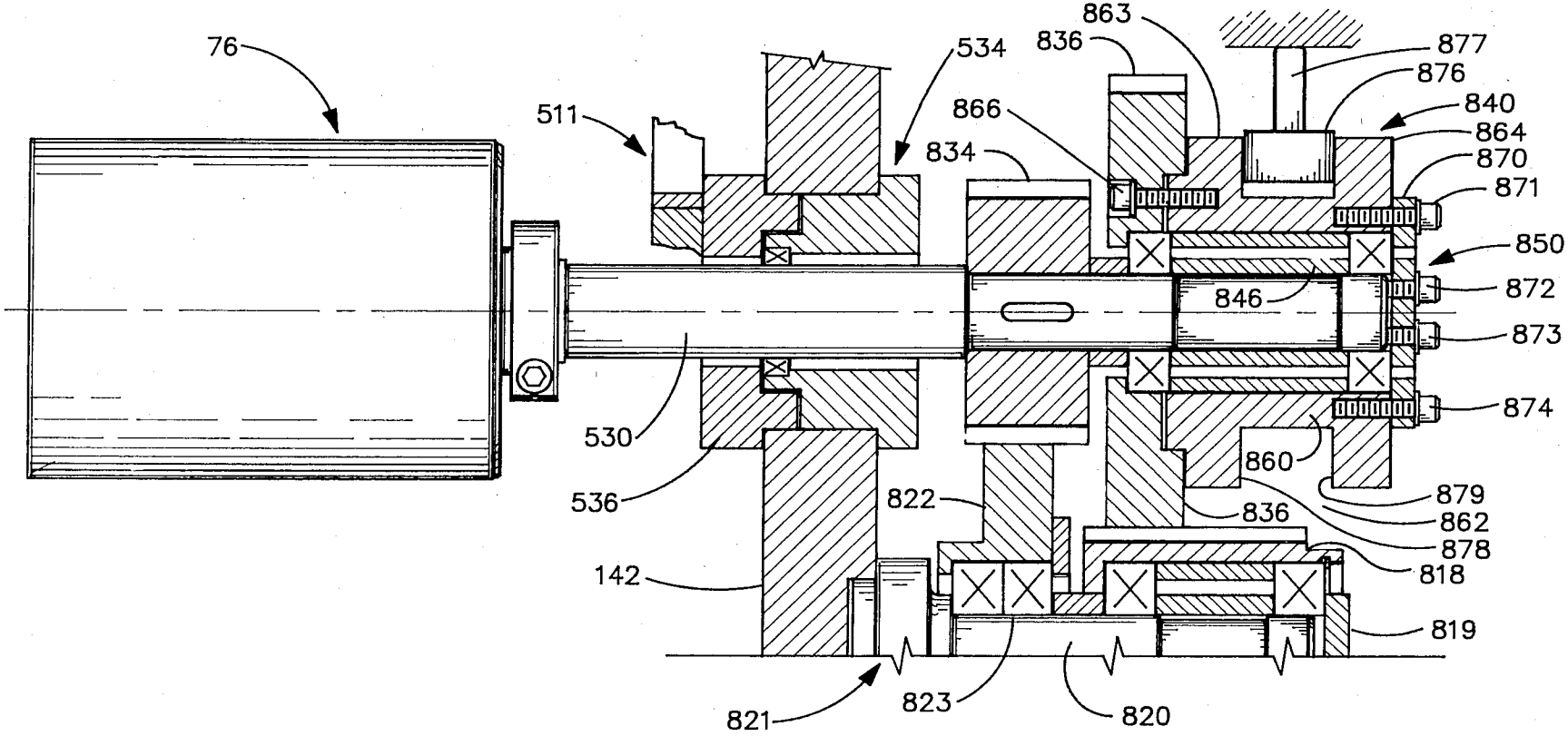

The drive system for the vibrator rolls 76, 78 associated with form rolls 72, 74 is illustrated in FIG. 35A and the drive system for vibrator roll 83 is illustrated in FIG. 35. Vibrator roll shaft members 530, 832 are rotatably and axially movably supported by bearing assemblies 534, 836 mounted in side plate 142. Each shaft member 530, 832 is rotatably driven by pinion gear 834, 835 driven by a gear 822 rotatably mounted on an intermediate stub shaft 820. Pinion gear 818 rotatably mounted on shaft 820 is connected to gears 836, 838 of cam pulley assemblies 840, 842 rotatably supported on shaft members 530, 832 by bearing assemblies 846, 848 and drivably connected to shafts 530, 832. Each of the cam pulley assemblies 840, 842 comprises a flanged hub member 860 with a continuous axially inclined cam slot 862 located between axially spaced flange portions 863, 864. Each hub member 860 is fixedly attached to gear 836 or 838 by bolt means 866 and is fixedly connected to shaft members 530 or 832 by an end plate 870 and bolt means 871, 872, 873, 874. A cam roller means 876 mounted on a fixed shaft member 877 is located in each cam slot 862 in abutting engagement with slot side surfaces 878, 879 so as to effect reciprocable back and forth movement of shafts 530, 832 and vibrator rolls 76, 78, 83 during rotation of the hub member 860 relative to cam rollers 876. It is to be understood that the drive system for each vibrator roll 76, 78 and associated form roll 72, 74 are similarly constructed and arranged. As shown in FIGS. 2, 3 and 5 the inker gear drive system is synchronously driven by a toothed timing belt and pulley drive system comprising actuated belts 60, 92, 93 and pulleys 94, 95, 96, 97, 98, 99 which are synchronized with the plate cylinder assembly drive system. The inker gear drive system includes anti-shock shaft or coupling means 890 between gear box means 59 and 59A, and idler tension control take-up pulley means 891, 892, 893.

The aforedescribed apparatus and methods may be variously employed individually or in combination to provide various advantages and improved results in the can decorating art. It is intended that the following claims be construed to cover the various inventive concepts except insofar as limited by the prior art.

What is claimed is:

1. A decorator apparatus for applying a decorative ink image to the cylindrical outer surface of a one piece aluminum or steel can body or the like comprising:

a rotatable mandrel wheel means for supporting can body members on circumferentially spaced mandrel members;

infeed means for loading undecorated can body members onto the mandrel members;

a rotatable inking blanket wheel means having a plurality of circumferentially spaced blanket segment means thereon for applying ink images to the can body members;

a plurality of circumferentially spaced plate cylinder means for transferring ink images to said blanket segment means;

a plurality of circumferentially spaced ink fountain means for holding a supply of ink for each of said plate cylinder means;

an ink transfer system associated with each ink fountain means including a plurality of ink transfer roll means associated with each ink fountain means for transferring ink from each fountain means to an associated plate cylinder means and then to the blanket segment means;

a transfer wheel means for receiving decorated can body members from the mandrel wheel means;

a can carrying means for receiving decorated can body members from the transfer wheel means and transferring the decorated can body members away from the decorator apparatus;

a main base frame means for supporting the decorator apparatus and a vertically extending rigid frame plate means for supporting said plate cylinder means and said ink fountain means and said ink transfer system in juxtaposition to said blanket wheel means;

a plurality of circumferentially spaced plate cylinder mounting openings extending through said frame plate means in radially outwardly spaced relationship to said blanket wheel means;

a plurality of circumferentially spaced ink transfer system mounting openings extending through said frame plate means in generally radiallly outwardly spaced relationship to said plate cylinder openings;

a motor means and a main drive means operatively associated with the various wheel means for causing synchronous rotation thereof and including a bull gear means for driving said blanket wheel means;

each of said plate cylinder means being constructed as a separate sub-assembly and being separately and removably mounted in one of said plate cylinder mounting openings on said frame plate means and each plate cylinder means having a separate drive gear means for being directly driven by said bull gear means;

each ink transfer system being constructed as a separate sub-assembly and having separate roll drive gear means for operating said ink transfer roll means separately from said plate cylinder means and said plate cylinder drive gear means and being separately and removably mounted in one of said ink transfer system mounting openings; and ink transfer system drive means separate from said plate cylinder drive gear means for operating said roll drive gear means separately from said plate cylinder means and said plate cylinder drive gear means.

2. The invention as defined in claim 1 and wherein:

each of said plate cylinder means is separately custom fitted and aligned on said frame plate means during assembly at the factory; and all of said plate cylinder means are driven directly by said main bull gear means and are mechanically separate from and independent of the associated ink transfer system.

3. The invention as defined in claim 2 and wherein:

each plate cylinder means has an independent alignment and adjustment system which enables highly accurate alignment and adjustment both during assembly and during operation of the machine.

4. The invention as defined in claim 1 and wherein:

all of said ink transfer systems are of identical design and construction so as to be interchangeable at the various inking stations on the decorator.

5. The invention as defined in claim 4 and wherein:

all of said ink transfer roll means of each ink transfer system are separately driven by a roll drive system means separate from said plate cylinder means to substantially prevent vibration of the ink transfer roll system from being transmitted to said plate cylinder means.

6. The invention as defined in claim 5 and wherein:

each ink transfer system has an independent separate alignment and adjustment system which enables highly accurate alignment and adjustment during operation of the decorator.

7. The invention as defined in claim 5 and wherein said roll drive system means comprises a timing belt and pulley means.

8. The invention as defined in claim 7 and wherein said timing belt and pulley means comprises:

a first timing belt and pulley means for operation by the main drive shaft means;

a second timing belt and pulley means operated by said first timing belt and pulley means and for operating a first group of said ink transfer systems; and a third timing belt and pulley means operated by said first timing belt and pulley means for operating a second group of said ink transfer systems.

9. The invention as defined in claim 4 and further comprising:

ink supply fountain mounting means for enabling each ink fountain means to be individually adjusted to a substantial horizontal position comprising selectively adjustable pivotal support bracket means mounted on fountain roll shaft hub means in said side plate means.

10. The invention as defined in claims 1, 2 or 6 and wherein:

said ink transfer system for transferring ink from said fountain ink supply means to said plate cylinder means comprising:

a pair of form roll means for transferring ink to said plate cylinder means at two peripherally spaced locations;

a pair of form roll engaging vibrator roll means including a first form roll engaging vibrator roll means for engaging and transferring ink to a first one of said pair of form roll means and a second form roll engaging vibrator roll means for engaging and transferring ink to a second one of said pair of form roll means;

a first intermediate distributing roll means engaging said first form roll engaging vibrator roll means for transferring ink thereto;

a second intermediate distributing roll means for engaging said first form roll engaging vibrator means and receiving ink therefrom and for engaging said second form roll engaging vibrator means and transferring ink thereto from said first form roll engaging vibrator roll means; and a third intermediate vibrator roll means for engaging said first intermediate distributing roll means and transferring ink thereto.

11. The invention as defined in claim 10 and further comprising:

a third intermediate distributor roll means for engaging said third intermediate vibrator roll means and transferring ink thereto;

a fountain supply means for holding a supply of ink;

a fountain roll means for receiving ink from said fountain supply means; and an oscillatory ductor roll means pivotally movable between a position of engagement with said fountain roll means for receiving ink therefrom and a position of engagement with said distributor roll means for transferring ink thereto.

12. The invention as defined in claim 10 and further comprising:

pressure adjusting means associated with each of said form roll means for adjusting the contact pressure between each form roll means and said plate cylinder means.

13. The invention as defined in claim 12 and wherein said pressure adjusting means comprising:

eccentric axially spaced shaft bearing means mounted eccentrically to a form roll shaft means whereby selective rotation of said form roll shaft means causes said form roll means to move toward and away from said associated vibrator roll means while maintaining parallelism therebetween; and selectively operable manual adjustment means connected to the form roll shaft means to selectively cause rotation thereof.

14. The invention as defined in claim 10 and further comprising:

a pair of pivotal bracket means mounted on opposite end portions of each form roll engaging vibrator roll means;

a form roll shaft means for each form roll means having opposite end portions rotatably supported by one end portion of said pivotal bracket means and supporting each form roll means in ink transfer contact with said plate cylinder means and with the associated vibrator roll means; and selectively adjustable stop means associated with one other end portion of each of said pivotal bracket means for selectively adjusting and maintaining parallelism of said form roll means relative to said plate cylinder means and for selectively adjusting and maintaining ink contact transfer pressure between said form roll means and said plate cylinder means.

15. The invention as defined in claim 14 and wherein said selectively adjustable stop means comprising:

a pair of abutment plate members mounted on the other end portions of each of said bracket members and having inclined abutment surfaces;

an adjustment shaft member mounted adjacent and in parallel relationship to said vibrator roll means and having a first portion located adjacent one of said bracket means and a second portion located adjacent said other one of said bracket means;

a pair of conical cam devices eccentrically mounted on said adjustment shaft portions in abutting engagement with said inclined abutment surfaces at 180° offset locations;

selectively operable parallelism control means for selectively causing rotation of said shaft means and said cam devices relative to said abutment plate members to selectively vary the contact positions and effect and maintain parallelism of said roll form means relative to said plate cylinder means by unequal pivotal displacement of said pivotal bracket means; and selectively operable pressure control means for selectively causing axial displacement of said shaft means and said cam devices relative to said abutment plate means to selectively adjust the contact pressure between said form roll means and said plate cylinder means by equal pivotal displacement of said bracket means while maintaining parallelism.

16. The invention as defined in claim 15 and wherein said adjustment control means comprises:

threaded nut means fixedly mounted on said shaft member;

threaded sleeve means rotatably engageable with said threaded nut means and being rotatable relative to said shaft means and said nut means for causing axial displacement of said shaft means;

a first handle means connected to said threaded sleeve means for causing selective rotation of said sleeve means to cause axial displacement of said shaft means and said cam devices to adjust and maintain contact pressure;

a second handle means connected to said shaft means for causing selective rotation of said shaft means to change the eccentric relationship of said cam devices relative to said stop plate means to adjust and maintain parallelism; and locking means associated with said threaded sleeve means for selectively separately locking and unlocking said handle means.

17. The invention as defined in claim 16 and wherein said locking means comprising:

a sleeve member having a radially outwardly extending flange portion and being fixed to said shaft member for rotation therewith;

a ring member mounted on said sleeve member and having a radially inwardly extending flange portion adjacent said radially outwardly extending flange portion and being selectively rotatable relative thereto;

an arcuate offset side surface on said ring member located opposite an arcuate slot;

a locking segment member mounted in said arcuate slot for selective abutting engagement with said sleeve member;

an end plate member mounted adjacent said ring member and said locking segment member;

a first locking bolt means for selectively causing axial abutting locking engagement between said end plate member and said ring member; and a second locking bolt means for selectively causing axial abutting locking engagement between said locking segment member and said sleeve member.

18. The invention as defined in claim 10 and further comprising:

each of said intermediate roll means having a non-rotatable roll shaft member with axially spaced end portions for rotatably supporting an intermediate roll member relative to adjacent roll means;

intermediate roll shaft axially spaced mounting means for rotatably supporting and maintaining parallelism of each intermediate roll means;

alignment and parallelism maintaining means associated with said mounting means for precision location and alignment of said intermediate roll means relative to adjacent roll means; and pressure adjustment means associated with each mounting means for adjusting and maintaining contact pressure between said intermediate roll means and adjacent roll means.

19. The invention as defined in claim 18 and wherein said mounting means each comprising:

a block member fixedly mounted on a frame side wall;

a slot in each block member having precision machined opposite parallel side surfaces and an end surface;

a shaft member for supporting said intermediate roll means and having opposite end portions with precision machined opposite flat side surfaces and an end surface and a slot located between said flat surfaces;

said alignment and parallelism maintaining means being provided by each of said end portions of said shaft member being mounted in said slot in said block member with said opposite side surfaces of said block member slidably abuttingly engaging said opposite flat side surfaces of said shaft end portions and said end surface of said shaft portions being located closely adjacent said end surface of said slot in said block member;

a plate member fixedly mounted on said block member on a side of said slot located opposite the adjacent roll means and having an adjustment threaded bolt with an end portion extending into said mounting slot and into abutting engagement with said shaft slot and providing said pressure adjustment means to enable selective lateral adjustment of said shaft end portion to selectively adjust and maintain pressure of said intermediate roll means relative to adjacent roll means.

20. The invention as defined in claim 1, 2 or 6 and wherein:

said plate cylinder means and said ink transfer system being mounted on one side of said rigid frame plate means;

said plate cylinder drive means and said roll system gear drive means being mounted on the opposite side of said frame plate means;

lubricating means for said plate cylinder drive means and said roll system drive means mounted on the opposite side of said rigid frame plate means; and sealing means associated with said gear drive means and said rigid frame plate means for preventing flow of lubricant to said ink transfer system.

21. The invention as defined in claim 1 and wherein each of said plate cylinder means comprising:

an outer hub member having a central bore and axially spaced end surfaces on opposite sides of said frame plate means and a counterbore in each end of said hub member and being fixedly mounted in one of said mounting openings in said frame plate means in approximate parallel alignment with said blanket wheel means;

a pair of flanged bearing sleeve means having a central precision machined bore and being mounted in each counterbore in said hub member in coaxial relationship and defining a first central axis of rotation;

an inner hub member having precision machined cylindrical axially spaced outer peripheral end surface portions rotatably and axially slidably coaxially mounted in and supported by said central precision machined bore of each of said flange bearing sleeve members and having a central eccentric bore with precision machined axially spaced coaxial bore end portions defining a second central axis of rotation which is eccentric to said first axis of rotation;

precision bearing means mounted in said coaxial bore end portions;

a precision machined main shaft member having a central axis of rotation and a central shaft portion rotatably and axially slidably mounted in said inner hub member by said bearing means in coaxial relationship with said central eccentric bore and having one end portion located adjacent said blanket wheel means and one other end portion located asjacent said bull gear means;

end plate means fastened to said end portions of said inner hub member for holding said bearing means in said bore end portions;

a plate cylinder means mounted on said one end portion of said main shaft member in ink transfer relationship with said blanket wheel means;

gear means mounted on said other end portion of said main shaft member in driving engagement with said bull gear means;

eccentric adjustment means associated with said inner hub member for selectively causing rotation of said inner hub member relative to said sleeve means and changing the location of said central axis of rotation of said main shaft member relative to said blanket wheel means to selectively move said plate cylinder member toward and away from said blanket wheel means while maintaining parallelism therebetween and effecting adjustment of contact pressure between said plate cylinder member and said blanket wheel means;

image height registration adjustment means associated with said inner hub member for selectively causing axial displacement of said inner hub member and said main shaft member relative to said sleeve means and selectively changing the axial location of said plate cylinder member relative to said blanket wheel means while maintaining parallelism therebetween and effecting height registration of the ink image; and image circumferential registration adjustment means associated with said gear means for selectively causing rotation of said shaft member and said plate cylinder member relative to said blanket wheel means and selectively changing the circumferential location of said plate cylinder member relative to said blanket wheel means while maintaining parallelism therebetween and effecting circumferential registration of the ink image.

22. The invention as defined in claim 21 and wherein said eccentric adjustment means comprising:

a first abutment flange means fixedly mounted on a front end portion of said inner hub member and extending radially outwardly therefrom;

an abutment plate means fixed to said plate frame means adjacent said cylinder assembly and engaging said first abutment flange means to hold said inner hub member in a selected circumferentially displaced position relative to said outer hub member;

a second abutment flange means fixedly mounted on a rear end portion of said inner hub member and extending radially outwardly therefrom; and a resilient stop means fixedly mounted on said frame plate means for engaging said second abutment flange means and holding said inner hub member in a selected circumferentially displaced location relative to said outer hub member.

23. The invention as defined in claim 22 and further comprising:

axial tightening means for providing and maintaining axial abutting engagement between all axially adjacent transverse surfaces.

24. The invention as defined in claim 23 and wherein said axial tightening means comprising:

a sleeve member axially slidably mounted on said shaft member adjacent and in abutting engagement with said bearing means at said other end of said inner hub member;

a ring member having circumferentially spaced compression spring devices axially slidably mounted on said shaft member adjacent and in abutting engagement with said sleeve member; and a threaded collar member threadably mounted on said shaft member adjacent and in abutting engagement with said ring member.

25. The invention as defined in claim 24 and wherein said axial tightening means further comprising:

a sleeve member mounted between and abutting said axially spaced bearing means for transmitting axial force and maintaining the axial spacing therebetween.

26. The invention as defined in claim 25 and wherein said axial tightening means further comprising:

a pair of threaded sleeve members mounted in opposite ends of said bore in said slide block member and being rotatable therein and having a central threaded bore for engaging said threaded shaft portion and having a flange portion with arcuate bolt slots;

bolt means extending through said bolt slots into said slide block member for fixedly non-rotatably holding said sleeve members on said block member in a tightened condition while enabling opposite rotation of said sleeve members relative to said block member and said shaft member in a loosened condition to cause tight engagement of the threads on the sleeve members with the threads on the shaft member.

27. The invention as defined in claim 22 and said bull gear means having helical teeth and said drive gear means comprising:

an inner hub member rotatably and axially displaceably mounted on an end portion of said shaft member;

a drive gear member mounted on said inner hub member and having helical gear teeth;

an anti-back lash gear member mounted on said ring gear member and having helical teeth;

keyway slot means extending through said drive gear member and said anti-back lash gear member;

key means fixedly mounted on said hub member and slidably mounted in said keyway slot means for transmitting non-slip rotating force from said drive gear member to said hub member while enabling selective axial adjustment movement of said drive gear member relative to said hub member;

a friction drive member mounted on said one end of said shaft member adjacent said hub member and being frictionally driveably engaged therewith and rotated thereby;

a second key means for driveably connecting said friction drive member to said hub member; and end plate means abutting said friction drive means and being fixedly connected to said one end of said shaft member for holding said gear means on said shaft means.

28. The invention as defined in claim 27 and further comprising:

adjustable circumferential stop means associated with said drive gear key means for preventing relative circumferential displacement of said drive gear member relative to said hub member.

29. The invention as defined in claim 28 and wherein said circumferential stop means comprising:

a pair of roller members mounted on said drive gear member and abuttingly engaging opposite side surfaces of said key member.

30. The invention as defined in claim 29 and wherein said circumferential stop means further comprising:

an adjustable plate means on said gear member for mounting said roller members to change the location of the rotational axis and maintain tight abutting engagement of said roller members with said key means.

31. The invention as defined in claim 30 and wherein said adjustable plate means comprising:

a plate member supporting said roller members and having axially spaced arcuate bolt slots; and bolt members extending through said arcuate bolt slots into said drive gear member to fixedly hold said plate member on said drive gear member in a tightened condition and to allow pivotal movement of said plate member in a loosened condition to position said roller members in tight abutting engagement with said key means.

32. The invention as defined in claim 21 or 22 and wherein said height registration means comprising:

an abutment plate means fixed to a rear end portion of said inner hub member and extending radially outwardly therefrom for transmitting axial force to said inner hub member and for restricting axial movement of said inner hub member;

a rotatable adjustment shaft means mounted in said plate frame means adjacent to and in parallel relationship with said plate cylinder assembly and having one end portion located adjacent said plate cylinder member and one other threaded end portion located adjacent said gear means for rotation relative to said inner hub member;

fixed guide shaft means mounted in said plate frame means adjacent to and in parallel relationship with said adjustment shaft means;

an axially displaceable slide block means having a threaded bore mounted on said threaded end portion of said rotatable adjustment shaft means for axial displacement relative to said inner hub member caused by rotation of said adjustment shaft means and having guide bore means for receiving said guide shaft means and causing axial displacement of said slide block means during rotation of said adjustment shaft means; and a pair of axially spaced roller means mounted on said slide block means and located on opposite sides of and in abutting engagement with opposite side surfaces of said abutment plate means for transmitting force thereto to cause axial movement of said inner hub member during rotation of said adjustment shaft means and for holding said inner hub member in a selected axial location;

manually operable control means on said one end of said adjustment shaft means for selective rotation thereof; and locking means associated with said control means for locking said control means and said adjustment shaft means in a selected position.

33. The invention as defined in claim 32 and wherein said roller means comprises:

an eccentric sleeve means for supporting one of said roller means; and roller location adjustment means associated with said eccentric sleeve means for causing said roller means to tightly engage said abutment plate means.

34. The invention as defined in claim 32 and wherein said circumferential registration means comprising:

an abutment plate means fixed to a rear end portion of said drive gear means and extending radially outwardly therefrom for transmitting axial force to said drive gear means and for restricting axial movement of said gear means;

a rotatable adjustment shaft means mounted in said plate frame means adjacent to and in parallel relationship with said plate cylinder assembly and having one end portion located adjacent said plate cylinder member and one other threaded end portion located adjacent said gear means for rotation relative to said inner hub member;

fixed guide shaft means mounted in said plate frame means adjacent to and in parallel relationship with said adjustment shaft means;

an axially displaceable slide block means having a threaded bore mounted on said threaded end portion of said rotatable adjustment shaft means for axial displacement relative to said gear means caused by rotation of said adjustment shaft means and having guide bore means for receiving said guide shaft means and causing axial displacement of said slide block means during rotation of said adjustment shaft means; and a pair of axially spaced roller means mounted on said slide block means and located on opposite sides of and in abutting engagement with opposite side surfaces of said abutment plate means for transmitting force thereto to cause axial movement of said gear means relative to said bull gear means during rotation of said adjustment shaft means and for holding said gear means in a selected axial location;

manually operable control means on said one end of said adjustment shaft means for selective rotation thereof; and locking means associated with said control means for locking said control means and said adjustment shaft means in a selected position.

35. The invention as defined in claim 34 and wherein said roller means comprising:

an eccentric sleeve means for supporting one of said roller means; and roller location adjustment means associated with said eccentric sleeve means for causing said roller means to tightly engage said abutment plate means.

36. The invention as defined in claim 22 and wherein said first abutment flange means is located 180° opposite said second abutment flange means for exerting axially and circumferentially offset oppositely directed forces on said inner hub member to prevent lateral displacement.

37. A method of assembly and adjustment of a plurality of plate cylinder means and associated ink transfer roll means and ink supply fountain means on a vertical support plate frame means adjacent a blanket wheel means of a can decorator machine comprising:

machining plate cylinder mounting bores and ink station slots in the vertical support plate frame means;

fixedly mounting plate cylinder support hub members having central plate cylinder assembly mounting bores in each of the plate cylinder mounting bores;

accurately precision machining the end surfaces and the mounting bores of the plate cylinder support hub members to provide parallel aligned end surface and axially spaced mounting bore portions and parallel adjustment control mounting bores located in precise radially, outwardly spaced relationship to the axially spaced mounting bore portions;

loosely inserting a plate cylinder assembly including a plate cylinder member and axially spaced precisely accurately machined support sleeve members in said axially spaced mounting bore portions with the axially spaced support sleeve members loosely located in the axially spaced mounting bore portion;

individually adjusting the position of each plate cylinder member relative to the blanket wheel means to obtain a position of approximate alignment therewith;

individually fastening each of the axially spaced support sleeve members of each of the plate cylinder assemblies to each of the plate cylinder support hub members in the position of approximate alignment;

mounting separate plate cylinder precision alignment adjustment means in each of the adjustment control mounting bores associated with each plate cylinder assembly and connecting each plate cylinder precision alignment adjustment means with each associated plate cylinder assembly;

separately adjusting end plate cylinder assembly by use of the plate cylinder precision alignment adjustment means to obtain separate precision alignment of each plate cylinder relative to the blanket wheel means;

separately mounting each of the associated ink transfer roll means and ink supply fountain means on a separate ink system support frame means;

separately mounting each ink system support frame means on the vertical support plate frame means in the ink supply system slots with a form roll in juxtaposition to each of the plate cylinders; and adjusting the position for each form roll relative to each associated plate cylinder until the axis of each form roll is substantially parallel to the axis of the associated plate cylinder.

38. A decorator apparatus for applying a decorative ink image to the cylindrical outer surface of a one piece aluminum or steel can body or the like comprising:

a rotatable mandrel wheel means for supporting can body members on circumferentially spaced mandrel members;

infeed means for loading undecorated can body members onto the mandrel members;

a rotatable inking blanket wheel means having a plurality of circumferentially spaced blanket segment means thereon for applying ink images to the can body members;

a plurality of circumferentially spaced plate cylinder means for transferring ink images to said blanket segment means;

a plurality of circumferentially spaced ink fountain means for holding a supply of ink for each of said plate cylinder means;

an ink transfer system associated with each ink fountain means including a plurality of ink transfer roll means associated with each ink fountain means for transferring ink from each fountain means to an associated plate cylinder means and then to the blanket segment means;

a transfer wheel means for receiving decorated can body members from the mandrel wheel means;

a can carrying means for receiving decorated can body members from the transfer wheel means and transferring the decorated can body members away from the decorator apparatus;

a main base frame means for supporting the decorator apparatus and a vertically extending rigid frame plate means for supporting said plate cylinder means and said ink fountain means and said ink transfer system in juxtaposition to said blanket wheel means;

a motor means and a main drive means operatively associated with the various wheel means for causing synchronous rotation thereof and including a bull gear means for driving said blanket wheel means;

each of said plate cylinder means being constructed and mounted as a separate sub-assembly on said frame plate means and comprising:

an outer hub member having a central bore and axially spaced end surfaces on opposite sides of said plate frame means and a counterbore in each end of said hub member and being fixedly mounted in said plate frame means in approximate parallel alignment with said blanket wheel means;

a counterbore in each end of said hub member;

a pair of flanged bearing sleeve means having a central precision machined bore and being mounted in each counterbore in said hub member in coaxial relationship and defining a first central axis of rotation;

an inner hub member having precision machined cylindrical axially spaced outer peripheral end surface portions rotatably and axially slidably coaxially mounted in and supported by said central precision machined bore of each of said flange bearing sleeve members and having a central eccentric bore with precision machined axially spaced coaxial bore end portions defining a second central axis of rotation which is eccentric to said first axis of rotation;

precision bearing means mounted in said coaxial bore end portions;

a precision machined main shaft member having a central axis of rotation and a central shaft portion rotatably and axially slidably mounted in said inner hub member by said bearing means in coaxial relationship with said central eccentric bore and having one end portion located adjacent said blanket wheel means and one other end portion located adjacent said bull gear means;

end plate means fastened to said end portions of said inner hub member for holding said bearing means in said bore end portions;

a plate cylinder means mounted on said one end portion of said main shaft member in ink transfer relationship with said blanket wheel means;

gear means mounted on said other end portion of said main shaft member in driving engagement with said bull gear means;

eccentric adjustment means associated with said inner hub member for selectively causing rotation of said inner hub member relative to said sleeve means and changing the location of said central axis of rotation of said main shaft member relative to said blanket wheel means to selectively move said plate cylinder member toward and away from said blanket wheel means while maintaining parallelism therebetween and effecting adjustment of contact pressure between said plate cylinder member and said blanket wheel means;

image height registration adjustment means associated with said inner hub member for selectively causing axial displacement of said inner hub member and said main shaft member relative to said sleeve means and selectively changing the axial location of said plate cylinder member relative to said blanket wheel means while maintaining parallelism therebetween and effecting height registration of the ink image; and image circumferential registration adjustment means associated with said gear means for selectively causing rotation of said shaft member and said plate cylinder member relative to said blanket wheel means and selectively changing the circumferential location of said plate cylinder member relative to said blanket wheel means while maintaining parallelism therebetween and effecting circumferential registration of the ink image.

39. The invention as defined in claim 38 and wherein said eccentric adjustment means comprising:

a first abutment flange means fixedly mounted on a front end portion of said inner hub member and extending radially outwardly therefrom;

an abutment plate means fixed to said plate frame means adjacent said cylinder assembly and engaging said first abutment flange means to hold said inner hub member in a selected circumferentially displaced position relative to said outer hub member;

a second abutment flange means fixedly mounted on a rear end portion of said inner hub member and extending radially outwardly therefrom; and a resilient stop means fixedly mounted on said frame plate means for engaging said second abutment flange means and holding said inner hub member in a selected circumferentially displaced location relative to said outer hub member.

40. The invention as defined in claims 38 or 39 and wherein said height registration means comprising:

an abutment plate means fixed to a rear end portion of said inner hub member and extending radially outwardly therefrom for transmitting axial force to said inner hub member and for restricting axial movement of said inner hub member;

a rotatable adjustment shaft means mounted in said plate frame means adjacent to and in parallel relationship with said plate cylinder assembly and having one end portion location adjacent said plate cylinder member and one other threaded end portion located adjacent said gear means for rotation relative to said inner hub member;

fixed guide shaft means mounted in said plate frame means adjacent to and in parallel relationship with said adjustment shaft means;

an axially displaceable slide block means having a threaded bore mounted on said threaded end portion of said rotatable adjustment shaft means for axial displacement relative to said inner hub member caused by rotation of said adjustment shaft means and having guide bore means for receiving said guide shaft means and causing axial displacement of said slide block means during rotation of said adjustment shaft means; and a pair of axially spaced roller means mounted on said slide block means and located on opposite sides of and in abutting engagement with opposite side surfaces of said abutment plate means for transmitting force thereto to cause axial movement of said inner hub member during rotation of said adjustment shaft means and for holding said inner hub member in a selected axial location;

manually operable control means on said one end of said adjustment shaft means for selective rotation thereof; and locking means associated with said control means for locking said control means and said adjustment shaft means in a selected position.

41. The invention as defined in claim 40 and wherein said roller means comprises:

an eccentric sleeve means for supporting one of said roller means; and roller location adjustment means associated with said eccentric sleeve means for causing said roller means to tightly engage said abutment plate means.

42. The invention as defined in claim 38 or 39 and wherein said circumferential registration means comprising:

an abutment plate means fixed to a rear end portion of said drive gear means and extending radially outwardly therefrom for transmitting axial force to said drive gear means and for restricting axial movement of said gear means;

a rotatable adjustment shaft means mounted in said plate frame means adjacent to and in parallel relationship with said plate cylinder assembly and having one end portion located adjacent said plate cylinder member and one other threaded end portion located adjacent said gear means for rotation relative to said inner hub member;

fixed guide shaft means mounted in said plate frame means adjacent to and in parallel relationship with said adjustment shaft means;

an axially displaceable slide block means having a threaded bore mounted on said threaded end portion of said rotatable adjustment shaft means for axial displacement relative to said gear means caused by rotation of said adjustment shaft means and having guide bore means for receiving said guide shaft means and causing axial displacement of said slide block means during rotation of said adjustment shaft means; and a pair of axially spaced roller means mounted on said slide block means and located on opposite sides of and in abutting engagement with opposite side surfaces of said abutment plate means for transmitting force thereto to cause axial movement of said gear means relative to said bull gear means during rotation of said adjustment shaft means and for holding said gear means in a selected axial location;

manually operable control means on said one end of said adjustment shaft means for selective rotation thereof; and locking means associated with said control means for locking said control means and said adjustment shaft means in a selected position.

43. The invention as defined in claim 42 and wherein said roller means comprising:

an eccentric sleeve means for supporting one of said roller means; and roller location adjustment means associated with said eccentric sleeve means for causing said roller means to tightly engage said abutment plate means.

44. The invention as defined in claim 38 or 39 and further comprising:

axial tightening means for providing and maintaining axial abutting engagement between all axially adjacent transverse surfaces.

45. The invention as defined in claim 44 and wherein said axial tightening means comprising:

a sleeve member axially slidably mounted on said shaft member adjacent and in abutting engagement with said bearing means at said other end of said inner hub member;

a ring member having circumferentially spaced compression spring devices axially slidably mounted on said shaft member adjacent and in abutting engagement with said sleeve member; and a threaded collar member threadably mounted on said shaft member adjacent and in abutting engagement with said ring member.

46. The invention as defined in claim 45 and wherein said axial tightening means further comprising:

a sleeve member mounted between and abutting said axially spaced bearing means for transmitting axial force and maintaining the axial spacing therebetween.

47. The invention as defined in claim 46 and wherein said axial tightening means further comprising:

a pair of threaded sleeve members mounted in opposite ends of asid bore in said slide block member and being rotatable therein and having a central threaded bore for engaging said threaded shaft portion and having a flange portion with arcuate bolt slots; and bolt means extending through said bolt slots into said slide block member for fixedly non-rotatably holding said sleeve members on said block member in a tightened condition while enabling opposite rotation of said sleeve members relative to said block member and said shaft member in a loosened condition to cause tight engagement of the threads on the sleeve members with the threads on the shaft member.

48. The invention as defined in claim 38 and said bull gear means having helical teeth and said drive gear means comprising:

an inner hub member rotatably and axially displaceably mounted on an end portion of said shaft member;

a drive gear member mounted on said inner hub member and having helical gear teeth;

an anti-back lash gear member mounted on said ring gear member and having helical teeth;

keyway slot means extending through said drive gear member and said anti-back lash gear member;

key means fixedly mounted on said hub member and slidably mounted in said keyway slot means for transmitting non-slip rotating force from said drive gear member to said hub member while enabling selective axial adjustment movement of said drive gear member relative to said hub member;

a friction drive member mounted on said one end of said shaft member adjacent said hub member and being frictionally driveably engaged therewith and rotated thereby;

a second key means for driveably connecting said friction drive member to said hub member; and end plate means abutting said friction drive means and being fixedly connected to said one end of said shaft member for holding said gear means on said shaft means.

49. The invention as defined in claim 48 and further comprising:

adjustable circumferential stop means associated with said drive gear key means for preventing relative circumferential displacement of said drive gear member relative to said hub member.

50. The invention as defined in claim 49 and wherein said circumferential stop means comprising:

a pair of roller members mounted on said drive gear member and abuttingly engaging opposite side surfaces of said key member.

51. The invention as defined in claim 50 and wherein said circumferential stop means further comprising:

an adjustable plate means on said gear member for mounting said roller members to change the location of the rotational axis and maintain tight abutting engagement of said roller members with said key means.

52. The invention as defined in claim 51 and wherein said adjustable plate means comprising:

a plate member supporting said roller members and having axially spaced arcuate bolt slots; and bolt members extending through said arcuate bolt slots into said drive gear member to fixedly hold said plate member on said drive gear member in a tightened condition and to allow pivotal movement of said plate member in a loosened condition to position said roller members in tight abutting engagement with said key means.

53. A decorator apparatus for applying a decorative ink image to the cylindrical outer surface of a one piece aluminum or steel can body or the like comprising:

a rotatable mandrel wheel means for supporting can body members on circumferentially spaced mandrel members;

infeed means for loading undecorated can body members onto the mandrel members;

a rotatable inking blanket wheel means having a plurality of circumferentially spaced blanket segment means thereon for applying ink images to the can body membes;

a plurality of circumferentially spaced plate cylinder means for transferring ink images to said blanket segment means;

a plurality of circumferentialy spaced ink fountain means for holding a supply of ink for each of said plate cylinder means;

an ink transfer system associated with each ink fountain means including a plurality of ink transfer roll means associated with each ink fountain means for transferring ink from each fountain means to an associated plate cylinder means and then to the blanket segment means;

a transfer wheel means for receiving decorated can body members from the mandrel wheel means;

a can carrying means for receiving decorated can body members from the transfer wheel means and transferring the decorated can body members away from the decorator apparatus;

a main base frame means for supporting the decorator apparatus and a vertically extending rigid frame plate means for supporting said plate cylinder means and said ink fountain means and said ink transfer system in juxtaposition to said blanket wheel means;

a motor means and a main drive means operatively associated with the various wheel means for causing synchronous rotation thereof;

said ink transfer system for transferring ink from said fountain ink supply means to said plate cylinder means comprising:

a pair of form roll means for transferring ink to said plate cylinder means at two peripherally spaced locations;

a pair of form roll engaging vibrator roll means including a first form roll engaging vibrator roll means for engaging and transferring ink to a first one of said pair of form roll means and a second form roll engaging vibrator roll means for engaging and transferring ink to a second one of said pair of form roll means;

a first intermediate distributing roll means engaging said first form roll engaging vibrator roll means for transferring ink thereto;

a second intermediate distributing roll means for engaging said first form roll engaging vibrator means and receiving ink therefrom and for engaging said second form roll engaging vibrator means and transferring ink thereto from said first form roll engaging vibrator roll means; and a third intermediate vibrator roll means for engaging said first intermediate distributing roll means and transferring ink thereto:

a pair of pivotal bracket means mounted on opposite end portions of each form roll engaging vibrator roll means;

a form roll shaft means for each form roll means having opposite end portions rotatably supported by one end portion of said pivotal bracket means and supporting each form roll means in ink transfer contact with said plate cylinder means and with the associated vibrator roll means;

selectively adjustable stop means associated with one other end portion of each of said pivotal bracket means for selectively adjusting and maintaining parallelism of said form roll means relative to said plate cylinder means and for selectively adjusting and maintaining ink contact transfer pressure between said form roll means and said plate cylinder means; said selectively adjustable stop means comprising:

a pair of abutment plate members mounted on the other end portions of each of said bracket members and having inclined abutment surfaces;

an adjustment shaft member mounted adjacent and in parallel relationship to asid vibrator roll means and having a first portion located adjacent one of said bracket means and a second portion located adjacent said other one of said bracket means;

a pair of conical cam devices eccentrically mounted on said adjustment shaft portions in abutting engagement with said inclined abutment surfaces at 180° offset locations;

selectively operable parallelism control means for selectively causing rotation of said shaft means and said cam devices relative to said abutment plate members to selectively vary the contact positions and effect and maintain parallelism of said roll form means relative to said plate cylinder means by unequal pivotal displacement of said pivotal bracket means; and selectively operable pressure control means for selectively causing axial displacement of said shaft means and said cam devices relative to said abutment plate means to selectively adjust the contact pressure between said form roll means and said plate cylinder means by equal pivotal displacement of said bracket means while maintaining parallelism.

54. The invention as defined in claim 53 and wherein said adjustment control means comprises:

threaded nut means fixedly mounted on said shaft member;

threaded sleeve means rotatably engageable with said threaded nut means and being rotatable relative to said shaft means and said nut means for causing axial displacement of said shaft means;

a first handle means connected to said threaded sleeve means for causing selective rotation of said sleeve means to cause axial displacement of said shaft means and said cam devices to adjust and maintain contact pressure;

a second handle means connected to said shaft means for causing selective rotation of said shaft means to change the eccentric relationship of said cam devices relative to said stop plate means to adjust and maintain parallelism; and locking means associated with said threaded sleeve means for selectively separately locking and unlocking said handle means.

55. The invention as defined in claim 54 and wherein said locking means comprising:

a sleeve member having a radially outwardly extending flange portion and being fixed to said shaft member for rotation therewith;

a ring member mounted on said sleeve member and having a radially inwardly extending flange portion adjacent said radially outwardly extending flange portion and being selectively rotatable relative thereto;

an arcuate offset side surface on said ring member located opposite an arcuate slot;

a locking segment member mounted in said arcuate slot for selective abutting engagement with said sleeve member;

an end plate member mounted adjacent said ring member and said locking segment member;

a first locking bolt means for selectively causing axial abutting locking engagement between said end plate member and said ring member; and a second locking bolt means for selectively causing axial abutting locking engagement between said locking segment member and said sleeve member.

56. A decorator apparatus for applying a decorative ink image to the cylindrical outer surface of a one piece aluminum or steel can body or the like comprising:

a rotatable mandrel wheel means for supporting can body members on circumferentially spaced mandrel members;

infeed means for loading undecorated can body members onto the mandrel members;

a rotatable inking blanket wheel means having a plurality of circumferentially spaced blanket segment means thereon for applying ink images to the can body members;

a plurality of circumferentially spaced plate cylinder means for transferring ink images to said blanket segment means;

a plurality of circumferentially spaced ink fountain means for holding a supply of ink for each of said plate cylinder means;

an ink transfer system associated with each ink fountain means including a plurality of ink transfer roll means associated with each ink fountain means for transferring ink from each fountain means to an associated plate cylinder means then to the blanket segment means;

a transfer wheel means for receiving decorated can body members from the mandrel wheel means;

a can carrying means for receiving decorated can body members from the transfer wheel means and transferring the decorated can body members away from the decorator apparatus;

a main base frame means for supporting the decorator apparatus and a vertically extending rigid frame plate means for supporting said plate cylinder means and said ink fountain means and said ink transfer system in juxtaposition to said blanket wheel means;

a motor means and a main drive means operatively associated with the various wheel means for causing synchronous rotation thereof;

said ink transfer system for transferring ink from said fountain ink supply means to said plate cylinder means comprising:

a pair of form roll means for transferring ink to said plate cylinder means at two peripherally spaced locations;

a pair of form roll engaging vibrator roll means including a first form roll engaging vibrator roll means for engaging and transferring ink to a first one of said pair of form roll means and a second form roll engaging vibrator roll means for engaging and transferring ink to a second one of said pair of form roll means;

a first intermediate distributing roll means engaging said first form roll engaging vibrator roll means for transferring ink thereto;

a second intermediate distribution roll means for engaging said first form roll engaging vibrator means and receiving ink therefrom and for engaging said second form roll engaging vibrator means and trasnferring ink thereto from said first form roll engaging vibrator roll means;

a third intermediate vibrator roll means for engaging said first intermediate distributing roll means and transferring ink thereto;

each of said intermediate roll means having a non-rotatable roll shaft member with axially spaced end portions for rotatably supporting an intermediate roll member relative to adjacent roll means;

intermediate roll shaft axially spaced mounting means for rotatably supporting and maintaining parallelism of each intermediate roll means;

alignment and parallelism maintaining means associated with said mounting means for precision location and alignment of said intermediate roll means relative to adjacent roll means; and pressure adjustment means associated with each mounting means for adjusting and maintaining contact pressure between said intermediate roll means and adjacent roll means; said mounting means each comprising:

a block member fixedly mounted on a frame side wall;

a slot in each block member having precision machined opposite parallel side surfaces and an end surface;

a shaft member for supporting said intermediate roll means and having opposite end portions with precision machined opposite flat side surfaces and an end surface and a slot located between said flat surfaces;

said alignment and parallelism maintaining means being provided by each of said end portions of said shaft member being mounted in said slot in said block member with said opposite side surfaces of said block member slidably abuttingly engaging said opposite flat side surfaces of said shaft end portions and said end surface of said shaft portions being located closely adjacent said end surface of said slot in said block member; and a plate member fixedly mounted on said block member on a side of said slot located opposite the adjacent roll means having an adjustment threaded bolt with an end portion extending into said mounting slot and into abutting engagement with said shaft slot and providing said pressure adjustment means to enable selective lateral adjustment of said shaft end portion to selectively adjust and maintain pressure of said intermediate roll means relative to adjacent roll means.

57. A decorator apparatus for applying a decorative ink image to the cylindrical outer surface of a one piece aluminum or steel can body or the like comprising:

a rotatable mandrel wheel means for supporting can body members on circumferentially spaced mandrel members;

infeed means for loading undecorated can body members onto the mandrel members;

a rotatable inking blanket wheel means having a plurality of circumferentially spaced blanket segment means thereon for applying ink images to the can body members;

a plurality of circumferentially spaced plate cylinder means for transferring ink images to said blanket segment means;

a plurality of circumferentially spaced ink fountain means for holding a supply of ink for each of said plate cylinder means;

an ink transfer system associated with each ink fountain means including a plurality of ink transfer roll means associated with each ink fountain means for transferring ink from each fountain means to an associated plate cylinder means and then to the blanket segment means;

a transfer wheel means for receiving decorated can body members from the mandrel wheel means;

a can carrying means for receiving decorated can body members from the transfer wheel means and transferring the decorated can body members away from the decorator apparatus;

a main base frame means for supporting the decorator apparatus and a vertically extending rigid frame plate means for supporting said plate cylinder means and said ink fountain means and said ink transfer system in juxtaposition to said blanket wheel means;

a motor means and a main drive means operatively associated with the various wheel means for causing synchronous rotation thereof;

outer support means having central bore means and being mounted on said frame plate means for supporting said plate cylinder means and defining a first central axis of rotation;

an inner support means axially slidably coaxially mounted in and supported by said central bore means of said outer support means and having central eccentric bore means defining a second central axis of rotation which is eccentric to said first axis of rotation;

bearing means mounted in said central eccentric bore means in said inner support means;

main shaft means having a central axis of rotation and a central shaft portion rotatably and axially slidably mounted in said inner support means by said bearing means in coaxial relatonship with said central eccentric bore means and having one end portion located adjacent said blanket wheel means and one other end portion located adjacent said drive gear means;

a plate cylinder means mounted on said one end portion of said main shaft means in ink transfer relationship with said blanket wheel means;

driven gear means mounted on said other end portion of said main shaft means in driving engagement with said drive gear means;

eccentric adjustment means associated with said inner support means for selectively causing rotation of said inner support means relative to said outer support means and changing the location of said central axis of rotation of said main shaft member relative to said blanket wheel means to selectively move said plate cylinder member toward and away from said blanket wheel means while maintaining parallelism therebetween and effecting adjustment of contact pressure between said plate cylinder member and said blanket wheel means;

image height registration adjustment means associated with said inner support means for selectively causing axial displacement of said inner support means and said main shaft member relative to said outer support means and selectively changing the axial location of said plate cylinder member relative to said blanket wheel means while maintaining parallism therebetween and effecting height registration of the ink image; and image circumferential registration adjustment means associated with said driven gear means for selectively causing rotation of said shaft member and said plate cylinder member relative to said blanket wheel means and selectively changing the circumferential location of said plate cylinder member relative to said blanket wheel means while maintaining parallelism therebetween and effecting circumferential registration of the ink image.

58. The invention as defined in claim 57 and wherein said eccentric adjustment means comprising:

a first abutment flange means fixedly mounted on a front end portion of said inner support means and extending radially outwardly therefrom;

an abutment plate means fixed to said plate frame means adjacent said cylinder assembly and engaging said first abutment flange means to hold said inner support means in a selected circumferentially displaced position relative to said outer support means;

a second abutment flange means fixedly mounted on a rear end portion of said inner support means and extending radially outwardly therefrom; and a resilient stop means fixedly mounted on said frame plate means for engaging said second abutment flange means and holding said inner support means in a selected circumferentially displaced location relative to said outer support means.

59. The invention as defined in claim 57 or 58 and wherein said height registration means comprising:

an abutment plate means fixed to a rear end portion of said inner support means and extending radially outwardly therefrom for transmitting axial force to said inner support means and for restricting axial movement of said inner support means;

a rotatable adjustment shaft means mounted in said plate frame means adjacent to and in parallel relationship with said plate cylinder assembly and having one end portion located adjacent said plate cylinder member and one other threaded end portion located adjacent said driven gear means for rotation relative to said inner support means;

fixed guide shaft means mounted in said plate frame means adjacent to and in parallel relationship with said adjustment shaft means;

an axially displaceable slide block means having a threaded bore mounted on said threaded end portion of said rotatable adjustment shaft means for axial displacement relative to said inner support means caused by rotation of said adjustment shaft means and having guide bore means for receiving said guide shaft means and causing axial displacement of said slide block means during rotation of said adjustment shaft means; and a pair of axially spaced roller means mounted on said slide block means and located on opposite sides of and in abutting engagement with opposite side surfaces of said abutment plate means for transmitting force thereto to cause axial movement of said inner support means during rotation of said adjustment shaft means and for holding said inner support means in a selected axial location;

manually operable control means on said one end of said adjustment shaft means for selective rotation thereof; and locking means associated with said control means for locking said control means and said adjustment shaft means in a selected position.

60. The invention as defined in claim 59 and wherein said roller means comprises:

an eccentric sleeve means for supporting one of said roller means; and roller location adjustment means associated with said eccentric sleeve means for causing said roller means to tightly engage said abutment plate means.

61. The invention as defined in claim 57 or 58 and wherein said circumferential registration means comprising:

an abutment plate means fixed to a rear end portion of said driven gear means and extending radially outwardly therefrom for transmitting axial force to said driven gear means and for restricting axial movement of said driven gear means;

a rotatable adjustment shaft means mounted in said plate frame means adjacent to and in parallel relationship with said plate cylinder assembly and having one and portion located adjacent said plate cylinder member and one other threaded end portion located adjacent said driven gear means for rotation relative to said inner support means;

fixed guide shaft means mounted in said plate frame means adjacent to and in parallel relationship with said adjustment shaft means;

an axially displaceable slide block means having a threaded bore mounted on said threaded end portion of said rotatable adjustment shaft means for axial displacement relative to said driven gear means caused by rotation of said adjustment shaft means and having guide bore means for receiving said guide shaft means and causing axial displacement of said slide block means during rotation of said adjustment shaft means; and a pair of axially spaced roller means mounted on said slide block means and located on opposite sides of and in abutting engagement with opposite side surfaces of said abutment plate means for transmitting force thereto to cause axial movement of said driven gear means relative to said drive gear means during rotation of said adjustment shaft means and for holding said driven gear means in a selected axial location;

manually operable control means on said one end of said adjustment shaft means for selective rotation thereof; and locking means associated with said control means for locking said control means and said adjustment shaft means in a selected position.

62. The invention as defined in claim 61 and wherein said roller means comprising:

an eccentric sleeve means for supporting one of said roller means; and roller location adjustment means associated with said eccentric sleeve means for causing said roller means to tightly engage said abutment plate means.

63. The invention as defined in claim 57 and further comprising:

axial tightening means for providing and maintaining axial abutting engagement between all axially adjacent transverse surfaces.

64. The invention as defined in claim 63 and wherein said axial tightening means comprising:

a sleeve member axially slidably mounted on said shaft member adjacent and in abutting engagement with said bearing means at said other end of said inner support means;

a ring member having circumferentially spaced compression spring devices axially slidably mounted on said shaft member adjacent and in abutting engagement with said sleeve member; and a threaded collar member threadably mounted on said shaft member adjacent and in abutting engagement with said ring member.

65. The invention as defined in claim 63 and wherein said axial tightening means further comprising:

a sleeve member mounted between and abutting said axially spaced bearing means for transmitting axial force and maintaining the axial spacing therebetween.

66. The invention as defined in claim 65 and wherein said axial tightening means further comprising:

a pair of threaded sleeve members mounted in opposite ends of said bore in said slide block member and being rotatable therein and having a central threaded bore for engaging said threaded shaft portion and having a flange portion with arcuate bolt slots;

bolt means extending through said bolt slots into said slide block member for fixedly non-rotatably holding said sleeve members on said block member in a tightened condition while enabling opposite rotation of said sleeve members relative to said block member and said shaft member in a loosened condition to cause tight engagement of the threads on the sleeve members with the threads on the shaft member.

67. The invention as defined in claim 57 and said drive gear means having helical teeth and said driven gear means comprising:

an inner hub member rotatably and axially displaceably mounted on an end portion of said shaft member;

a drive gear member mounted on said inner hub member and having helical gear teeth;

an anti-back lash gear member mounted on said ring gear member and having helical teeth;

keyway slot means extending through said drive gear member and said anti-back lash gear member;

key means fixedly mounted on said hub member and slidably mounted in said keyway slot means for transmitting non-slip rotating force from said drive gear member to said hub member while enabling selective axial adjustment movement of said drive gear member relative to said hub member;

a friction drive member mounted on said one end of said shaft member adjacent said hub member and being frictionally driveably engaged therewith and rotated thereby;

a second key means for driveably connecting said friction drive member to said hub member; and end plate means abutting said friction drive means and being fixedly connected to said one end of said shaft member for holding said gear means on said shaft means.

68. The invention as defined in claim 67 and further comprising:

adjustable circumferential stop means associated with said drive gear key means for preventing relative circumferential displacement of said drive gear member relative to said hub member.

69. The invention as defined in claim 68 and wherein said circumferential stop means comprising:

a pair of roller members mounted on said drive gear member and abuttingly engaging opposite side surfaces of said key member.

70. The invention as defined in claim 69 and wherein said circumferential stop means further comprising:

an adjustable plate means on said gear member for mounting said roller members to change the location of the rotational axis and maintain tight abutting engagement of said roller members with said key means.

71. The invention as defined in claim 70 and wherein said adjustable plate means comprising:

a plate member supporting said roller members and having axially spaced arcuate bolt slots; and bolt members extending through said arcuate bolt slots into said drive gear member to fixedly hold said plate member on said drive gear member in a tightened condition and to allow pivotal movement of said plate member in a loosened condition to position said roller members in tight abutting engagement with said key means.

* * * * *